US005892190A

United States Patent [19]

Morita et al.

[11] Patent Number: 5,892,190

[45] **Date of Patent: *Apr. 6, 1999**

[54] METHOD AND SYSTEM OF CONTROLLING ELEVATORS AND METHOD AND APPARATUS OF INPUTTING REQUESTS TO THE CONTROL SYSTEM

[75] Inventors: Yuzo Morita, Hitachi; Toshimitsu Tobita; Kiyoshi Nakamura, both of Katsuta; Atsuya Fujino, Hitachi; Soshiro Kuzunuki, Katsuta; Kotaro Hirasawa, Hitachi; Yoshio Sakai, Ibaraki-ken; Kenji Yoneda; Takaaki Ueshima, both of Katsuta; Yuji Toda, Hitachi; Hiromi Inaba, Katsuta, all of Japan

[73] Assignee: Hitachi, Ltd., Tokyo, Japan

[ * ] Notice: The term of this patent shall not extend beyond the expiration date of Pat. No. 5,307,903.

[21] Appl. No.: 134,803

[22] Filed: Oct. 12, 1993

Related U.S. Application Data

[63] Continuation of Ser. No. 301,973, Jan. 26, 1989.

[30] Foreign Application Priority Data

| | | | |
|---|---|---|---|
| Jan. 29, 1988 | [JP] | Japan | 63-16983 |
| Jan. 29, 1988 | [JP] | Japan | 63-16984 |
| Mar. 2, 1988 | [JP] | Japan | 63-47480 |
| Mar. 7, 1988 | [JP] | Japan | 63-51493 |
| Mar. 9, 1988 | [JP] | Japan | 63-53532 |

[51] Int. Cl.[6] ..... B66B 1/36

[52] U.S. Cl. ..... 187/38; 187/387

[58] Field of Search ..... 187/121, 124, 187/125, 128, 101, 133, 247, 330, 382, 383, 384, 387, 391, 393, 381; 395/901, 918

[56] References Cited

U.S. PATENT DOCUMENTS

| | | | |
|---|---|---|---|
| 2,468,317 | 5/1949 | Watson | 187/128 |
| 3,891,064 | 6/1975 | Clark | 187/29 |
| 4,043,429 | 8/1977 | Hirasawa et al. | 187/124 |
| 4,246,983 | 1/1981 | Bril | 187/29 R |
| 4,690,243 | 9/1987 | Ichioka | 187/101 |
| 4,708,224 | 11/1987 | Schrooder | 187/122 |
| 4,719,996 | 1/1988 | Tsuji | 187/127 |
| 4,760,896 | 8/1988 | Yamaguchi | 187/124 |
| 4,860,207 | 8/1989 | Kubo | 187/124 |
| 4,947,965 | 8/1990 | Kuzunuki et al. | 187/127 |
| 4,984,174 | 1/1991 | Yasunobu et al. | 364/513 |
| 5,010,472 | 4/1991 | Yoenda et al. | 364/148 |
| 5,239,141 | 8/1993 | Tobita et al. | 187/124 |
| 5,307,903 | 5/1994 | Morita et al. | 187/124 |

FOREIGN PATENT DOCUMENTS

| | | |
|---|---|---|
| 8510800145 | 1/1989 | China . |
| 030823 | 3/1980 | European Pat. Off. . |

(List continued on next page.)

OTHER PUBLICATIONS

"An On–Line Tuning Method for Multi–Objective Control of Elevator Group", A. Fujino, et al., draft for IECON, 1992, IEEE, 1991.

*IECON 1991*, "An Elevator Characterized Group Supervisory Control System", T. Tobita, et al., IEEE 1991, pp. 1972–1976.

"Tamokuteki Ishi Detteo–Riron to Oyo–I, –Tamokuteki Ishi Kettei to AHP–" System to Seigyo, vol. 30, No. 7, pp. 430–438, 1986.

*Primary Examiner*—Robert E. Nappi

*Attorney, Agent, or Firm*—Antonelli, Terry, Stout & Kraus, LLP

[57] ABSTRACT

Elevator group supervisory control method and system for group supervisory control of a plurality of elevators serving a plurality of floors. The method and apparatus of the invention permits the inputting of qualitative requests (guidance), from the user, concerning elevator operation into the group supervisory control system. Qualitative requests concerning elevator operation are set in the form of guidance (or request) targets. The thus set request targets are converted into control targets for the elevators. Actual group supervisory control is executed using the control targets.

51 Claims, 70 Drawing Sheets

| NO | REQUEST TARGET ITEM | CONTROL TARGET ITEM |
|---|---|---|
| 1 | I LIKE TO TAKE RIGHT NOW $S_1$ | WAITING TIME (WAITING TIME AVERAGED OVER ALL PASSENGERS) |
| 2 | I DON'T WANT LONGTIME WAITING $S_2$ | RATE OF OCCURRENCE OF LONGTIME WAITING (PROBABILITY OF OCCURRENCE OF WAITING TIME OF ONE MINUTE OR MORE) |
| 3 | I LIKE TO GET TO DESTINED FLOOR IN A HURRY $S_3$ | RIDING TIME (INTERVAL OF TIME BETWEEN GETTING IN AND GETTING OFF CAGE) |
| 4 | I LIKE TO TAKE AN UNCROWDED CAGE $S_4$ | DEGREE OF JAM IN CAGE (PROPORTION OF PASSENGER NUMBER IN CAGE TO RATED CAPACITY) |
| 5 | I DON'T CHANGE A RESERVED CAGE $S_5$ | RESERVATION CHANGE RATE (RATE OF CHANGE OF ASSIGNMENT TO A DIFFERENT CAGE BECAUSE OF FULL-UP OR LONGTIME WAITING) |
| 6 | I WANT TO GET INFORMATION ABOUT A RESERVED CAGE RIGHT NOW $S_6$ | RESERVATION INFORMING TIME (INTERVAL OF TIME BETWEEN HALL CALL GENERATION AND GUIDANCE OF RESERVED CAGE) |
| 7 | MANY PASSENGERS SHOULD BE CONVEYED WITHIN A SHORT PERIOD OF TIME $S_7$ | TRANSPORT CAPABILITY (DEGREE OF OCCURRENCE OF DIVISIONAL EXPRESS OPERATION AND CONCENTRATED SERVICE WITHIN PREDETERMINED TIME ZONE) |
| 8 | I DON'T LIKE ARRIVAL OF AN UNRESERVED CAGE $S_8$ | RATE OF FIRST ARRIVE UNRESPONSIVE TO CAGE CALL (RATE OF FIRST ARRIVAL OF AN UNRESERVED CAGE IN RESPONSE TO A HALL CALL) |
| 9 | I LIKE THE CAGE TO STOP AT THE ZERO-TH FLOOR WITHOUT FAIL $S_9$ | FREQUENCY OF NONSTOP OF CAGE (FREQUENCY OF PASSAGE OF AN UNRESERVED CAGE THROUGH A CAGE CALL ORIGINATING FLOOR) |
| 10 | I LIKE A LARGE AMOUNT OF GENERAL INFORMATION GUIDE $S_{10}$ | INFORMATION GUIDE AMOUNT (ENTERTAINMENT GUIDE, WEATHER FORECASTING, TIME) |
| 11 | ENERGY SAVING RUNNING SHOULD BE DONE $S_{11}$ | ENERGY SAVING RATE (RATE OF REDUCTION OF ELEVATOR POWER CONSUMPTION) |

FOREIGN PATENT DOCUMENTS

| | | |
|---|---|---|
| A58-52162 | 2/1983 | Japan . |
| 58-63668 | 4/1983 | Japan . |
| B58-56709 | 12/1983 | Japan . |
| A59-48364 | 3/1984 | Japan . |
| A59-48369 | 3/1984 | Japan . |
| A59-223672 | 12/1984 | Japan . |
| B6247787 | 10/1987 | Japan . |
| B6270 | 1/1989 | Japan . |
| B6271 | 1/1989 | Japan . |
| 1374656 | 11/1974 | United Kingdom . |
| 2070280 | 9/1981 | United Kingdom . |
| 2110423 | 6/1983 | United Kingdom . |
| 2111244 | 6/1983 | United Kingdom . |
| 2136157 | 2/1984 | United Kingdom . |
| 2141843 | 1/1985 | United Kingdom . |
| 2195792 | 4/1988 | United Kingdom . |
| 2215488 | 9/1989 | United Kingdom . |
| 2216683 | 9/1989 | United Kingdom . |
| 2216299 | 10/1989 | United Kingdom . |
| 2216682 | 10/1989 | United Kingdom . |

FIG. 3

21a

| CONTROL TARGET | TARGET VALUE | WEIGHT |
|---|---|---|
| WAITING TIME AT HALL | WITHIN 40 sec | 8 |
| RIDING TIME | WITHIN 60 sec | 7 |
| RESERVATION CHANGE RATE | LESS THAN 5% | 5 |
| TRANSPORT CAPABILITY | MORE THAN 60PASSENGERS/min | 6 |
| PASSENGER NUMBER | LESS THAN 60% | 4 |
| RATE OF OCCURRENCE OF LONGTIME WAITING | LESS THAN 5% | 9 |
| | | |
| | | |
| | | |
| | | |
| | | |

FIG. 4

RULE 1
IF OFFICE BUILDING
THEN THE USER IS EXPERIENCED

RULE 2
IF THE USER IS EXPERIENCED
AND WEIGHT FOR RESERVATION CHANGE RATE IS LESS THAN NORMAL VALUE
THEN RESERVATION CHANGE IS EFFECTED UPON OCCURRENCE OF LONGTIME WAITING

RULE 3
IF SERVICES FOR FLOORS OCCUR FREQUENTLY
AND WAITING TIME AT HALL IS TO BE REDUCED
THEN DISTRIBUTE ELEVATORS FOR WAITING FOR CALLS

RULE 4
IF TRAFFIC IS SMALL
AND WEIGHT FOR RIDING TIME IS LARGE
THEN FOR CALL OF PREDICTIVE WAITING TIME OF 40 sec OR LESS FROM MIDWAY FLOOR, NO ELEVATOR IS ASSIGNED RULE 5
IF OFFICE BUILDING
AND TIME TO ATTEND OFFICE
THEN SERVICES ARE CONCENTRATED ON REFERENCE FLOOR

RULE 6
IF GOVERNMENT OR PUBLIC BUILDING
THEN PASSENGERS ARE NOT EXPERIENCED

RULE 7
IF PASSENGERS ARE NOT EXPERIENCED
AND WEIGHT FOR RESERVATION CHANGE RATE IS NOT THE LOWEST
THEN RESERVATION CHANGE IS EFFECTED ONLY WHEN LONGTIME WAITING OF 70 sec OR MORE OCCURS

FIG. 6

| ELEVATOR PERFORMANCE AND ELEVATOR-SURROUNDING ENVIRONMENT | SET VALUE |
|---|---|
| THE NUMBER OF ELEVATORS | 8 |
| SPEED OF ELEVATOR No. 1 | 150m/min |
| SPEED OF ELEVATOR No. 2 | 150m/min |
| | |
| | |
| SERVICE FLOOR OF ELEVATOR No. 1 | 1-15 |
| SERVICE FLOOR OF ELEVATOR No. 2 | 1-15 |
| | |
| | |
| IS THERE A NEARBY CROSSING ? | YES |
| ARE DRESSING ROOM AND PLACE OF WORK AT DIFFERENT FLOORS ? | NO |
| | |

FIG. 7

21d

3

2

| CANDIDATE FOR CONTROL METHOD 1 | |
|---|---|
| CONTROL TARGET | PREDICTIVE VALUE |
| WAITING TIME AT HALL | 47 sec |
| RIDING TIME | 59 sec |
| RESERVATION CHANGE RATE | 2 % |
| TRANSPORT CAPABILITY | 55.3 PASSENGERS/min |
| PASSENGER NUMBER | 65 % |
| RATE OF OCCURRENCE OF LONGTIME WAITING | 7 % |

OBJECTIVE FUNCTION SPACE x - f SPACE

OBJECTIVE FUNCTION SPACE x-f SPACE

FIG. 16

INPUT THE TYPE OF BUILDING

1) BUILDING FOR ONLY ONE COMPANY RESIDENT

2) HOTEL

3) DEPARTMENT STORE

4) TENANT BUILDING

CHOOSE ONE OF ITEMS 1) TO 4)

INPUT TARGET VALUES OF INDIVIDUAL CONTROL TARGETS

1) WAITING TIME AT HALL WITHIN 40 sec

2) RIDING TIME WITHIN 60 sec

3) RESERVATION CHANGE RATE LESS THAN 5%

4) TRANSPORT CAPABILITY MORE THAN 60 PASSENGERS/min

5) PASSENGER NUMBER LESS THAN 60%

6) RATE OF OCCURRENCE OF LONGTIME WAITING LESS THAN 5%

INPUT PRIORITY RANKS FOR INDIVIDUAL CONTROL TARGETS

1) WAITING TIME AT HALL 2

2) RIDING TIME 3

3) RESERVATION CHANGE RATE 5

4) TRANSPORT CAPABILITY 4

5) PASSENGER NUMBER 6

6) RATE OF OCCURRENCE OF LONGTIME WAITING 1

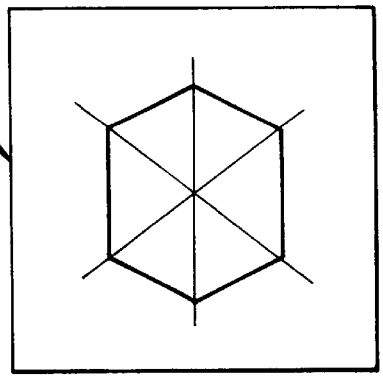

EXAMPLE OF REQUEST OR FEELING TARGETS IN THE CASE OF HOTEL

EXAMPLE OF REQUEST TARGETS IN THE CASE OF BUILDING FOR ONLY ONE COMPANY RESIDENT

FIG. 28

| NO | REQUEST TARGET ITEM | CONTROL TARGET ITEM |
|---|---|---|
| 1 | I LIKE TO TAKE RIGHT NOW $S_1$ | WAITING TIME (WAITING TIME AVERAGED OVER ALL PASSENGERS) |
| 2 | I DON'T WANT LONGTIME WAITING $S_2$ | RATE OF OCCURRENCE OF LONGTIME WAITING (PROBABILITY OF OCCURRENCE OF WAITING TIME OF ONE MINUTE OR MORE) |
| 3 | I LIKE TO GET TO DESTINED FLOOR IN A HURRY $S_3$ | RIDING TIME (INTERVAL OF TIME BETWEEN GETTING IN AND GETTING OFF CAGE) |
| 4 | I LIKE TO TAKE AN UNCROWDED CAGE $S_4$ | DEGREE OF JAM IN CAGE (PROPORTION OF PASSENGER NUMBER IN CAGE TO RATED CAPACITY) |
| 5 | I DON'T CHANGE A RESERVED CAGE $S_5$ | RESERVATION CHANGE RATE (RATE OF CHANGE OF ASSIGNMENT TO A DIFFERENT CAGE BECAUSE OF FULL-UP OR LONGTIME WAITING) |
| 6 | I WANT TO GET INFORMATION ABOUT A RESERVED CAGE RIGHT NOW $S_6$ | RESERVATION INFORMING TIME (INTERVAL OF TIME BETWEEN HALL CALL GENERATION AND GUIDANCE OF RESERVED CAGE) |
| 7 | MANY PASSENGERS SHOULD BE CONVEYED WITHIN A SHORT PERIOD OF TIME $S_7$ | TRANSPORT CAPABILITY (DEGREE OF OCCURRENCE OF DIVISIONAL EXPRESS OPERATION AND CONCENTRATED SERVICE WITHIN PREDETERMINED TIME ZONE) |
| 8 | I DON'T LIKE ARRIVAL OF AN UNRESERVED CAGE $S_8$ | RATE OF FIRST ARRIVE UNRESPONSIVE TO CAGE CALL (RATE OF FIRST ARRIVAL OF AN UNRESERVED CAGE IN RESPONSE TO A HALL CALL) |
| 9 | I LIKE THE CAGE TO STOP AT THE ZERO-TH FLOOR WITHOUT FAIL $S_9$ | FREQUENCY OF NONSTOP OF CAGE (FREQUENCY OF PASSAGE OF AN UNRESERVED CAGE THROUGH A CAGE CALL ORIGINATING FLOOR) |
| 10 | I LIKE A LARGE AMOUNT OF GENERAL INFORMATION GUIDE $S_{10}$ | INFORMATION GUIDE AMOUNT (ENTERTAINMENT GUIDE, WEATHER FORECASTING, TIME) |
| 11 | ENERGY SAVING RUNNING SHOULD BE DONE $S_{11}$ | ENERGY SAVING RATE (RATE OF REDUCTION OF ELEVATOR POWER CONSUMPTION) |

FIG. 30A

T11

| RULE \ CALL | 1U | 2U | 3U | 4U | 5U | 2D | 3D | 4D | 5D | 6D | 6DB |
|---|---|---|---|---|---|---|---|---|---|---|---|
| RULE 1 | | | ○ | | | | | | | ○ | ○ |
| RULE 2 | | | | | | | ○ | | | | ○ |
| RULE 3 | ○ | | ○ | | | | | | | | |

FIG. 30B

T12

| CON-DITION / RULE | DAY DESIG-NATION DAY | TIME TIME | LOADING RATE WEIGHT | WAITING TIME WAIT | CALL INFORMING TIME CTIM | DESIGNATED MACHINE NUMBER KFIT | TRAFFIC TRAFIC |
|---|---|---|---|---|---|---|---|
| UNIT | 0-6 bit | HOUR·MINUTE | % | Second | Second | 0-7 bit | PASSENGERS/5 MINUTE CAGE |
| RULE 1 | | | WEIGHT =<SEKISAI ×0.3 | | | | |
| RULE 2 | | 10:00 TIME <22:00 | | | | | TRAFIC < 25 |
| RULE 3 | | | | WAIT =< 30 | | | TRAFIC > 10 |

FIG. 30C

T13

| EXECU-TOR / RULE | CONDITIONAL FORMULA & EXECUTION FORMULA |
|---|---|
| RULE 1 | ω = WEIGHT(K) − SEKISAI × 0.3<br>IF ω ≦ 0 THEN VALUE(K) = WAIT<br>ELSE VALUE(K) = MAX<br>ASIGN = K FOR MIN (VALUE(K)) |
| RULE 2 | ASIGN = 3 |
| RULE 3 | IF WAIT(K) < (TRAFIC−10) × 0.8<br>THEN VALUE (K)<br>ASIGN = K FOR MIN (VALUE(K)) |

FIG. 33

| ELEVATOR PERFORMANCE AND ELEVATOR-SURROUNDING ENVIRONMENT | SET VALUE |
|---|---|
| THE NUMBER OF ELEVATORS | 8 |
| SPEED OF ELEVATOR No. 1 | 150m/min |
| SPEED OF ELEVATOR No. 2 | 150m/min |
| | |
| | |
| | |
| SERVICE FLOOR OF ELEVATOR No. 1 | 1-15 |
| SERVICE FLOOR OF ELEVATOR No. 2 | 1-15 |
| | |
| | |
| | |
| | |
| IS THERE A NEARBY CROSSING ? | YES |
| ARE DRESSING ROOM AND PLACE OF WORK AT DIFFERENT FLOORS ? | NO |
| | |

EXAMPLE OF CHANGE OF REQUEST TARGETS IN THE CASE OF HOTEL

FIG. 36

| CONTROL TARGET | CONTROL TARGET | | TARGET VALUE | WEIGHT |
|---|---|---|---|---|
| | TARGET VALUE | WEIGHT | | |
| LOADING RATE | 30% OR LESS | 9 | 30% OR LESS | 8 |
| RESERVATION CHANGE RATE | 3% OR LESS | 8 | 3% OR LESS | 7 |
| RATE OF FIRST ARRIVAL UNRESPOSIVE TO CAGE CALL | 3% OR LESS | 7 | 3% OR LESS | 6 |
| WAITING TIME AT HALL | 40 sec OR LESS | 6 | 25 sec OR LESS | 9 |
| TRANSPORT CAPABILITY | 30 PASSENGERS /min OR MORE | 5 | 30 PASSENGERS /min OR MORE | 5 |
| RESERVATION INFORMING TIME | 1 sec OR LESS | 4 | 1 sec OR LESS | 4 |
| | | | | |

INITIALIZED VALUE

RE-SET VALUE

FIG. 37

| | CONTROL TARGET | PREDICTIVE VALUE |
|---|---|---|
| CONTROL TARGET | PREDICTIVE VALUE | 45 % |
| LOADING RATE | 40 % | 6 % |
| RESERVATION CHANGE RATE | 5 % | 4 % |
| RATE OF FIRST ARRIVAL UNRESPONSIVE TO CAGE CALL | 3 % | 23 sec |
| WAITING TIME AT HALL | 25sec | 40 PASSENGERS/min |
| TRANSPORT CAPABILITY | 35 PASSENGERS/min | 0.1 s |
| RESERVATION INFORMING TIME | 0.1 s | |
| | | |

METHOD BASED ON MINIMUM AVERAGE WAITING TIME

METHOD BASED ON MINIMUM WAITING TIME

FIG. 42

TYPICAL ELEVATOR SPECIFICATION

| ITEM | VALUE |
|---|---|
| FLOOR NUMBER IN BUILDING | B1· 1ST-15TH FLOOR |
| RESIDENT NUMBER | 1000 |
| INSTALLED ELEVATOR NUMBER | 6 |
| ELEVATOR SPEED | 240M/MIN. |
| RATED CAPACITY OF ELEVATOR | 20 |
| REFERENCE START FLOOR | 1ST FLOOR |

FIG. 43

Q.1 DO YOU LIKE TO TAKE ON ELEVATOR RIGHT NOW?

1) VERY STRONGLY 2) STRONGLY 3) MODERATELY 4) SLIGHTLY 5) DON'T CARE

Q.2 DO YOU WANT THAT MANY PASSENGERS SHOULD BE CONVEYED?

1) VERY STRONGLY 2) STRONGLY 3) MODERATELY 4) SLIGHTLY 5) DON'T CARE

- - - - - - - - - - - - - - - - - - - -

Q.5 DO YOU LIKE TO TAKE UNCROWDED ELEVATOR?

1) VERY STRONGLY 2) STRONGLY 3) MODERATELY 4) SLIGHTLY 5) DON'T CARE

FIG. 44

| UTILIZATION ENVIRONMENT / CONTROL TARGET | 1 | 2 | ---- | n |
|---|---|---|---|---|
| WAITING TIME | 3 | 4 | ---- | 5 |
| RIDING TIME | 5 | 2 | ---- | 3 |
| LONGTIME WAIT OCCURENCE RATE | 2 | 3 | ---- | 2 |
| RESERVATION HIT RATE | 0 | 5 | ---- | 1 |
| ---------- | ---------- | ---------- | | ---------- |
| RATE OF JAM IN CAGE | 1 | 2 | | 0 |

FIG. 46

| | WAITING TIME | TRANSPORT CAPACITY | RIDING TIME | FORECASTING HIT RATE | RATE OF JAM IN CAGE |
|---|---|---|---|---|---|
| WAITING TIME | 1 | 5 | 3 | 9 | 7 |
| TRANSPORT CAPACITY | 1/5 | 1 | 1/3 | 5 | 3 |
| RIDING TIME | 1/3 | 3 | 1 | 7 | 5 |
| FORECASTING HIT RATE | 1/9 | 1/5 | 1/7 | 1 | 1/3 |
| RATE OF JAM IN CAGE | 1/7 | 1/3 | 1/5 | 3 | 1 |

FIG. 47

CONTROL METHOD DECIDING KNOWLEDGE BASE

RULE 1
IF OFFICE BUILDING
AND WEIGHT FOR WAITING TIME IS 0.5 OR MORE
THEN MIN-MAX CONTROL IS USED

RULE 2
IF DEGREE OF JAM IN CAGE IS 80% OR LESS
AND WEIGHT IS 0.1 OR LESS
THEN K2 IN ASSIGNMENT EVALUATION FORMULA
IS ZEROED

FIG. 48

101″-3

| DECISION TABLE | |
|---|---|
| START TIME OF DECISION TABLE UTILIZATION | 7 : 00 |
| END TIME OF DECISION TABLE UTILIZATION | 9 : 00 |
| ASSIGNMENT METHOD | min-max |
| EVALUATION FORMULA | $\phi = K_1 W_2 + K_2 R_W + \cdots$ |
| K1 (WAITING TIME) | 1 |
| K2 (PASSENGER NUMBER) | 0.3 |
| — — — — | |
| INFORMATION GUIDE | SCREEN NO.3 |
| | |

FIG. 54

| | | INQUIRY STATEMENT | COMMENTARY STATEMENT |
|---|---|---|---|
| REQUEST ITEM | 1 | DO YOU LIKE TO TAKE AN ELEVATOR ARRIVING EARLIER? | WAITING TIME AT THE ELEVATOR HALL IS PREFERENTIALLY SHORTENED. RESERVATION CHANGE TENDS TO OCCUR FREQUENTLY. |
| | 2 | DO YOU LIKE TO TAKE AN UNCROWDED ELEVATOR? | THIS ITEM IS AVAILABLE WHEN YOU LIKE TO TAKE AN UNCROWDED ELEVATOR AT THE COST OF A SLIGHTLY LONGTIME WAITING OR MANY BAGGAGES ARE HANDLED IN THE BUILDING. |
| | ⋮ | ⋮ | ⋮ |
| | n | DO YOU LIKE EARLIER ARRIVAL OF A RESERVED ELEVATOR ? | FIRST ARRIVAL OF AN UNRESERVED ELEVATOR IS MINIMIZED. THIS ITEM IS AVAILABLE FOR A BUILDING WHERE MANY OF PASSENGERS ARE UNEXPERIENCED. |

FIG. 55

| | | BUILDING TYPE | | | | |
|---|---|---|---|---|---|---|
| | | BUILDING FOR ONLY ONE COMPANY RESIDENT | HOTEL | COMMUNITY | ---- | GOVERNMENT PUBLIC BUILDING |
| REQUEST ITEM | 1 | LARGE | MEDIUM | SMALL | --- | LARGE |
| | 2 | SMALL | LARGE | SMALL | ---- | MEDIUM |
| | ⋮ | ⋮ | ⋮ | ⋮ | | ⋮ |
| | n | SMALL | LARGE | MEDIUM | --- | MEDIUM |

FIG. 56

| | | CONTROL OBJECTIVE | | | | | | |
|---|---|---|---|---|---|---|---|---|
| | | WAITING TIME | RATE OF JAM IN CAGE | LONGTIME WAIT OCCURENCE RATE | FORECASTING HIT RATE | TRANSPORT CAPACITY | --- | RIDING TIME |
| REQUEST ITEM | 1 | 3 | −1 | 2 | −1 | 3 | --- | 1 |
| | 2 | −1 | 3 | −1 | 2 | 0 | --- | 1 |
| | ⋮ | ⋮ | ⋮ | ⋮ | ⋮ | ⋮ | | ⋮ |
| | n | 1 | 0 | 1 | 3 | 0 | --- | 2 |

FIG. 57

| | | | CONTROL OBJECTIVE CORRELATION | | | | |
|---|---|---|---|---|---|---|---|
| | | | 3 | 2 | 1 | 0 | −1 |
| DEFAULT & RANK PURSUANT TO THE TYPE OF BUILDING | LARGE | A | 6 | 4 | 2 | 1 | −2 |
| | | B | 5 | 3 | 2 | 0 | −2 |
| | | C | 3 | 2 | 1 | 0 | −1 |
| | MEDIUM | A | 4 | 3 | 2 | 0 | −2 |
| | | B | 3 | 2 | 1 | 0 | −1 |
| | | C | 2 | 1 | 0 | 0 | 0 |
| | SMALL | A | 3 | 2 | 1 | 0 | −1 |
| | | B | 2 | 1 | 0 | 0 | 0 |
| | | C | −1 | 0 | 0 | 0 | 1 |

FIG. 58

| | | PRIORITY RANK | | | | | |
|---|---|---|---|---|---|---|---|
| | | 1 | 2 | 3 | 4 | 5 | 6 |
| BUILDING FOR ONLY ONE COMPANY RESIDENT | WAITING TIME | ≦15 sec | ≦20 sec | ≦25 sec | ≦30 sec | ≦35 sec | ≦40 sec |
| | RATE OF JAM IN CAGE | ≦60 % | ≦70 % | ≦75 % | ≦80 % | ≦85 % | ≦90 % |
| | LONGTIME WAIT OCCURENCE RATE | ≦0.5 % | ≦1 % | ≦2 % | ≦2 % | ≦3 % | ≦5 % |
| | FORECASTING HIT RATE | ≧98 % | ≧95 % | ≧90 % | ≧85 % | ≧80 % | ≧70 % |
| | TRANSPORT CAPACITY | ≧90 % | ≧85 % | ≧80 % | ≧75 % | ≧70 % | ≧60 % |
| | ⋮ | ⋮ | ⋮ | ⋮ | ⋮ | ⋮ | ⋮ |
| | RIDING TIME | ≦20 sec | ≦25 sec | ≦30 sec | ≦35 sec | ≦40 sec | ≦50 sec |
| HOTEL | WAITING TIME | ≦20 sec | ≦25 sec | ≦30 sec | ≦35 sec | ≦40 sec | ≦50 sec |
| | RATE OF JAM IN CAGE | ≦40 % | ≦45 % | ≦50 % | ≦55 % | ≦60 % | ≦65 % |
| | ⋮ | ⋮ | ⋮ | ⋮ | ⋮ | ⋮ | ⋮ |
| ⋮ | ⋮ | ⋮ | ⋮ | ⋮ | ⋮ | ⋮ | ⋮ |

FIG. 60

| | | INQUIRY STATEMENT | COMMENTARY STATEMENT |
|---|---|---|---|
| REQUEST ITEM | 1 | DO YOU LIKE TO TAKE AN ELEVATOR ARRIVING EARLIER ? | WAITING TIME AT THE ELEVATOR HALL IS PREFERENTIALLY SHORTENED. RESERVATION CHANGE TENDS TO OCCUR FREQUENTLY. |
| | 2 | DO YOU LIKE TO TAKE AN UNCROWDED ELEVATOR ? | THIS ITEM IS AVAILABLE WHEN YOU LIKE TO TAKE AN UNCROWDED ELEVATOR AT THE COST OF A SLIGHTLY LONGTIME WAITING OR MANY BAGGAGES ARE HANDLED IN THE BUILDING. |
| | 3 | DO YOU USE SKIP SERVICE ? | STOPS EVERY OTHER FLOOR. TRANSPORT CAPABILITY IS VERY IMPROVED AT THE COST OF DISSATISFACTION OF CUSTOMERS. |
| | 4 | DO YOU USE VIP SERVICE ? | PREFERENTIAL RUNNING DEDICATED TO EXECUTIVES AND IMPORTANT VISITORS AT THE COST OF SLIGHTIY DEGRADED SEVICES FOR OTHER PASSENGERS. |
| | 5 | DO YOU LIKE EARLIER ARRIVAL OF A RESERVED ELEVATOR ? | FIRST ARRIVAL OF AN UNRESERVED ELEVATOR IS MINIMIZED. THIS ITEM IS AVAILABLE FOR A BUILDING WHERE MANY OF PASSENGERS ARE UNEXPERIENCED. |

FIG. 61

| | | DEFAULT FOR HOTEL | CONTROL OBJECTIVE | | | |
|---|---|---|---|---|---|---|
| | | | WAITING TIME | RATE OF JAM IN CAGE | FORECASTING HIT RATE | RIDING TIME |
| REQUEST ITEM | 1 | MEDIUM | 3 | -1 | -1 | 1 |
| | 2 | LARGE | -1 | 3 | 1 | 2 |
| | 3 | SMALL | 2 | -1 | 3 | 2 |
| | 4 | MEDIUM | -1 | -1 | 1 | -1 |
| | 5 | MEDIUM | 1 | 0 | 3 | 1 |

| | PRIORITY RANK | | | |
|---|---|---|---|---|
| | 1 | 2 | 3 | 4 |
| WAITING TIME | ≦20sec | ≦25sec | ≦30sec | ≦35sec |
| RATE OF JAM IN CAGE | ≦40% | ≦50% | ≦60% | ≦70% |
| FORECASTING HIT RATE | ≧98% | ≧96% | ≧93% | ≧90% |
| RIDING TIME | ≦30sec | ≦40sec | ≦50sec | ≦60sec |

FIG. 65A

| | | |
|---|---|---|
| I LIKE TO TAKE AN ELEVATOR ARRIVING EARLIER (WAITING TIME) | : MANY PASSENGERS SHOULD BE CONVEYED (TRANSPORT CAPABILITY) | = 5 : 1 |
| I LIKE TO TAKE AN ELEVATOR ARRIVING EARLIER (WAITING TIME) | : I DON'T LIKE TO STAY IN THE ELEVATOR FOR A LONG TIME (RIDING TIME) | = 3 : 1 |
| I LIKE TO TAKE AN UNCROWDED ELEVATOR (DEGREE OF JAM IN CAGE) | : I LIKE EARLIER ARRIVAL OF A RESERVED ELEVATOR (FORECASTING HIT RATE) | = 3 : 1 |

FIG. 65B

ONE-TO-ONE COMPARISON TABLE

| | WAITING TIME | TRANS-PORT CAPACITY | RIDING TIME | FORE-CASTING HIT RATE | RATE OF JAM IN CAGE | WEIGHT |
|---|---|---|---|---|---|---|
| WAITING TIME | 1 | 5 | 3 | 9 | 7 | 513 |
| TRANSPORT CAPACITY | 1 5 | 1 | 1/3 | 5 | 3 | 129 |
| RIDING TIME | 1/3 | 3 | 1 | 7 | 5 | 261 |
| FORECASTING HIT RATE | 1/9 | 1/5 | 1/7 | 1 | 1/3 | 033 |
| RATE OF JAM IN CAGE | 1/7 | 1/3 | 1/5 | 3 | 1 | 063 |

FIG. 65C

ONE-TO-ONE COMPARISON MATRIX A $$A = \begin{pmatrix} 1 & 5 & 3 & 9 & 7 \\ 1/5 & 1 & 1/3 & 5 & 3 \\ 1/3 & 3 & 1 & 7 & 5 \\ 1/9 & 1/5 & 1/7 & 1 & 1/3 \\ 1/7 & 1/3 & 1/5 & 3 & 1 \end{pmatrix}$$

$\lambda max = 5.24$

CHARACTERISTIC VECTOR V $$V = \begin{pmatrix} 0.513 \\ 0.129 \\ 0.261 \\ 0.033 \\ 0.063 \end{pmatrix}$$

FIG. 67

REQUEST TARGET INPUT KNOWLEDGE BASE

```
RULE 1
IF    OFFICE BUILDING
  THEN  THE USER IS EXPERIENCED

RULE 2
IF    THE USER IS EXPERIENCED
AND   REQUEST FOR RESERVATION HIT RATE IS LOW
  THEN  RESERVATION HIT RATE IS 90% OR MORE

RULE 3
IF    OFFICE BUILDING
AND   REQUEST FOR DEGREE OF JAM IN CAGE
      IS HIGH
  THEN  DEGREE OF JAM IN CAGE IS 80%
        OR LESS
```

621

FIG. 69

634

| ELEVATOR PERFORMANCE AND ELEVATOR-SURROUNDING ENVIRONMENT | SET VALUE |
|---|---|
| THE NUMBER OF ELEVATORS | 8 |
| SPEED OF ELEVATOR NO. 1 | 150 m/min |
| SPEED OF ELEVATOR NO. 2 | 150m/min |
| | |
| | |
| | |
| | |
| SERVICE FLOOR OF ELEVATOR NO. 1 | 1 - 15 |
| SERVICE FLOOR OF ELEVATOR NO. 2 | 1 - 15 |
| | |
| | |
| | |
| | |
| IS THERE A NEARBY CROSSING? | YES |
| ARE DRESSING ROOM AND PLACE OF WORK AT DIFFERENT FLOORS? | NO |
| | |

FIG. 70

624

| USER'S REQUEST TABLE | | |
|---|---|---|
| CONTROL TARGET | TARGET VALUE | WEIGHTING |
| RESERVATION HIT RATE | 90% OR MORE | 0.033 |
| RATE OF JAM IN CAGE | 80% OR LESS | 0.063 |
| WAITING TIME | 40 sec OR LESS | 0.513 |
| TRANSPORT CAPABILITY | 60 PASSENGERS / minute OR MORE | 0.129 |
| RIDING TIME | 30 sec OR LESS | 0.261 |

FIG. 71

631

CONTROL METHOD DECIDING KNOWLEDGE BASE

RULE 1
IF OFFICE BUILDING
AND WEIGHT FOR WAITING TIME IS 0.5 OR MORE
THEN MIN-MAX CONTROL IS USED

RULE 2
IF DEGREE OF JAM IN CAGE IS 80% OR LESS
AND WEIGHT IS 0.1 OR LESS
THEN $K_1$ IN ASSIGNMENT EVALUATION FORMULA
IS ZEROED

FIG. 72

641

| DECISION TABLE | |
|---|---|
| START TIME OF DECISION TABLE UTILIZATION | 7 : 00 |
| END TIME OF DECISION TABLE UTILIZATION | 9 : 00 |
| ASSIGNMENT METHOD | min - max |
| EVALUATION FORMULA | $\phi = K_1X_1 + K_2X_2 + \cdots$ |
| $K_1$ (WAITING TIME COEFFICIENT) | 1 |
| $K_2$ (PASSENGER NUMBER COEFFICIENT) | 0 |
| ------- | ----- |
| DISPLAY OF OCCURRENCE OF RESERVATION CHANGE | SCREEN NO.3 |
| ------- | ----- |

METHOD AND SYSTEM OF CONTROLLING ELEVATORS AND METHOD AND APPARATUS OF INPUTTING REQUESTS TO THE CONTROL SYSTEM

This is a continuation of application Ser. No. 07/301.973, filed Jan. 26, 1989.

BACKGROUND OF THE INVENTION

This invention relates to elevator group supervisory control systems and more particularly to an elevator group supervisory control system suitable for realizing a variety of desires or requests of the users of the elevators.

In a conventional elevator group supervisory control system, with the view of improving running efficiency of elevator and services to passengers, occurrence of hall calls of supervised and a call is assigned to an optimum elevator in consideration of the whole service condition under the hall calls to thereby reduce average waiting time. Recently, a system has been proposed as disclosed in JP-A-58-52162 or GB 2,111,244 (corresponding to JP-A-58-63668) wherein in selecting from a plurality of elevators an elevator to which a hall call is assigned, an evaluation function for evaluating respective elevators is added with a variable parameter. The value of the variable parameter is changed in accordance with traffic. The obtained result is used to learn the parameter value which meets a preset target value. This parameter value is used in accordance with the running condition of an elevator to execute call assignment control.

In this system, either a minimum waiting time mode can be designated or the control target for energy saving can be set by a level command supplied from a switch or a building caretaker system. A stop call evaluation index is introduced by which stop calls destined for floors near a floor for which an originating (or new) call is destined are evaluated and the originating hall call is preferentially assigned to an elevator commanded by or having many of the stop calls. Advantageously, a weight coefficient for the stop call evaluation index can suitably be changed so as to be optimized for the waiting time and conversely the weight coefficient can be increased to attain energy saving effect.

On the other hand, JP-B-62-70 and JP-B-62-71 disclose a system which takes waiting time and energy saving into account. JP-B-58-56709 discloses a system which adds a predictive full-up to the evaluation index, and JP-B-62-47787 discloses a system which adds at least one of forecasting miss probability and full-up probability to the evaluation index.

Of the above conventional systems, the system having two control targets of waiting time and energy saving can avoid dissatisfaction of passengers by reducing average waiting time but there are still involved several problems. More specifically, because of unexceptional occurrence of a longtime waiting at a specified floor within the same time zone, call assignment to a remote elevator even in the presence of a nearby elevator in wait, assignment of a call from a passenger carrying a large baggage such as a wagon to a crowded elevator and consequent necessity of a new call after start of the crowded elevator and the like cause, various complaints are made and informed to the owner or a caretaker of building.

Further, only the waiting time and energy saving or the waiting time and full-up probability (forecasting miss probability) are considered as control targets in spite of the fact that there are involved many other control targets, and it is difficult for the owner or caretaker of buliding to designate and control many control targets. In addition, the multi-target consisting of various combinations of the above control targets can not be controlled.

In order to take care of various complaints about an elevator system installed in a building, the user of elevator such as owner or caretaker of the building must ask the elevator maker to improvably alter the elevator system. In response the elevator maker must change the program or add new programs and then revise the ROM. This in effect requires much labor and time. All of a variety of requests of the user including passengers and the owner or caretaker of the building can not be satisfied. Further, it is difficult to present to the user the effects of the actual operation of elevator in accordance with the corrected program.

As will be seen from the above, in the elevator equipment to be used in buildings, constraint is imposed on the performance of elevator equipment such as the number of elevators installed, rated capacity and elevator speed, and inputting of request targets for control goal expected to be realized under the constraint can not be achieved without going through many trial and error processes and experience. Also, desires or requests of the user are difficult to express reasonably numerically. Essentially, in the conventional technology, inputting of user's request has not been thought of and the manner of reasonably settling the request is in no way considered, with the result that control capable of matching individuality of the installed elevator is difficult to achieve.

Conventionally, as far as inputting and setting of evaluation items are concerned, for example, JP-A-59-223672 simply discloses designation of energy saving rate in terms of numerical value (%) and JP-A-59-48364 merely discloses a method of inputting information about entertainment reservation and concentrated service into elevator group supervision.

SUMMARY OF THE INVENTION

An object of this invention is to provide elevator group supervisory control method and system which can meet various requests of the user and building caretaker.

Another object of this invention is to provide elevator group supervisory control method and system wherein a request of the user can be inputted in the form of a display which is easy for the user to understand and fetched directly into a control system so as to be immediately reflected in controlling.

Still another object of the invention is to provide elevator group supervisory control method and system which can easily perform addition and/or deletion of various request items of the user.

Still another object of the invention is to provide request inputting apparatus and method for use in elevator control system by which various desires or requests of the user can be inputted in the form of feeling which is easy for the user to express.

To accomplish the above objects, an elevator group supervisory control system according to one aspect of the invention comprises means for inputting a plurality of control targets (at least two or more of waiting time at the hall, riding time, reservation change rate, transport capability, passenger number, rate of occurrence of longtime waiting, reservation informing time, rate of first arrival unresponsive to cage call, frequency of nonstop of cage, frequency of nonstop of full-up cage, information guide amount, noise level, energy saving, frequency of start of elevator and scheduled running) for a plurality of elevators, means for selecting at least one candidate control method expected to attain the control targets, means for determining predictive values of the control targets pursuant to a selected control method, and means for settling the control method on the basis of the predictive values. The elevator group supervisory control system constructed as above can meet various requests of the user and building caretaker.

Preferably, the elevator group supervisory control system according to the invention comprises means for displaying the predictive values capable of attaining the control targets, whereby a control method acceptable to the user and building caretaker can be determined conversationally.

According to another aspect of the invention, target values, priority ranks and weights are inputted in respect of individual control targets, knowledge of environment/traffic, individual control targets and relation between a plurality of control methods is precedently stored, and the predictive value is checked for its validity or confirmed through simulation, whereby processing time can be reduced and accuracy of prediction can be improved.

According to still another aspect of the invention, a control method is determined by determining a Pareto optimal solution through a mathematical programming such as multiobjective programming or goal programming, thereby ensuring easy determination of control method.

On the basis of requests of the customer which are represented by target values for control goal of elevator and associated priority ranks or weights and inputted through the input means, at least one candidate control method expected to meet the requests of the customer is selected and derived using the precedently stored knowledge.

For example, given that the customer's requests are for only waiting time, riding time and energy saving, the Pareto optimal solution used for selection can be obtained using the stored knowledge of an experimental or theoretical formula indicative of the relation of the customer's request with respect to the traffic and control method, and the multiobjective programming or goal programming. However, since it is infrequent that the formula indicative of the relation between the customer's request and the traffic and control method can be obtained, the precedently stored knowledge of the relation between the customer's request and the traffic and control method is used to deduce and derive a few candidate control methods capable of meeting the customer's request under predictive traffic.

In respect of each of the thus derived candidate control methods, predictive values of the control targets expected to be obtained when the elevator is controlled using individual control methods under the predictive traffic are simulated by means of simulator means which performs computer simulation of movement of the elevator.

By using the predictive values of control targets obtainable with the individual control methods and the target values for control goal and associated priority ranks or weights inputted through the input means, the elevator control methods are checked for superiority or inferiority to select a control method which is expected to be best suited for attainment of the customer's request.

The thus selected control method, the predictive values of the control targets obtainable with this control method, and the target values for control goal and associated priority ranks or weights are presented to the customer through the display means to enable the customer to again operate the above procedure if the selected control method is unacceptable to the customer. In this manner, the customer's request and predictive value thereof are presented to the customer and the elevator control method is determined interactively, thereby ensuring elevator control which is acceptable to the customer. If complete knowledge of all conditions for determining the elevator control method such as the maximum speed of elevator, passenger number and difference in service floors served by elevators is stored in advance for the purpose of carrying out deduction on the basis of the complete knowledge, the storage capacity must be increased and the deduction becomes time-consuming. Contrary to this, according to the invention, a certain number of candidate solutions are selected through deduction and the best suited one is selected from the candidate solutions so that a practically satisfactory control method may be determined within a period of time which is practically satisfactorily short.

According to still another aspect of the invention, the elevator control system comprises means for inputting feelings or requests of the user, and means for executing group supervisory control in accordance with the feeling or requests, whereby the user's feeling or requests can be reflected in the group supervisory control.

Preferably, the elevator control system according to the invention comprises means for converting the feelings or requests into a plurality of control targets, thus gaining easy applicability to group supervisory control. Specifically, a plurality of feeling or request target items and elevator utilization environment (running condition of elevator, traffic and the like parameter) are set by request input means, and target conversion means having a knowledge base adapted to store, in respect of the given request target items, conversion functions for different types of elevator utilization environment (corresponding to membership functions in fuzzy control) converts the request targets into elevator control target values. Additionally, weighting or priority ranking between control target items may also be determined through, for example, analytical hierarchy process (AHP) technique. AHP is described in an article entitled "Tamokuteki Ishi Kettei—Riron to Oyo—I, —Tamokuteki Ishi Kettei to AHP—" (Multiple-objective Decision Making—Theory and Application—I, —Multiple-objective Decision Making and AHP—) Sisutemu to Seigyo (System and Control), Vol. 30, No. 7, pp.430–438, 1986.

According to still another aspect of the invention, the elevator control system comprises means for directly inputting control targets (at least two or more of waiting time at the hall, riding time, reservation change rate, transport capability, passenger number, longtime waiting, reservation informing time, rate of first arrival unresponsive to cage call, frequency of nonstop of cage, frequency of nonstop of full-up cage, information guide amount, noise level, energy saving, frequency of start of elevator and scheduled running), and means for executing group supervisory control by using the control targets.

According to still another aspect of the invention, the elevator control system comprises means for determining a control method so as to attain the control targets inputted through the feeling or request input means or the means for directly inputting control targets. More specifically, the system comprises means for selecting at least one candidate for control method expected to attain the control targets, means for determining predictive values of the control targets pursuant to a selected control method, and means for settling the control method on the basis of the predictive values. More effectively, the predictive values may preferably be determined through simulation.

According to still another aspect of the invention, the elevator control system comprises registration means (decision table) used to permit selection of running method in accordance with the elevator running condition or time zone, the contents of the registration means being changed, for example, increased by an external signal.

According to still another aspect of the invention, the elevator control system is operable to input a request, calculate an evaluation formula for call assignment in group supervision and parameters on the basis of the inputted request and execute group supervisory control in accordance with the evaluation formula and parameters.

According to still another aspect of the invention, a request inputting apparatus of elevator control system comprises means for inputting feelings or requests and means for converting the inputted feelings or requests into a plurality of control targets.

According to still another aspect of the invention, a feeling or request inputting apparatus of elevator control system comprises means for inputting feelings or requests and converting the feelings or requests into control targets, means for deducing and determining a proper control method, and means for registering the control method in the elevator control system. Preferably, the means for inputting feelings or requests and converting the feelings or requests into a plurality of control targets is so constructed as to determine control target values through deduction process by using preset feeling or request input knowledge base and environment/traffic data base and determine weighting or priority raking between control target items through AHP, and the means for deducing and determining a proper control method is so constructed as to determine the proper control method on the basis of the control target values and weighting or priority ranking between control target items by using the environment/traffic data base and a control method deciding knowledge base.

According to still another aspect of the invention, a request inputting method for use in the elevator control system comprises inputting qualitative requests of the user in a predetermined guidance fashion.

Input qualitative requests concerning elevator running such as feelings or request targets (originating from sense of value, interest, taste, sense, preference and the like) can easily be set in terms of plain language or in the form of a radar chart without assistance of expert in elevator control, and the thus set feeling (or request) targets can be converted into control target values by using a conversion function prepared on the basis of results of a questionaire. Of the thus obtained control target values (applied with weighting or priority ranking between control target items, as necessary), target values of items correlated with each other are processed, in accordance with a preset rule, into a control method by which group supervisory control sufficiently meeting the user's requests and individuality of each building can be realized.

The user who is acquainted with elevator running to some degree is permitted to directly input control targets to determine a control method, without resort to direct inputting of feelings or requests.

Further, if constraint such as limitation on the input condition is involved, there is no need of converting requests or feelings into control targets, and the requests or feelings can be fetched directly into the elevator control system to determine a call assignment elevation formula in group supervisory control and parameters and can be reflected in actual group supervisory control.

BRIEF DESCRIPTION OF THE DRAWINGS

FIG. 3 shows an example of a control target table.

FIG. 4 shows an example of a knowledge table.

FIG. 6 shows an example of an elevator performance/environment table.

FIG. 7 shows an example of a predictive value table.

FIGS. 15 and 16 show examples of inputting control targets conversationally.

FIG. 28 shows the correspondence between request target and control target.

FIGS. 30A to 30C show an example of control method selection rule.

FIG. 33 shows an example of setting of elevator specification.

FIG. 36 shows an example of a control target table.

FIG. 37 shows an example of predictive values.

FIG. 42 shows an example of typical specification upon inputting of request.

FIG. 43 shows the menner of inputting request targets.

FIG. 44 shows an example of a correlation table for determining a plurality of control targets from request targets.

FIG. 46 shows one-to-one comparison through AHP.

FIG. 47 shows an example of rules in a control method deciding knowledge base.

FIG. 48 shows an example of decision table.

FIGS. 54 to 58 show table states in a correlation knowledge base table, with FIG. 54 showing an inquiry statement table, FIG. 55 showing a default table pursuant to the types of building, FIG. 56 showing a correlation table, FIG. 57 showing a priority table and FIG. 58 showing a control target value table.

FIGS. 60 to 62 show an example of the correlation knowledge base table adapted for hotel, with FIG. 60 showing an inquiry statement table, FIG. 61 showing a default and correlation table and FIG. 62 showing a control objective value table.

FIG. 63 is a diagram illustrating an example of presentation of request (rank) b and predictive value e.

FIGS. 65A to 65C show the manner of determining weights through AHP.

FIG. 67 shows an example of a request input knowledge base.

FIG. 69 shows an example of an environment/traffic data base.

FIG. 70 shows an example of a customer request table.

FIG. 71 shows an example of a control method deciding knowledge base.

FIG. 72 shows an example of a decision table.

DESCRIPTION OF THE PREFERRED EMBODIMENTS

The invention will now be described by way of example with reference to the accompanying drawings.

Figure 1:
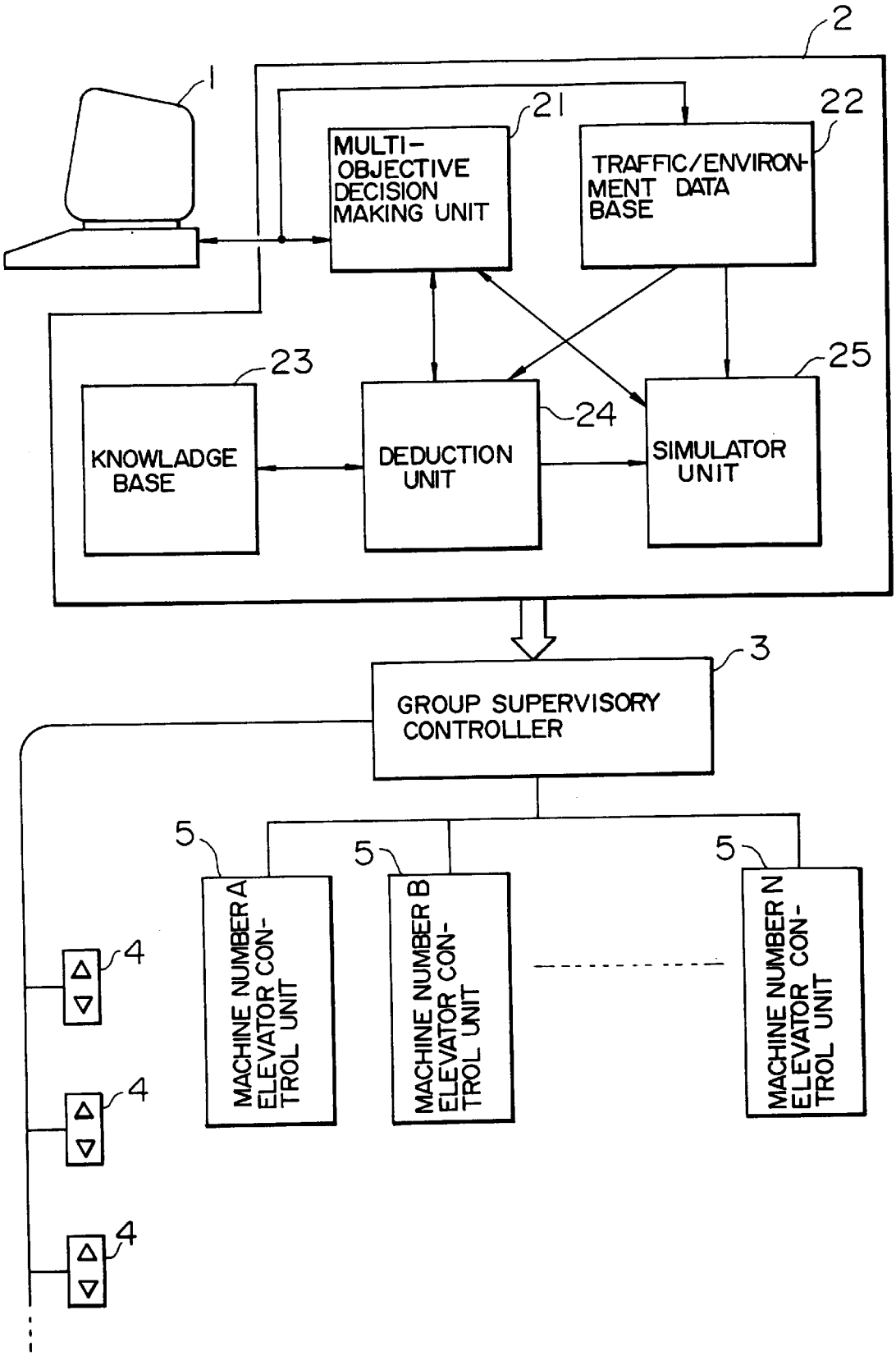
FIG. 1 is a schematic block diagram illustrating the overall construction of an embodiment of an elevator control system according to the inventon.

Referring particularly to FIG. 1 illustrating the overall construction of an embodiment of an elevator control system according to the invention, target values for elevator control goal such as the number of passengers, riding time, reservation change rate and waiting time (duration of time for hall call) and weights associated with these target values are inputted from an input/output unit 1 and sent to a control method decider 2. In the control method decider 2, a multi-objective decision making unit 21 receives a target value for control goal and a weight associated therewith and sends them to a deduction unit 24. The deduction unit 24 first accesses a traffic/environment data base 22 to fetch conditions for an elevator in question, such as the traffic in elevator indicative of a utilization condition of the elevator which occurs, for example, every minute, the elevator performance representative of service floors, rated speed and rated capacity which are determined for the elevator, the type of a building in which the elevator is installed and the environment surrounding the elevator which signifies whether there are crossings and a station near the building, and then uses knowledge stored in a knowledge base 23 to introduce a few control methods having ability to realize the target value for control goal and associated weight, sent from the multi-objective decision making unit 21, under the conditions for the elevator. Available as the control methods are, for example, a method for assignment based on minimum waiting time (Min), a method for assignment based on minimization of maximum waiting time (Min/Max), a method for assignment based on a distribution of waiting time, and combinations of these methods. The thus introduced control methods are sent to an elevator simulator unit 25 which simulates movement of elevator. The simulator unit 25 fetches the conditions for the elevator, such as the traffic, elevator performance and environment surrounding the elevator, from the traffic/environment data base 22 and carries out simulation in which the individual control methods are practiced under the conditions for the elevator, to determine predictive values for control goal pursuant to the individual control methods. The respective control methods and the predictive values for control goal thus determined by the individual control methods are sent to the multi-objective decision making unit 21. In the multi-objective decision making unit 21, the predictive values for control goal determined by the individual control methods are compared with the target value and associated weight inputted from the input/output unit 1 to provide the best control method, which is displayed, together with the target value and predictive value, on the input/output unit 1. If the displayed predictive value and control method are unacceptable, the target value for control goal and associated weight are changed and the above procedure repeated for a changed target value and its weight. Then, when acceptable results are obtained, the determined control method is sent to a group management controller 3. Pursuant to this control method, the group management controller 3 evaluates a call originating from a hall call button 4 to control a control unit 5 of the machine number elevator in question.

Figure 2:
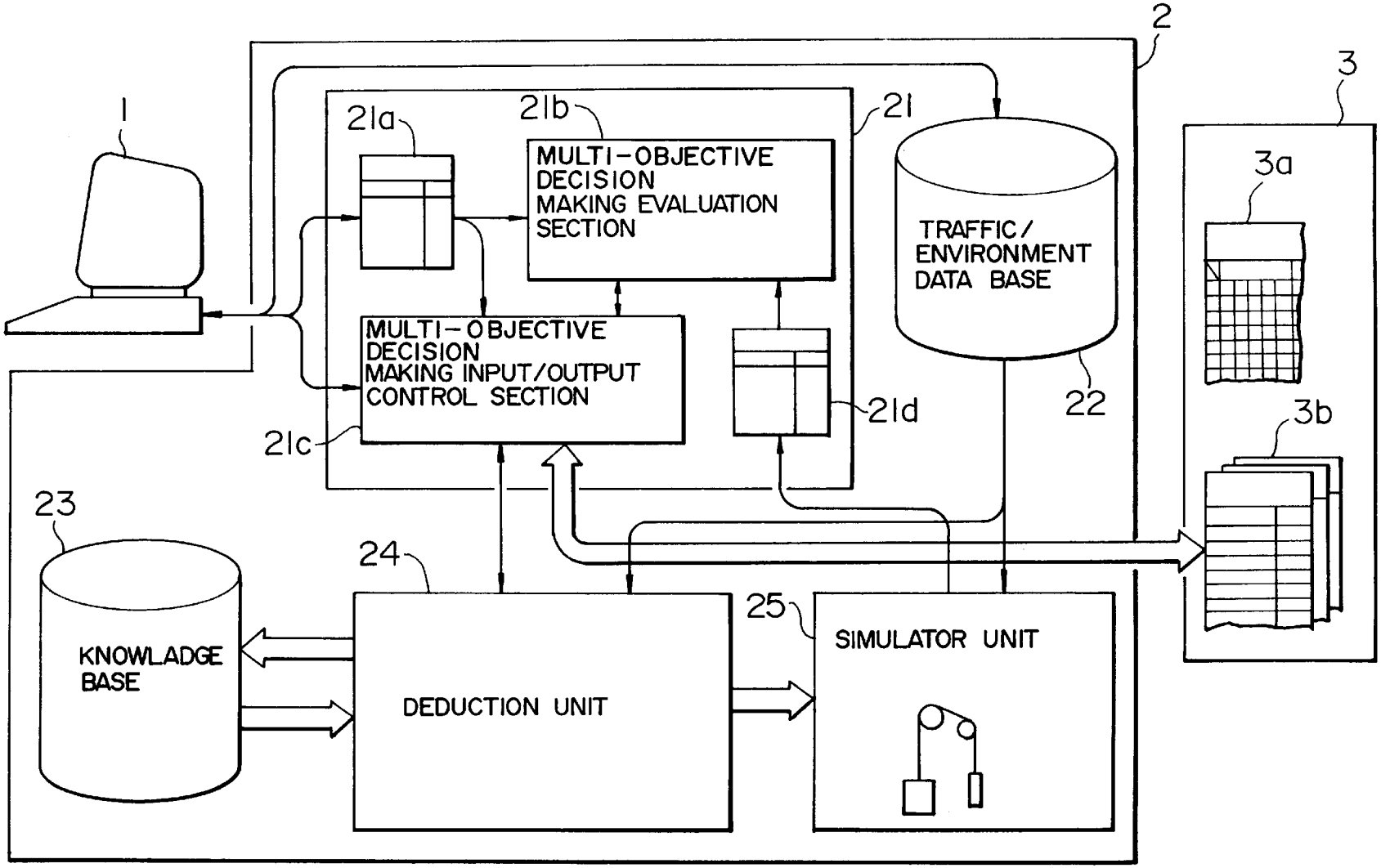
FIG. 2 is a block diagram illustrating details of a control method decider.
Figure 5:
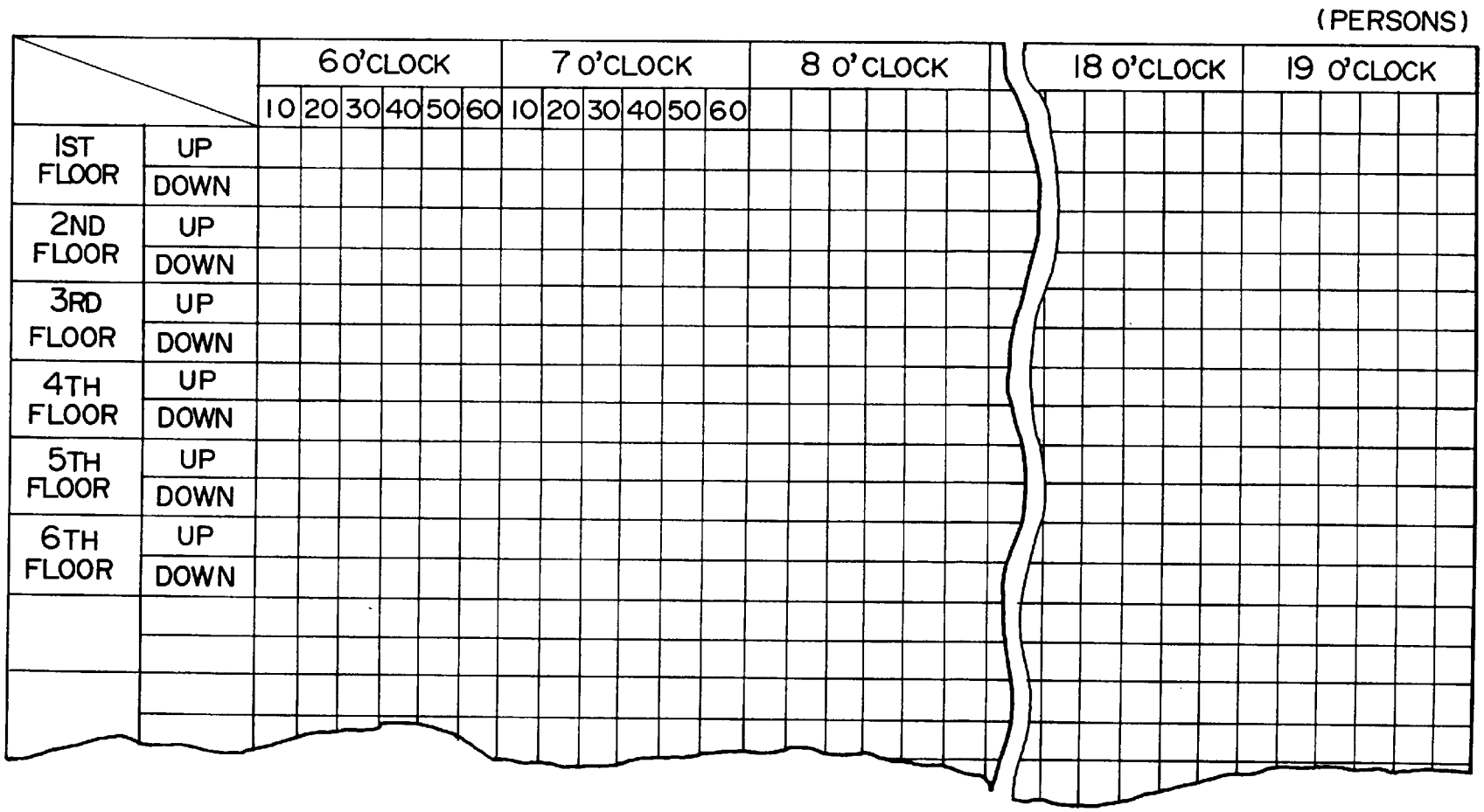
FIG. 5 shows an example of a traffic table.

Details of the control method decider 2 are illustrated in FIG. 2. A target value for control goal and its weight inputted from the input/output unit 1 are sent to a control target value table 21*a* of the multi-objective decision making unit 21. An example of the control target value table 21*a* is shown in FIG. 3. A multi-objective decision making input/output control section 21*c* sends the contents of the control target value table to the deduction unit 24. The deduction unit 24 fetches the traffic, elevator performance and environment surrounding the elevator from the traffic/environment data base 22 as well as knowledge from the knowledge base 23 to deduce control methods. Examples of the knowledge, traffic table and elevator performance/environment table are shown in FIGS. 4, 5 and 6, respectively. If the environment surrounding the elevator is simple and the target value for control goal from the input/output unit 1 is simple, the solution can be obtained through mathematical programming by using an experimental numerical formula which describes the relation between control method and control target and which is stored as knowledge in the knowledge base 23 (for the purpose of describing the relation, the numerical formula is not limitative and a table, a graph, algorithm or the like may also be used). In this case, the deduction unit 24 sends the experimental formula to the multi-objective decision making input/output control section 21*c* and this section 21*c* relays the experimental formula to a multi-objective decision making evaluation section 21*b* which in turn determines a Pareto optimal solution through multiobjective programming and returns the solution to the multi-objective decision making input/output control section 21*c*. The multi-objective decision making input/output control section 21*c* sends a resulting control method to the simulator unit 25. This simulator 25 uses the given elevator's traffic, performance and environment condition fetched from the traffic/environment data base 22 to calculate predictive values of individual control target pursuant to this control method and return the calculated predictive values to a predictive value table 21*d*.

An example of the predictive value table is shown in FIG. 7. The multi-objective dicision making evaluation section 21*b* compares the predictive value table 21*d* with the solution determined through mathematical programming and if the difference is not large, the section 21*b* relays the contents of the predictive value table 21*d* to the multi-objective decision making input/output control section 21*c* which in turn operates to display the contents of the predictive value table 21*d* and the contents of the control target value table 21*a* on the input/output unit 1, thereby enabling the user to decide whether the displayed contents is acceptable or not. Contrarily, if the environment surrounding the elevator is complicated and the target value for control goal is difficult to determine, the solution can not be obtained through mathematical programming. In this case, the deduction unit 24 uses knowledge stored in the knowledge base 23 on the basis of traffic, elevator performance/environment and a target value for control goal to select a few control methods having ability to achieve the target value for control goal. The thus selected control methods are sent to the simulator unit 25 which in turn uses the contents of the traffic/environment data base 22 to calculate predictive values determined for the individual control methods and sends the calculated predictive values to the predictive value table 21*d*. The multi-objective decision making evaluation section 21*b* looks up the contents of the predictive value table 21*d* to check the individual control methods for their superiority and inferiority. For example, when a target value $\hat{f}$ is described as a vector $\hat{f}=(\hat{f}_1, \hat{f}_2, \hat{f}_n)$ having individual target values for control goal fi, where i=1, . . . , n, as components, and a predictive value is described as a vector $f=(f_1, f_2, \ldots f_n)$ having individual predictive values for control goal fi, where i=1, . . . n, as components, the control method having superiority can be obtained by selecting a control method which can minimize the distance between target value vector and predictive value vector measured in terms of a weighted norm lp which is $$lp = \sum_{i=0}^{n} w_i|f_i - f_i|.$$

By utilizing this procedure, a control method providing a predictive value most approaching to the target value can be obtained. In running of elevator, it is not always of importance that the waiting time at the hall approaches to the target value but more preferably, such a control method is desired which can reduce the waiting time at the hall below the target value. This holds true for the number of passengers. Contrarily, the transport capacity is desired to exceed the target value. In the event that a control value is given different evaluations between such cases that it exceeds the target value and that it is below the target value, auxiliary variables defined by $$d_i^+ = \frac{1}{2}\ \{|f_i - f_i| + (f_i - \hat{f}_i)\}$$

and $$d\bar{i} = \frac{1}{2}\ \{|f_i - f_i| - (f_i - \hat{f}_i)\}$$

are introduced and a control method may be selected which can minimize $$lp = \sum_{i=1}^{n} (w_i^+ d_i^+ + w_i^- d_i^-),$$

where $d_i^+$ and $d_i^-$ are called difference variables and respectively represent attainment of excess and attainment of deficiency in respect of the i-th target value, and $w_i^+$ and $w_i^-$ represent weight coefficients for $d_i^+$ and $d_i^-$.

$$\text{Since } d_i^+ = \begin{cases} f_i - \hat{f}_i & \text{for } f_i \geqq \hat{f}_i \\ 0 & \text{for } f_i \leqq f_i \end{cases}$$

and $$d_i^- = \begin{cases} \hat{f}_i - f_i & \text{for } \hat{f}_i \geqq f_i \\ 0 & \text{for } \hat{f}_i \leqq f_i \end{cases}$$

stand, the weight inputted from the input/output unit 1 may be used as $W_i^+$ and the $W_i^-$ may be zeroed for such control values as waiting time and passenger number which may be below the target value and the $W_i^+$ may be zeroed and the weight inputted from the input/output unit 1 may be used as $W_i^-$.

Figure 8:
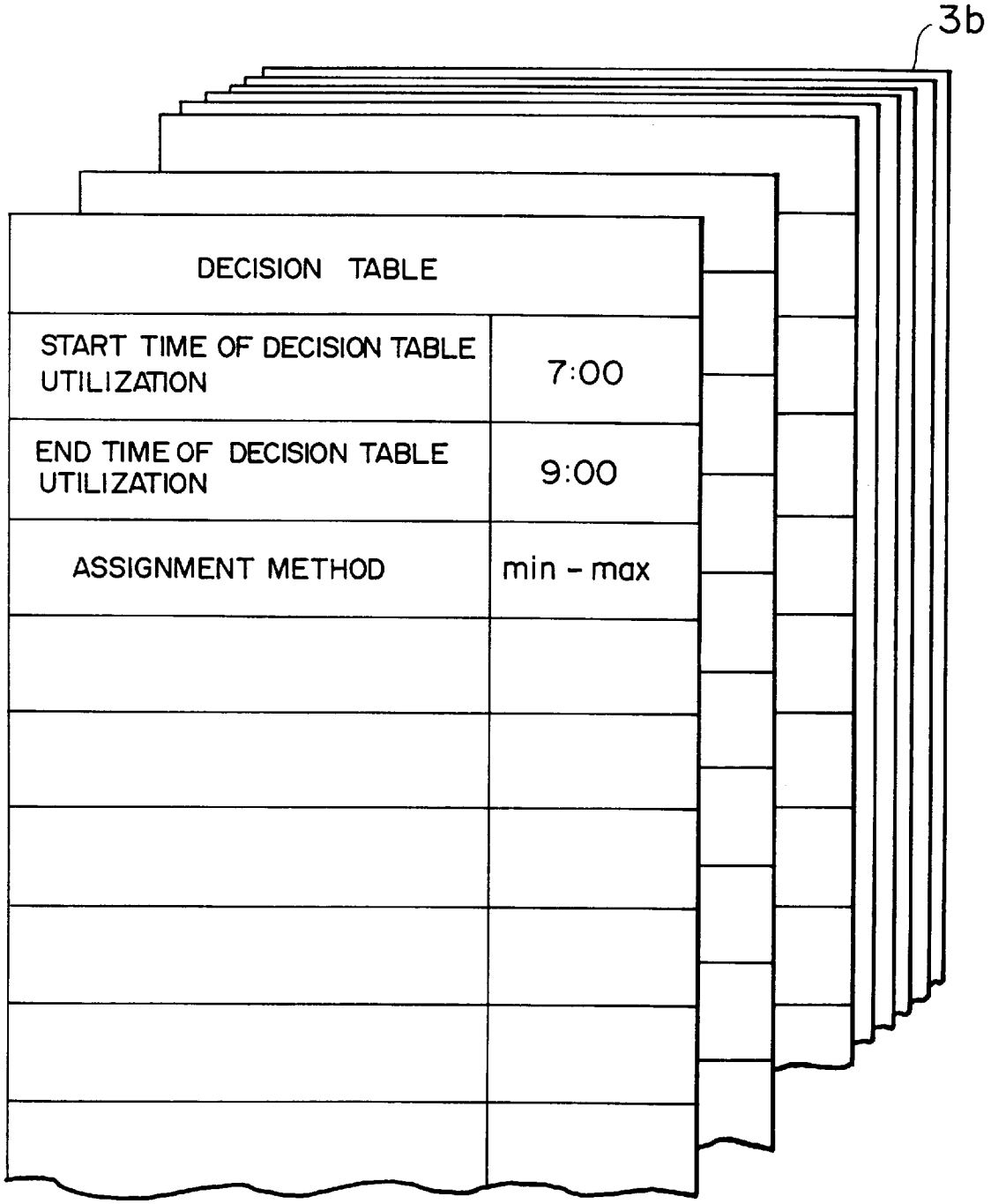
FIG. 8 shows an example of a decision table.

The thus selected control method, its predictive value for control goal and the target value are displayed on the input/output unit 1 to enable the user to decide whether the displayed contents is acceptable or not. If unacceptable, the target value for control goal and associated weight are changed and the above procedure is repeated for a changed target value and a weight associated therwith. If acceptable, the multi-objective decision making input/output control section 21*c* operates to rewrite a decision table 3*b* in the group supervisory controller 3 so that this control method may be executed. An example of the decision table is shown in FIG. 8. Since the traffic changes with time, there are provided a plurality of decision tables for dealing with different types of traffic and each decision table is described with the time its use starts and the time its use ends.

The problem of how to mutually adjust a plurality of control target values to achieve control acceptable to the customer can be treated as multi-objective programming problem which is formulated as the problem of minimizing or maximizing the objective relation $$l=f(x)-\hat{f}$$

under the limiting condition $$\left.\begin{array}{l} g(x) \leqq 0 \\ x \geqq 0 \end{array}\right\}.$$

This problem will be explained herein by way of minimization but maximization can be handled similarly by multiplying both sides of formula by "−1".

In the above formulas, $x=(x_1, x_2, \ldots, x_n)$ represents an n-dimensional decision variable vector, $f(x)=(f_1(x), f_2(x), \ldots, f_k(x)$ represents a k-dimensional vector function, $(f_1, f_2, \ldots, f_k)$ represents a k-dimensional target value vector, and $g(x)=(g_1(x), g_2(x), \ldots, g_m(x))$ represents an m-dimensional vector limiting function. Thus, the multi-objective programming problem is that of determining an n-dimensional decision variable vector which minimizes k objective functions simultaneously under m inequality limiting conditions. In group supervisory control of elevator, the decision variable vector x corresponds to a control method, the vector limiting function g(x) corresponds to traffic, performance of an elevator and environment surrounding the elevator. Then, components $f_1, f_2, \ldots, f_n$ of the target value vector $\hat{f}$ correspond to target values for control goal.

Figure 9A:
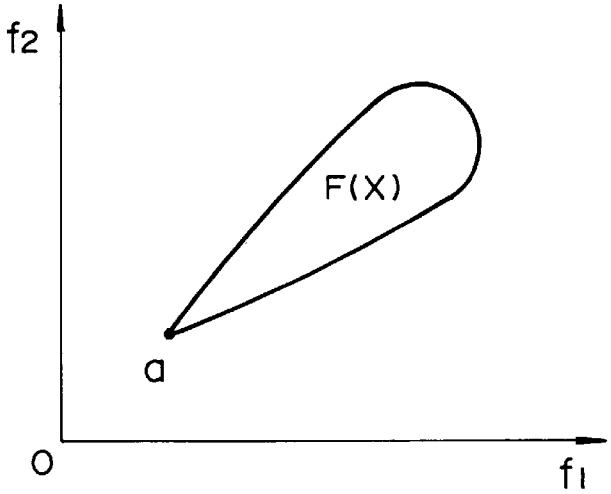
FIGS. 9A and 9B are graphic representations useful to explain the complete optimal solution.
Figure 9B:
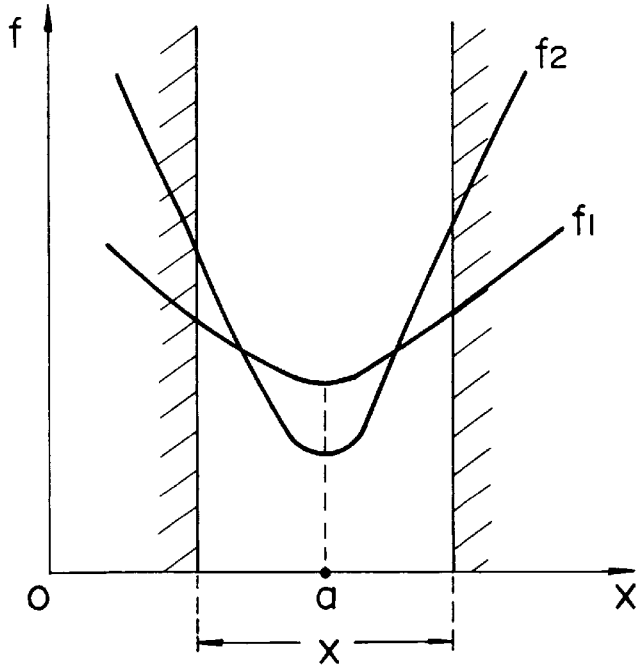
Figure 10A:
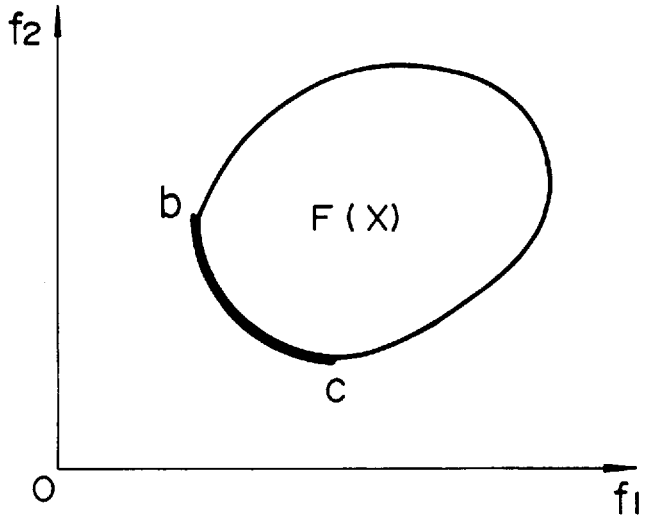
FIGS. 10A and 10B are graphic representations useful to explain the Pareto optimal solution.
Figure 10B:
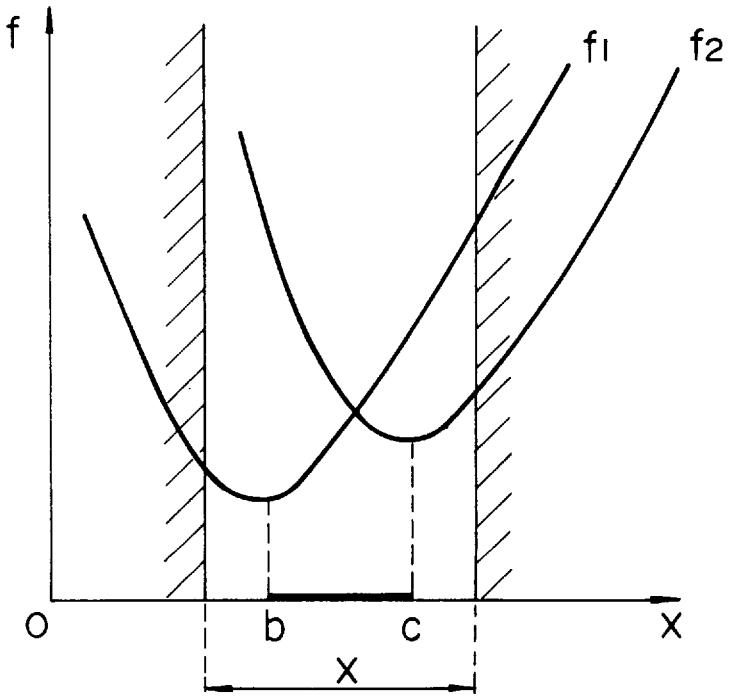
Figure 11:
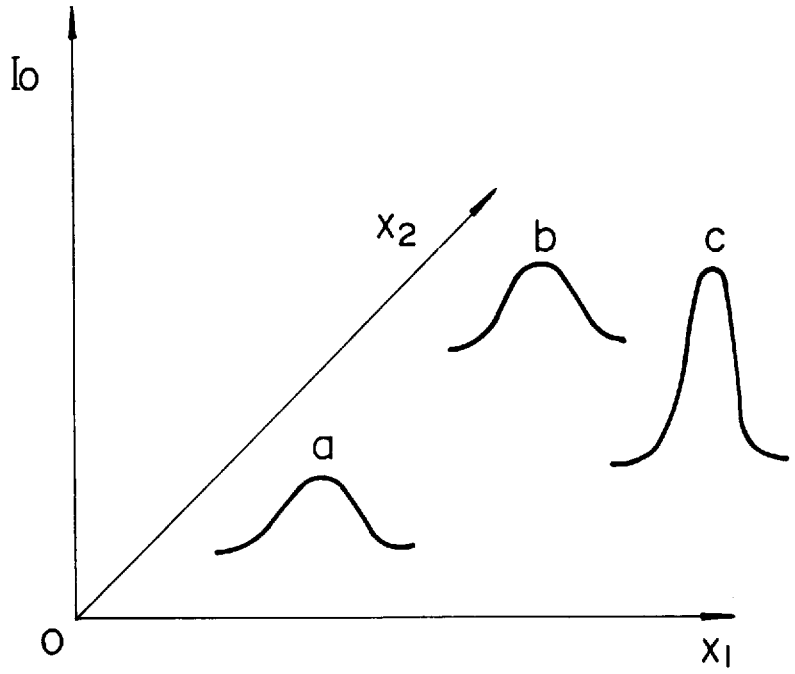
FIG. 11 is a graphic representation useful to explain global optimal solution and local optimal solution.

The solution of the multi-objective programming problem is conceptually illustrated in FIGS. 9A, 9B and FIGS. 10A, 10B. For simplicity of explanation, the target value vector $\hat{f}$ is assumed to be $\hat{f}=0$ herein. In particular, FIGS. 9A and 9B graphically explain a complete optimal solution obtained when the concept of a single objective is extended without alteration. In this example, two target functions are involved. In FIG. 9A, $F(x)=\{f(x)|x\epsilon X\}$ represents an executable region in objective function space. Illustrated in FIG. 9A is the objective function space in which $f_1$ and $f_2$ are both minimized at a point a. When $f_1$ and $f_2$ are illustrated in terms of an x−f space as shown in FIG. 9B, the $f_1$ and $f_2$ are both minimized at a point a. As is clear from the above, the complete optimal solution can exist only when all of the objective functions $f_1, f_2, \ldots, f_n$ are minimized simultaneously and in general, it can not exist when the objective functions conflict with each other. In the latter case, a solution can be defined which improves the value of a certain objective function at the cost of degrading the value of at least another objective function and this solution is called a Pareto optimal solution. FIGS. 10A and 10B are illustrative of the Pareto optimal solution. In particular, $f_1$ and $f_2$ are illustrated in terms of an x−f space as shown in FIG. 10B, indicating that $f_1$ takes the minimum value at a point b and $f_2$ takes the minimum value at a point c. Accordingly, any x lying between points b and c is the Pareto optimal solution which improves the value of one function at the cost of degrading the value of the other function. In FIG. 10A, $f_1$ and $f_2$ are illustrated in terms of an objective function space, indicating that $f_1$ takes the minimum value at a point b and $f_2$ takes the minimum value at a point c. The points b and c are included in the same Pareto optimal solusion but at the point b, the objective function $f_1$ on the one hand is minimized and the objective function $f_2$ on the other hand is the worst and at the point c, the objective function $f_2$ is minimized with the objective function $f_1$ being the worst. As is clear from the above, since the individual objective functions have different values for the same Pareto optimal solution, the individual objective functions need to be weighted as described previously in order to determine a solution which is the most preferable to the decision maker and the multi-objective programming problem needs to be converted into a scalar form which can be considered as single objective problem in order to ensure determination of solution. Specifically, the problem involved herein is that of minimizing the weighted norm lp representative of the distance from the target value $f=(\hat{f}_1, \hat{f}_2, \ldots, \hat{f}_k)$ set up for the objective function $f(x)=(f_1(x), f_2(x), \ldots, f_k(x))$ in the multi-objective programming problem. With the scalar form, when the solution is sought through mathematical programming, only a local Pareto optimal solution can generally be obtained. FIG. 11 graphically explains a global optimal solution c and local optimal solutions a and b. Through the use of the ordinary mathematical programming process or the method of slightly changing parameters to seek for better solutions, the local optimal solution indicated at a can be obtained but it is impossible to know that a better global optimal solution exists at c. It will takes a very long time to thoroughly examine all points by overlooking nothing. If in such an event a region in which local optimal solutions exist is known in advance, a global optimal solution can be determined by detecting individual local optimal solutions and compare them with each other. More specifically, to practice this expedience, the deduction unit 24 uses knowledge stored in the knowledge base 23 to deduce a region in which local optimal solutions exist and determine the local optimal solutions, and the multi-objective decision making evaluation section 21*b* compares the determined local optimal solutions with each other. Incidentally, in group supervisory control of elevator, the objective function can not be expressed by numerical formulas without much difficulties in many applications and it also changes with the installation condition of elevator. Accordingly, in such an event, the deduction unit 24 deduces a region where local optimal solutions exist, the simulator unit 25 uses some parameters present in the region to determine predictive values for control goal, and the multi-objective decision making evaluation section 21*b* compares the determined predictive values with each other to provide a solution. The solution obtained through the above procedure has, uncertainty as to whether to be a Pareto optimal solution but this solutions is practically satisfactory.

The deduction unit 24 deduces a control method in an exemplary manner as will be described below by referring to the use of knowledge shown in FIG. 4. It is assumed that the building is classified into an office building, the time is to attend office, the rate of change of reservation for control target is weighted by a small amount and the longtime waiting is weighted by a large amount. Because of the office building, rule 1 is selected which indicates that the user is experienced and on the basis of the condition of experienced user and the assumed small weight associated with the reservation change rate, rule 2 is selected so that reservation will be changed when a longtime waiting occurs. Also, on the basis of the assumed office building and time to attend office, rule 5 is selected so that services are concentrated on the reference floor. In this manner, running of elevator is controlled such that services are concentrated on the reference floor and reservation change is effected frequently when a longtime waiting tends to occur. In addition to the above-described deduction with regard to the control target inputted from the input/output unit 1 and the environmental condition, the deduction unit may use detailed traffic data and elevator performance fetched from the traffic/environment data base 22 to carry out deduction and determines a specified assignment evaluation formula for elevator and a range of parameters, and the simulator 25 responds to results sent from the deduction unit to provide a predictive value.

Figure 12:
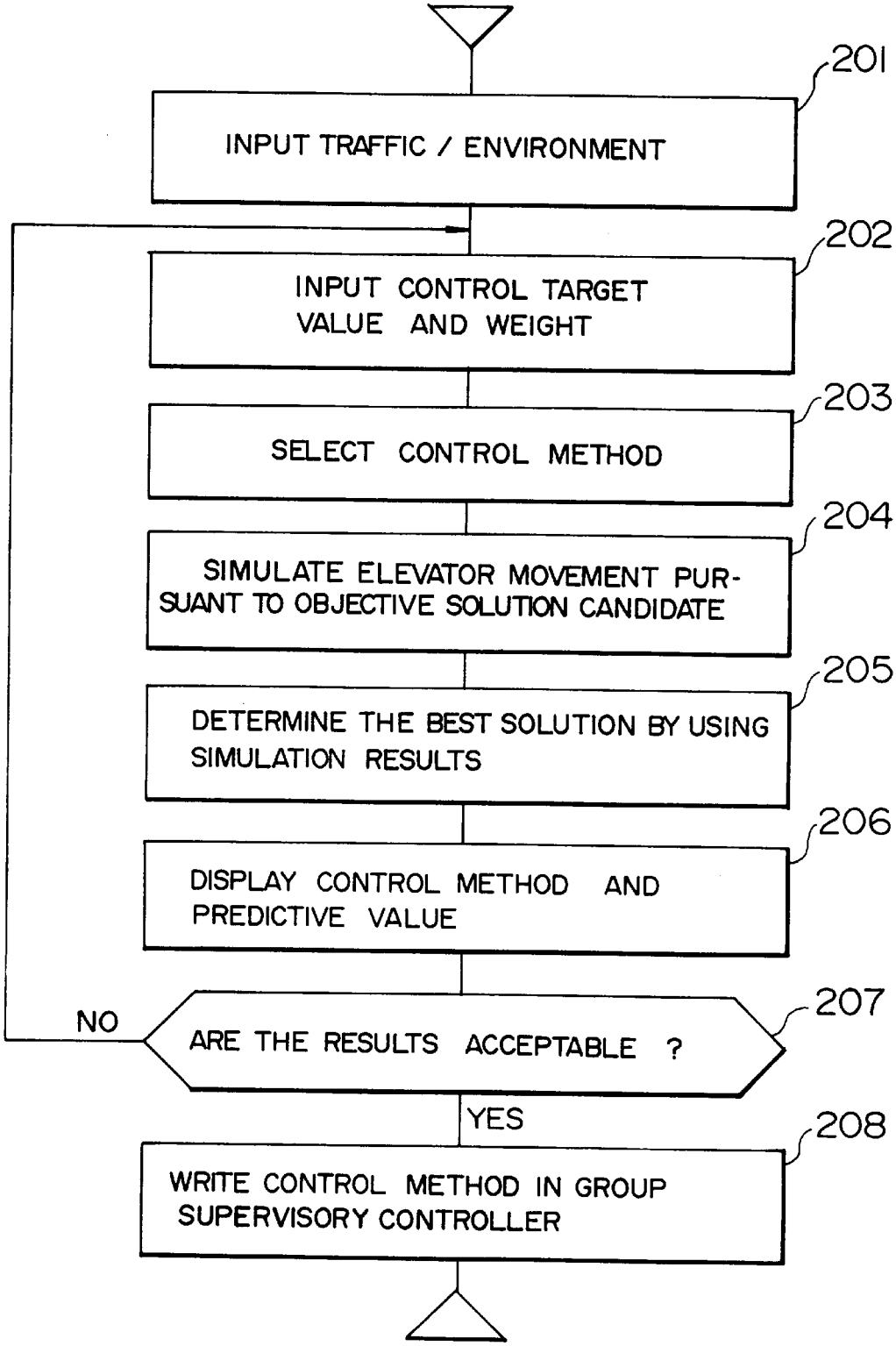
FIG. 12 is a schematic flow chart in an operational application of the elevator control system.

An example of operational application of the elevator control system will now be described with reference to a schematic flow chart of FIG. 12. Firstly, data of condition of environment surrounding an elevator and traffic is inputted from the input/output unit 1 (step 201). Then, a control target and its weight are inputted from the input/output unit 1 (step 202). Subsequently, the multi-objective decision making unit 21 and deduction unit 24 operate to select a few candidates for control method and under given traffic and environment surrounding the elevator (step 203), simulation is carried out using the selected control methods (step 204). Thereafter, simulation results of individual control methods are compared with each other at the multi-objective decision making unit 21 to determine the best solution (step 205). A control method thus selected and predictive values of control parameters attainable with this control method are displayed on the input/output unit (step 206). The displayed contents enables the user to decide whether the selected control method is acceptable (step 207). If unacceptable, the procedure returns to the step 202 and if acceptable, parameters necessary for execution of the control method are written in the group supervisory controller 3 (step 208).

Figure 13:
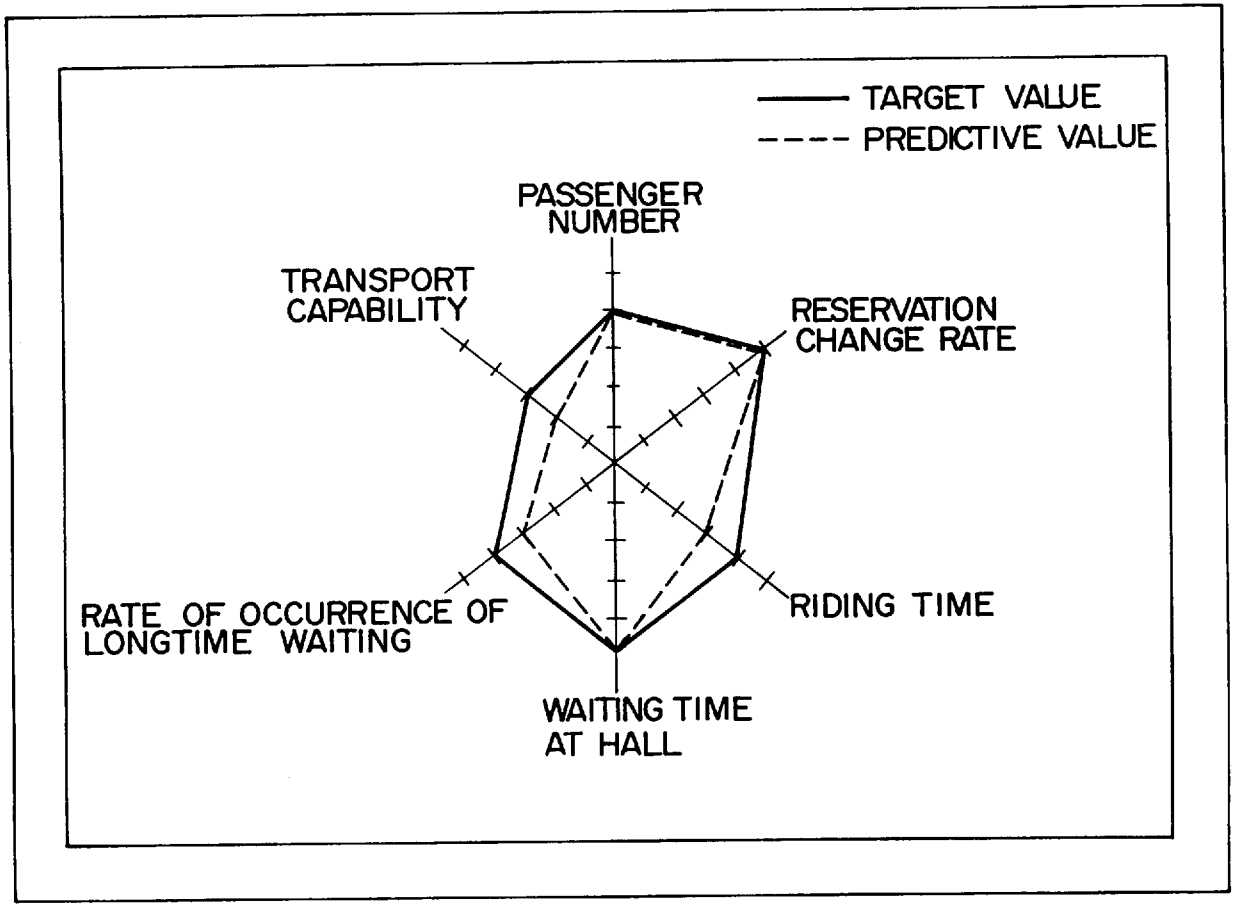
FIGS. 13 and 14 are diagrams illustrating examples of picture display of target values for control goal and predictive values.
Figure 14:
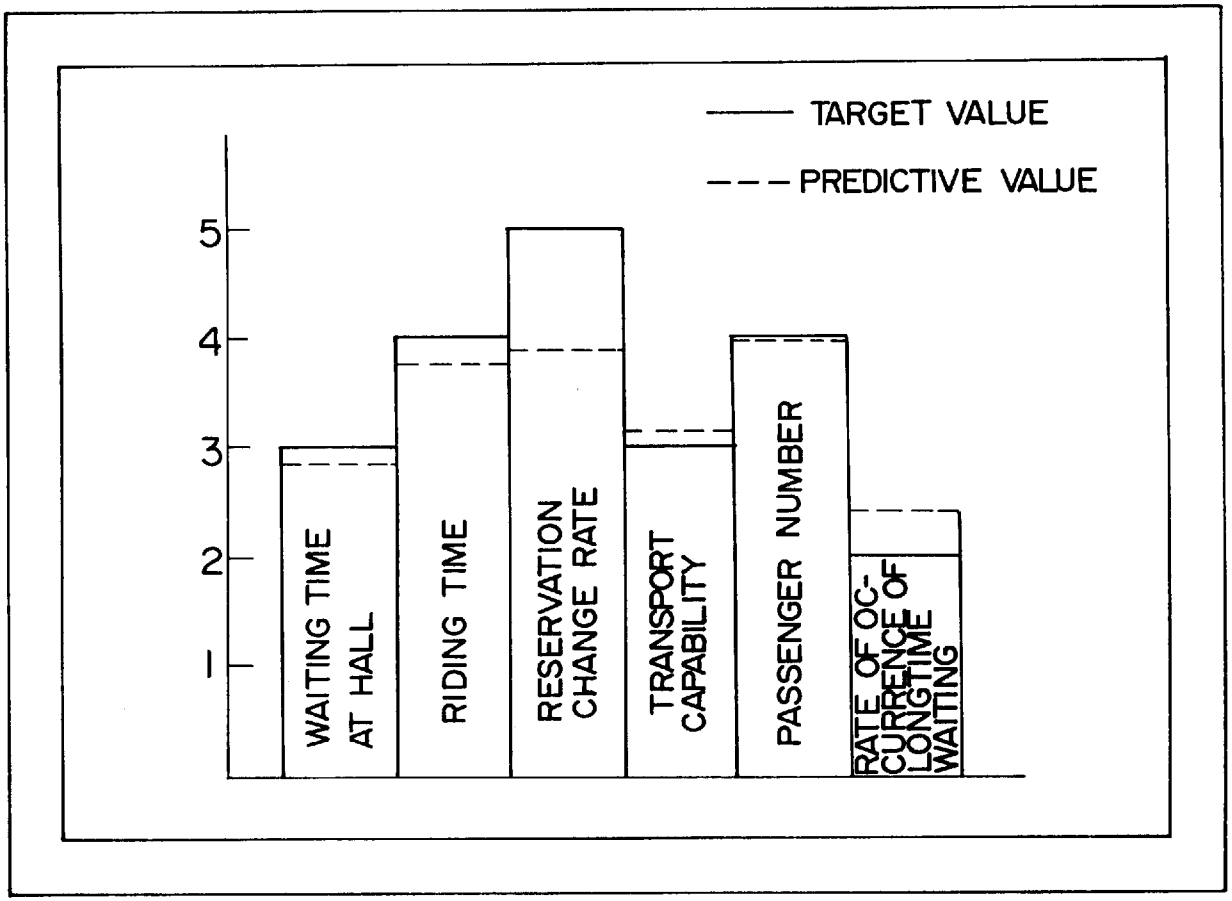

Referring to FIGS. 13 and 14, examples of display of target values for control goal and corresponding predictive values on the screen are illustrated. In an embodiment of display shown in FIG. 13, the target values and corresponding predictive values are displayed in the form of a hexagonal radar chart in which the target value is indicated at solid line and the predictive value is indicated at dashed line. Advantageously, this chart form can clearly show balance between control goals. In another embodiment of display shown in FIG. 14, the target values and corresponding predictive values are displayed in the form of a bar graph in which the target value and predictive value are indicated at solid line and dashed line, respectively, as in the case of the FIG. 13 embodiment. This graph form is advantageous in that deviation of the predictive value from the target value for control goal can be recognized visually with ease. In these embodiments, the ratio of each control parameter to a standard value determined in accordance with the type of building is indicated at 5 grades but actual waiting time may be indicated in second and reservation change rate may be indicated at percentage.

Figure 15:
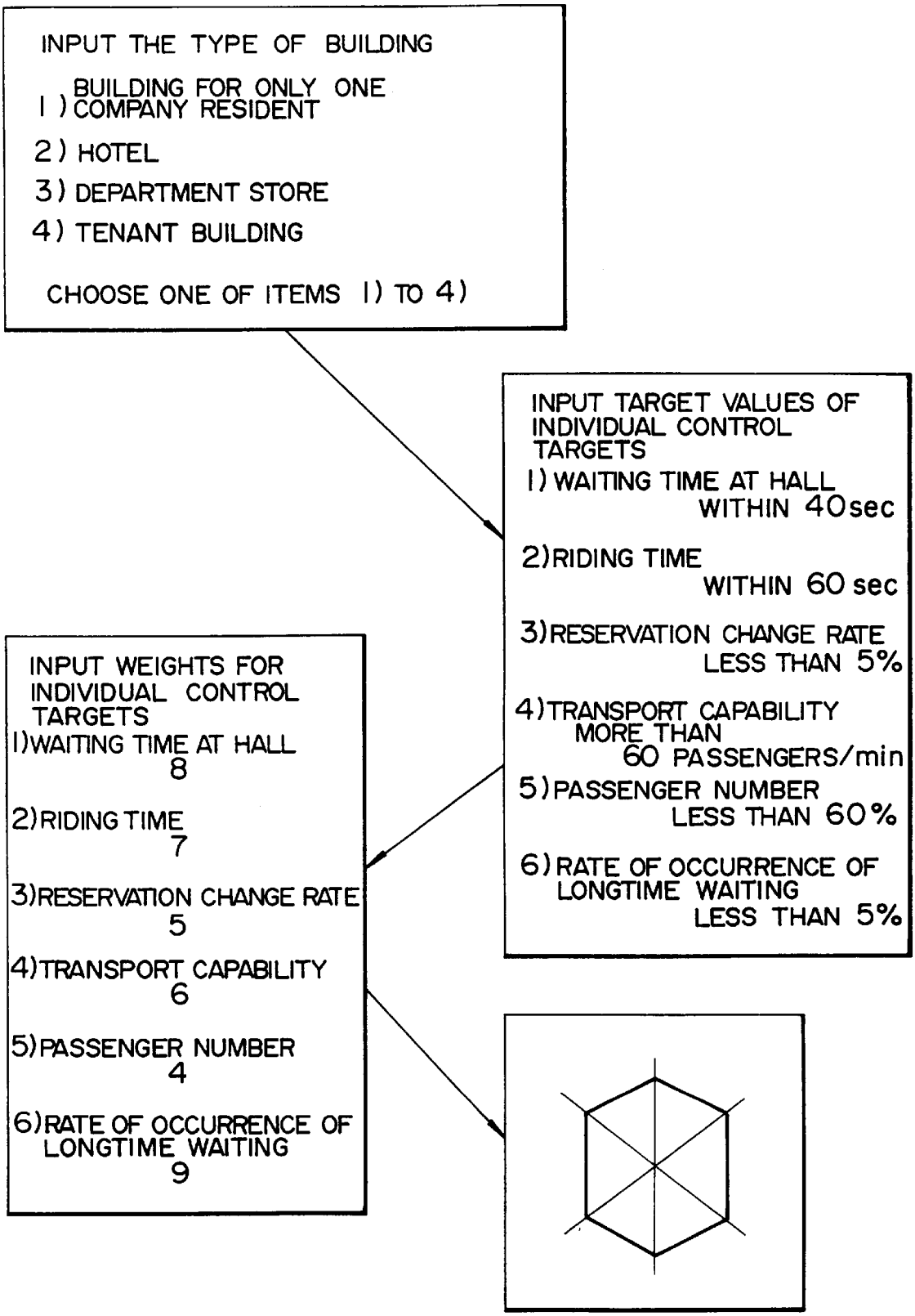
Figure 17:
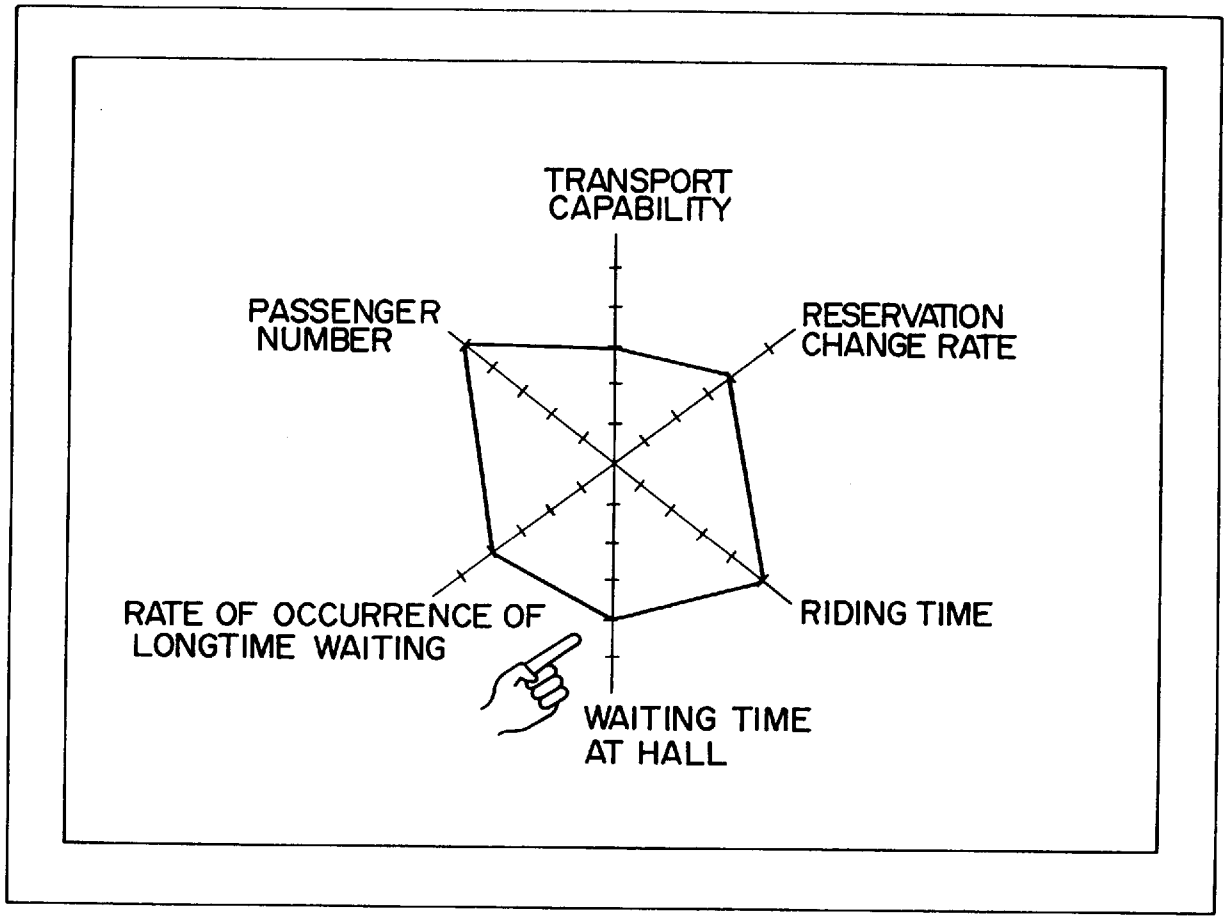
FIGS. 17 and 18 show examples of control targets inputted in the form of a coordinate chart.
Figure 18:
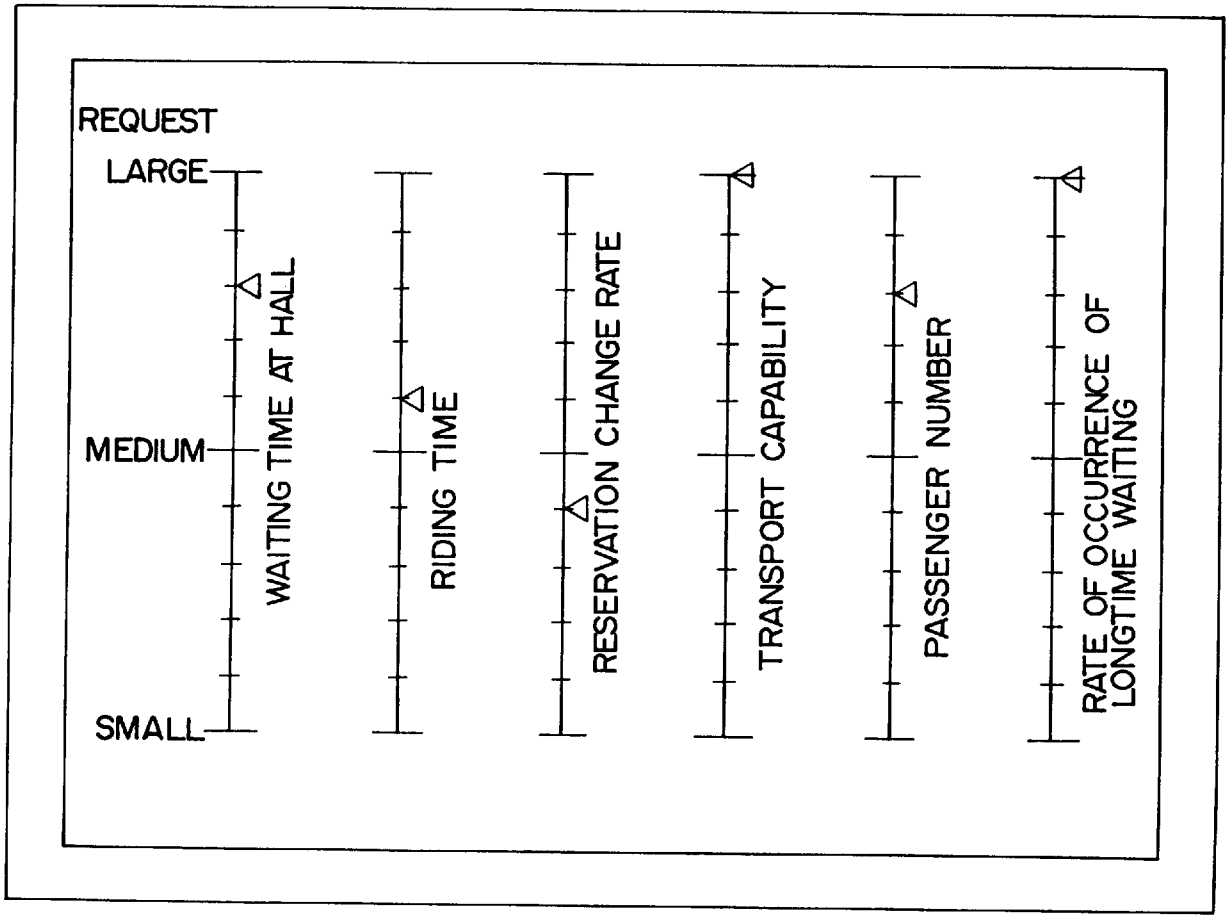

FIG. 15 shows an embodiment of inputting target values for control goal and associated weights in the conversational or guidance fashion. In this embodiment, individual weights are inputted to insure fine setting but in a complicated and troublesome way. FIG. 16 shows an embodiment of inputting target values for control goal and their priority. In this embodiment, fine setting can be done only by changing the target values but the manner of inputting is simplified. FIG. 17 shows an embodiment of inputting wherein target values are inputted by inputting a hexagonal chart of target values. The hexagonal chart may be inputted using a coordinate input device such as a mouse or a touch panel integral with the display unit. Advantageously, in accordance with this embodiment, ease of operation can be improved and upon change of the target value for control goal, the influence of a control goal upon another control goal can be grasped easily. FIG. 18 shows an embodiment of inputting target values for control goal and associated weights by using cursors. This embodiment is expected to attain effects resembling those of the FIG. 17 embodiment by using only the keyboard without resort to any special coordinate input device.

Figure 19:
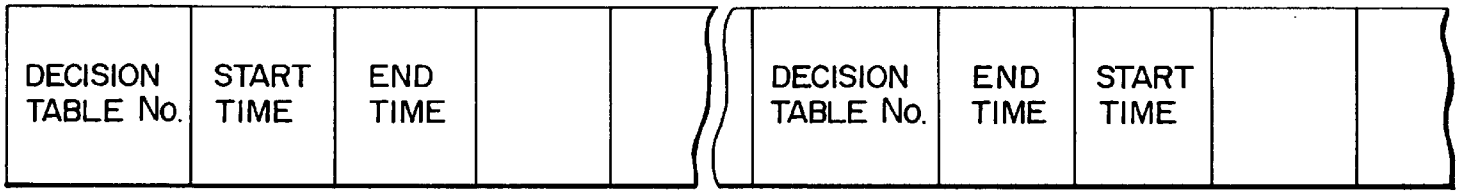
FIG. 19 shows a transmission format used for transmission of the contents of the decision table.
Figure 20:
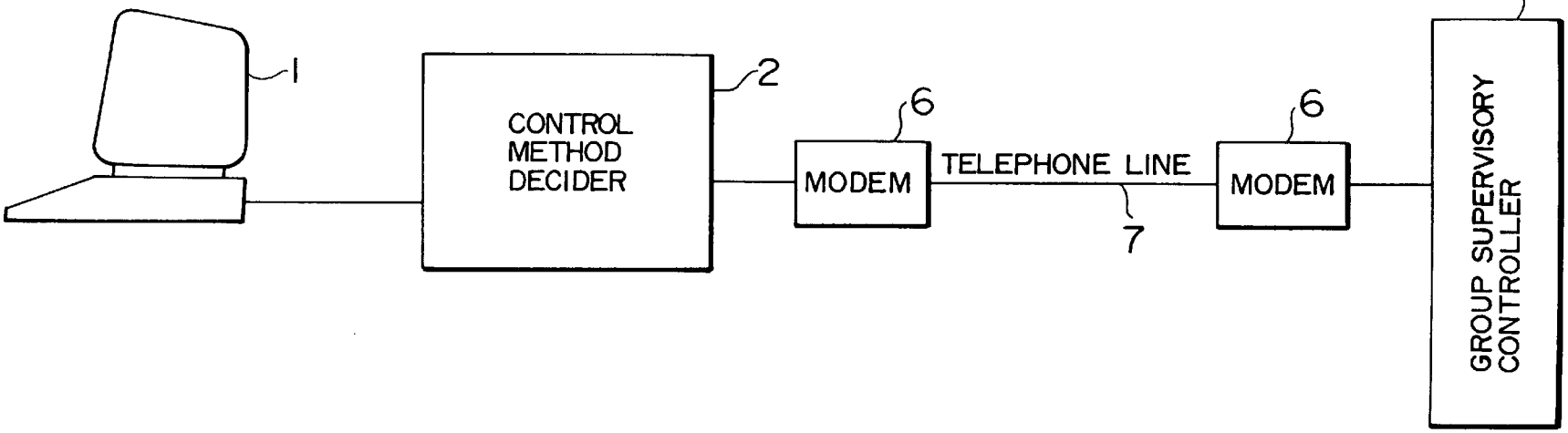
FIG. 20 is a diagram schematically illustrating an example of connection of the control method decider to a group management controller through telephone line.

In transmitting the contents of the decision table in series from the control method decider 2 to the group supervisory controller 3, a transmission format as shown in FIG. 19 is employed. FIG. 20 schematically illustrates an embodiment of connection of the input/output unit 1 and group supervisory controller 3 wherein the input/output unit 1 and control method decider 2 installed in a caretaker room or office room are connected to the group supervisory controller 3 installed in a machine room through modems 6 and a telephone line 7. In accordance with this embodiment, setting of group supervisory control can be changed from a remote location such as the caretaker room or office room.

The control parameters may also be inputted using a recording medium such as IC card.

According to the foregoing embodiments, the control method can be performed which harmonically meets a number of requested control parameters or items including conventional waiting time at the hall and energy saving as well as riding time, reservation change rate and passenger number, and the predictive value determined by a selected control method is presented to the customer to enable him to make neccessary change to the satisfaction of the customer, thereby ensuring running of elevator which is satisfactory to the customer.

The solutoin is sought for through deduction and in addition the predictive value is checked for its validity through simulation to improve accuracy of prediction. Further, in spite of the fact that to meet slight changes in traffic and difference in service floors, a variety of modes of elevator group supervisory are needed which are difficult to conduct, a few candidates for control method are selected and simulated and simulation results are compared with each other to provide a better control method by which such difficulties can be overcome, and as a result the practically satisfactory solution can be determined within practically acceptable time without resort to any knowledge base of impractically large capacity.

Another embodiment of the elevator control system according to the invention will now be described by making reference to FIGS. 21 to 37.

Figure 21:
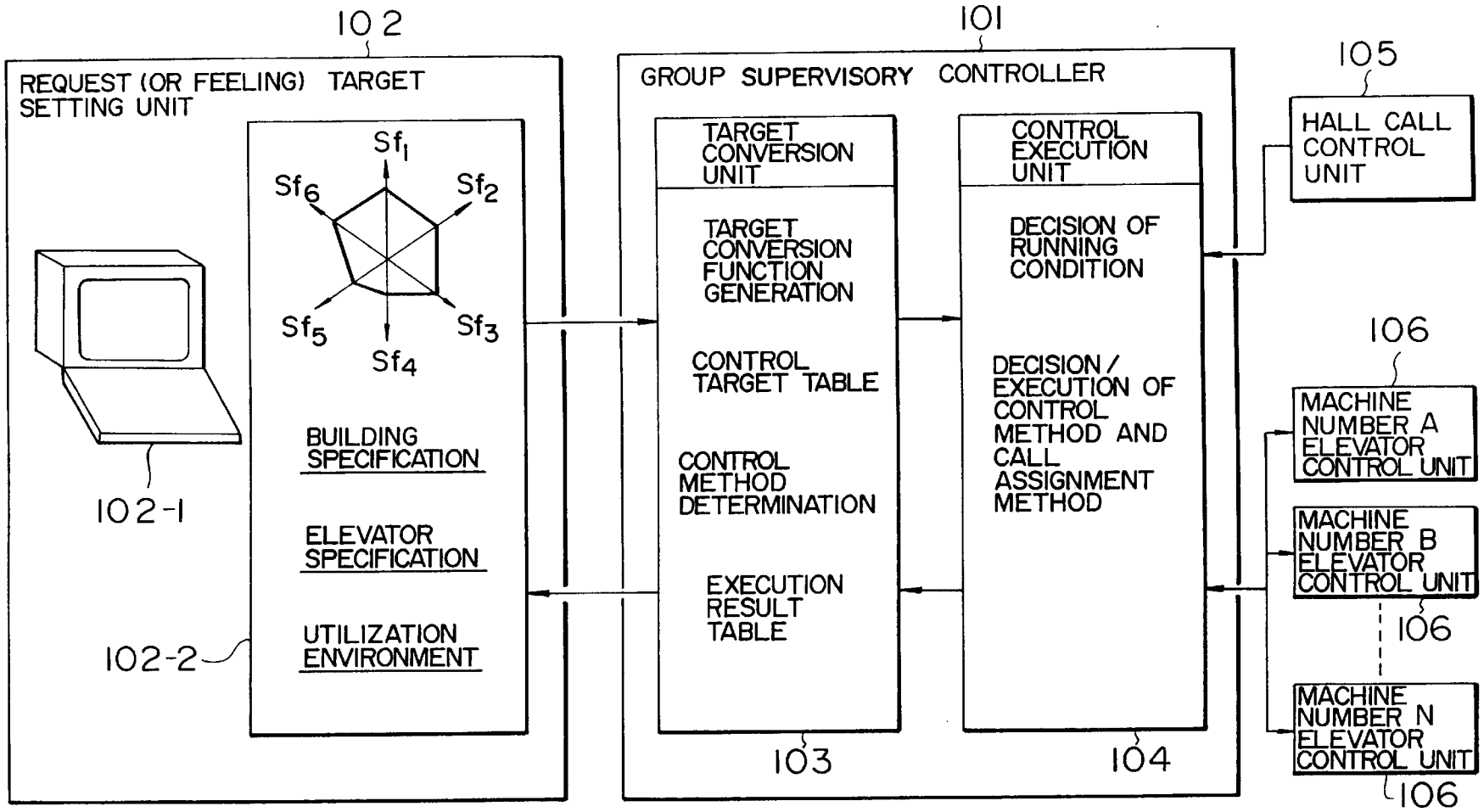
FIG. 21 is a schematic block diagram illustrating the overall construction of another embodiment of the elevator control system according to the invention.

In particular, FIG. 21 illustrates the overall construction of the elevator control system of this embodiment. This control system for group supervisory control compriese three major blocks. The first block is a feeling (or request) target setting unit 102 adapted to set a target value feeled or requested by the user, running condition of an elevator in question for attaining the requested target value, and utilization environment of the elevator such as traffic. The provision of this setting unit is effective to permit the user, even though not being an expert in elevator, to readily effect change of control method and running reservation. In FIG. 21, a keyboard and a display are employed in combination to form an input terminal (such as personal computer or work station) 102-1 by means fo which given conditions 102-2 including the requested target value are inputted. In an alternative, such means as dipswitches may be provided in a group supervisory controller 101 and directly set conditions (control goals in elevator) may be changed by turning on or off the dipswitches. Further, necessary conditions may be set directly in the group supervisory controller 101 by using a telephone line or a recording medium such as IC card. The second block is a target conversion unit 103 adapted to convert a desire of the user (feeled or requested target value) set by the request target setting unit 102 into a numerical value used in the actual control system. More specifically, the target conversion unit uses data representative of, for example, utilization environment of elevator, which is inputted together with the request target value upon setting thereof, to extract a target conversion function (for example, a function exemplified at block 103*a* in FIG. 22) which is prepared on the basis of data reflecting answers of the users to request items described in a questionnaire set out in advance, determines a target value (for example, see a table exemplified at block 103*b* in FIG. 22) used in actual control by using the extracted function, and determines a control method best suited for attainment of the control target. Values of the control target are classified in accordance with the conditions including traffic and stored in a table. The target conversion unit 103 included in the group supervisory controller 101 in this embodiment may be disposed externally of the controller 101 or may be build in the request target setting unit 102. The third block is a control execution unit 104 operable to determine and select control methods expected to be best suited for attainment of the control target, decide a running condition of elevator on the basis of data sent from a hall call control unit 105 comprised of hall call button switches and a control unit 106 of the machine number elevator in question, access the table to fetch a control method corresponding to the decided running condition, among the previously determined control methods (for example, call assignment methods), execute the fetched control method and transmit the execution results to the machine number elevator in question. Decision of the running condition may be carried out on the basis of, for example, the number of activation operations per unit time of the hall call control unit (the number of calls) and the number of passengers. The control system constructed as above can rapidly reflect the desire of the user in control operation to thereby improve easiness of elevator operation. In addition, actual results of running of the machine number elevator in question can be inverted by the target conversion unit 103 into a request target value which in turn is used to inform the user of the movement of elevator effective to indicate degree of attainment of the set target.

Figure 22:
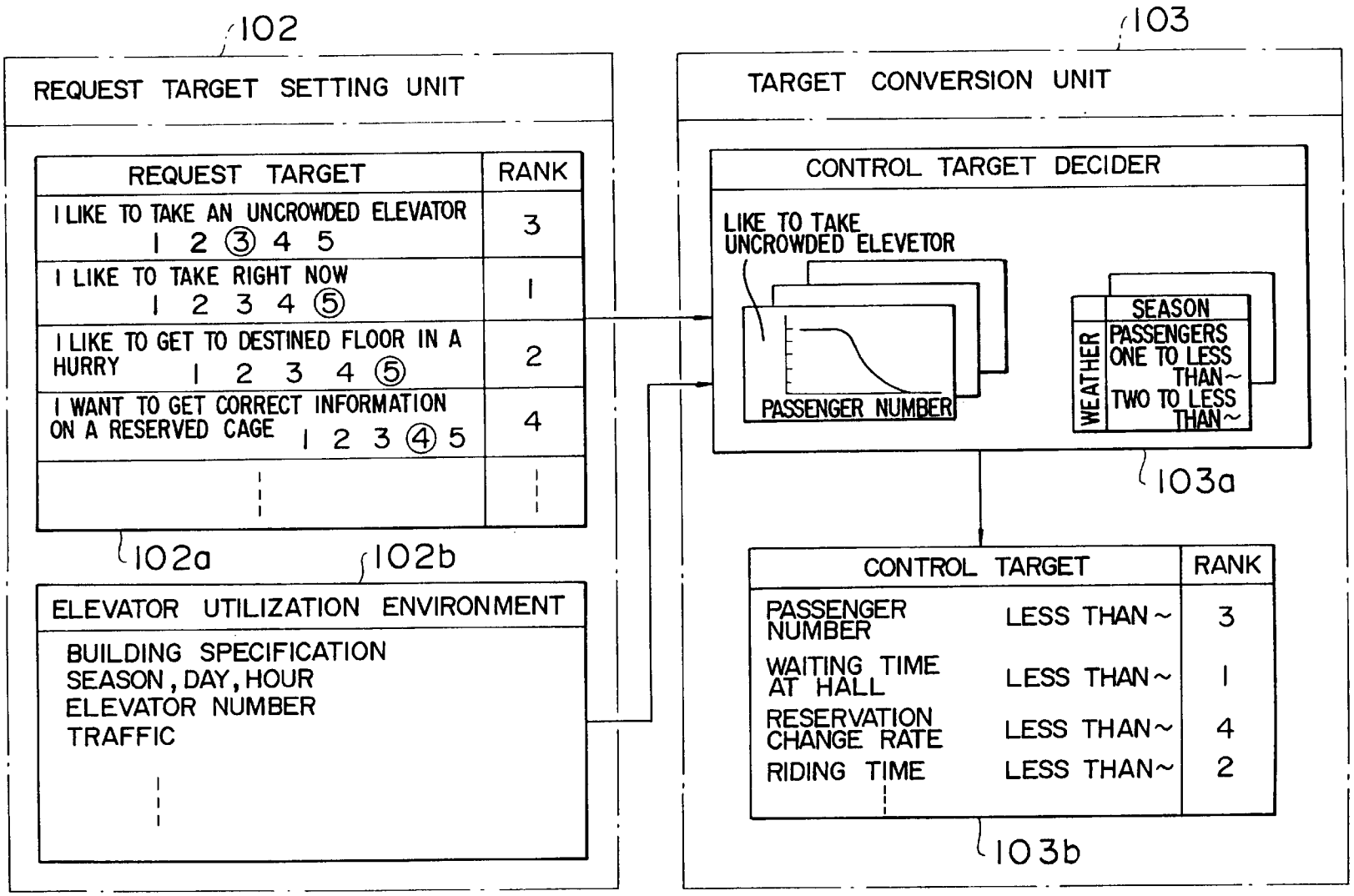
FIG. 22 is a diagram useful in explaining the operation of request target setting unit and target conversion unit.

FIG. 22 is a diagram useful to explain the operation of request target setting unit 102 and target conversion unit 103. The request target setting unit 102 comprises a request target value setting section 102*a* and an elevator utilization environment setting section 102*b* for setting elevator utilization environment (for example, the condition for utilization such as time zone and traffic, the characteristic of a building in which the elevator is installed and the specification of the elevator) under which the request target value has to be attained. Incidentally, the request target value is not directly set using a physical quantity representative of a target desired by the user but is indirectly set using the degree of a psychological feeling such as preference. In other words, the request target value may be considered as qualitative request concerning elevator running which stems from the user's sense of value, interest, taste, feeling, preference and the like. For example, the user, unless being an expert (such as designer and maintenance engineer) in elevator, is apt to say "I like to take an elevator right now" but in general would face difficulties in presenting a numerically quantitative request "Some elevators are installed in parallel for some floors and the waiting time suited for the elevator running at a speed of some meters/min is about some seconds, and so I like the waiting time shorter than some seconds". Under the circumstances, this embodiment accepts the request target value introduced in the form of such a qualitative target as expressed by "I like to take an uncrowded cage" or "I like to take right now". The request target value may also be considered as an analog quantity (or digital quantity) representative of a normalized target value (for control goal) of control data such as waiting time at the hall, riding time, reservation change rate (forecasting miss rate), passenger number (for example, the number of passengers staying in the cage when the door is closed), conveyed passenger number (the number of passengers conveyed per unit time) and so on. While the actual control target value varies with the type of building (hotel, department store, office building in which only one company resides or government and public office building), the elevator specification including the number of service floors, the number of installed elevators and rated capacity, and the utilization condition including traffic, the request target is normalized and therefore can be set to a desired value. One way of normalization will be exemplified below. For example, given that during rush hours for a building in which only one company resides, the minimum serviceable average waiting time is 25 seconds, the maximum serviceable average waiting time is 70 seconds, the minimum average waiting time used for normalizing the average waiting time is 100 and the maximum average waiting time used for normalizing the average waiting time is 0 (zero), then for a request target value being set to 50, a control target value is obtained which is $$70 - \frac{45}{100} \times 50 = 47.5 \text{ (seconds)}$$

and a control method is selected, from a plurality of control methods, which is capable of controlling the waiting time to a value which is less than the thus obtained control target value. The request may also be considered to express relative intensity among three or more items and to express a plurality of elevator running performance grades obtained by dividing the range between the minimum and maximum levels in the light of various conditions for the elevator. As is clear from the above, the feeling (or request) target is an expedient introduced to overcome difficulties encountered in directly expressing the control target value for running of elevator in terms of a specified quantitative numerical value by taking the control system into account. The request target value may be processed in other ways than normalization.

However, if the elevator user rquests that all input itmes "I like to take an uncrowded cage", "I like to take right now" . . . be satisfied thoroughly, it is difficult from the standpoint of running efficiency and the like factor to simultaneously satisfy conflicting input items (for example, a desire "I like to take an uncrowded cage" and another desire "I like to take right now" which occur during rush hours). Accordingly, priority is set in advance as to which desire is dominant and ranking of the target values is effected. Ranking is the problem of comparison and applicable to the target values, even though the target values being qualitative. Conceivably, one way of determining priority ranking is to rank request targets in the order of input sequence and a second way is to set up ranking of request target values concurrently with setting thereof. Otherwise, the request target values may be weighted and for advanced effectiveness, priority ranking and weighting may be applied in combination to the request target values.

Since the feeling (or request) target value is a qualitative target as described previously and simply expresses the degree of a desire of the user, the inputted request target value needs to be converted into an actual control target value (controllable quantity) in order to ensure control of elevator. However, the target conversion can not be determined for the request target value in one definite way and concurrently with inputting of the request target value, elevator utilization environment is inputted which includes the elevator specification indicative of the number of installed elevators, speed and rated capacity of elevator, the building specification indidative of hotel, building for only one company resident, department store and building for plural residents, and the utilization condition indicative of season, time zone (or time), the number of floors and traffic. Then, the control target decision section 103*a* included in the target conversion unit 103 determines a function or rule used for target conversion in accordance with the elevator utilization environment, determines a control target value corresponding to the request target value and records the control target value on a control target table 103*b* in correspondence to the request item in question. The control target conversion will be described later in greater detail.

Figure 23:
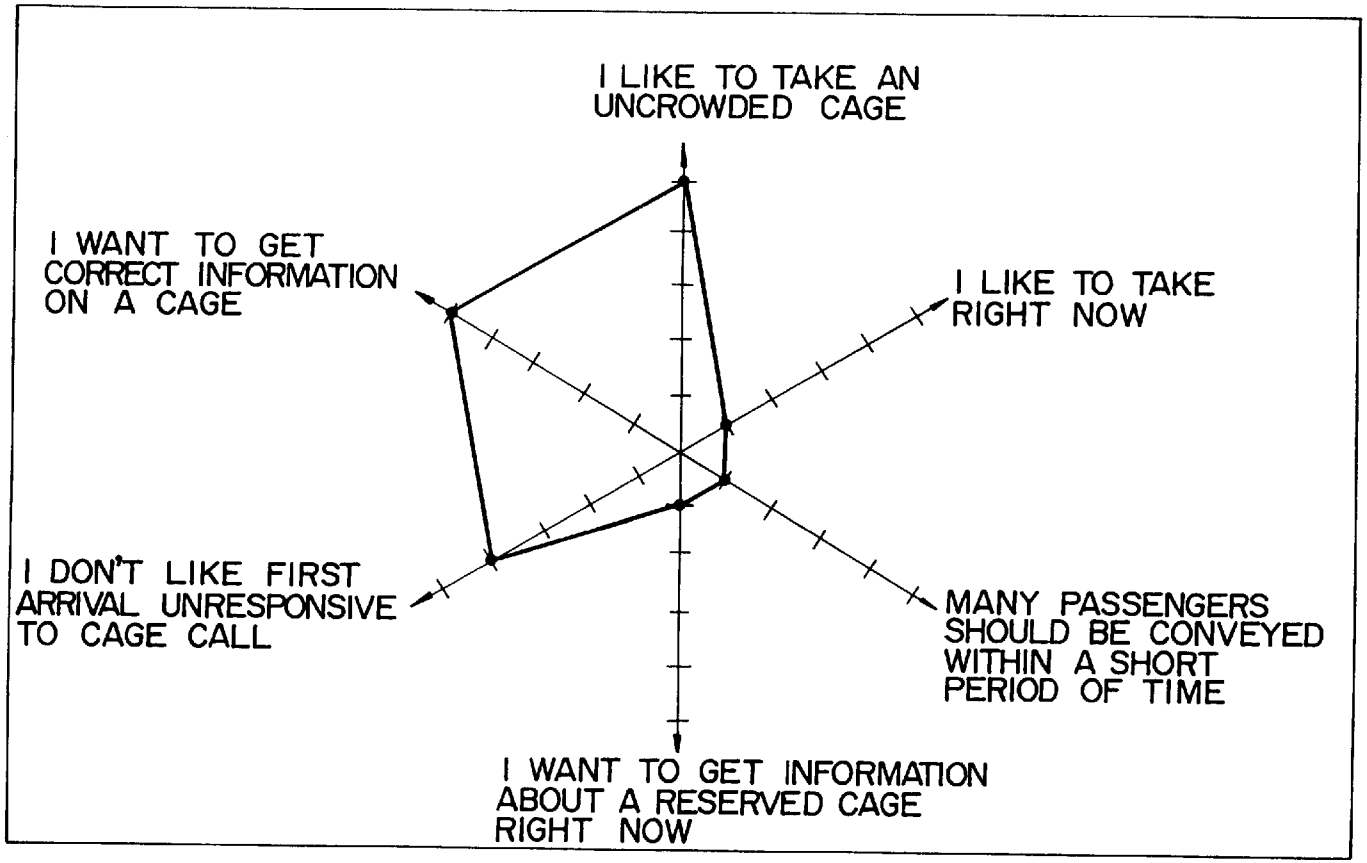
FIGS. 23 and 24 are diagrams showing examples of setting of request targets.
Figure 24:
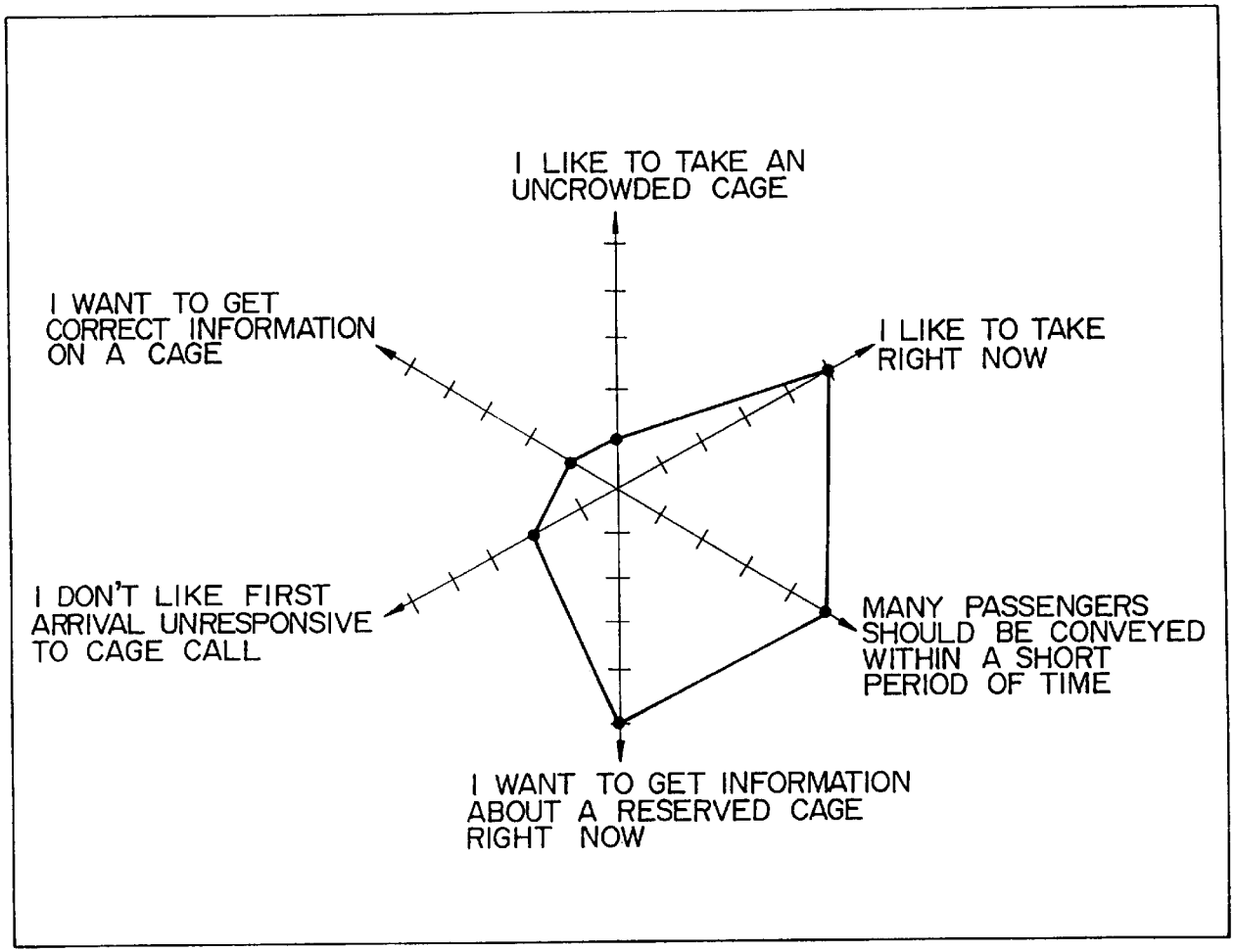

The request target value is set using numerical values ranging from 1 to 5 in the FIG. 22 embodiment but alternatively it may be set in analog fashion by inputting a radar chart as shown in FIG. 23 or 24 through a mouse or the like. In particular, FIG. 23 illustrates an example of request target in the hotel which is set in advance by the designer who takes into account the elevator utilization condition. As will be seen from FIG. 23, in the hotel, the passenger carrying baggages desires to take a rather uncrowded cage and more urgently to lessen the distance over which the passenger moves with baggages carried during the time zone within which lodgers use elevators and consequently, a desire "I want to get correct information on an arriving cage" is dominant but a desire "I like to take right now" and a desire "Many passengers should be conveyed within a short period of time" are suppressed. However, in the event that an entertainment is going to be held, the desire "Many passengers should be conveyed within a short period of time" will become dominant. In such an event, other demand items including the desire "I like to take an uncrowded cage" can not be satisfied any more. The degree of change in compatibility depends on the degree and importance of requests for individual demand items. In FIG. 22, the orders of the importances of achieving what are requested by respective requests are determined by giving each request target its rank of importance. In the case of the radar chart shown in FIGS. 23 and 24 as well, the orders of the importances may be set by giving the ranks of the importances. Further, it is also possible to decide the order of importances by inputting the request in order of the importances. FIG. 24 illustrates an example of request target in the building for only one company resident. In FIG. 24, with a view of improving efficiency of work in the company, demand items "I want to get information about a reserved cage right now", "Many passengers should be conveyed within a short period of time" and "I like to take right now" tend to be dominant.

Figure 25:
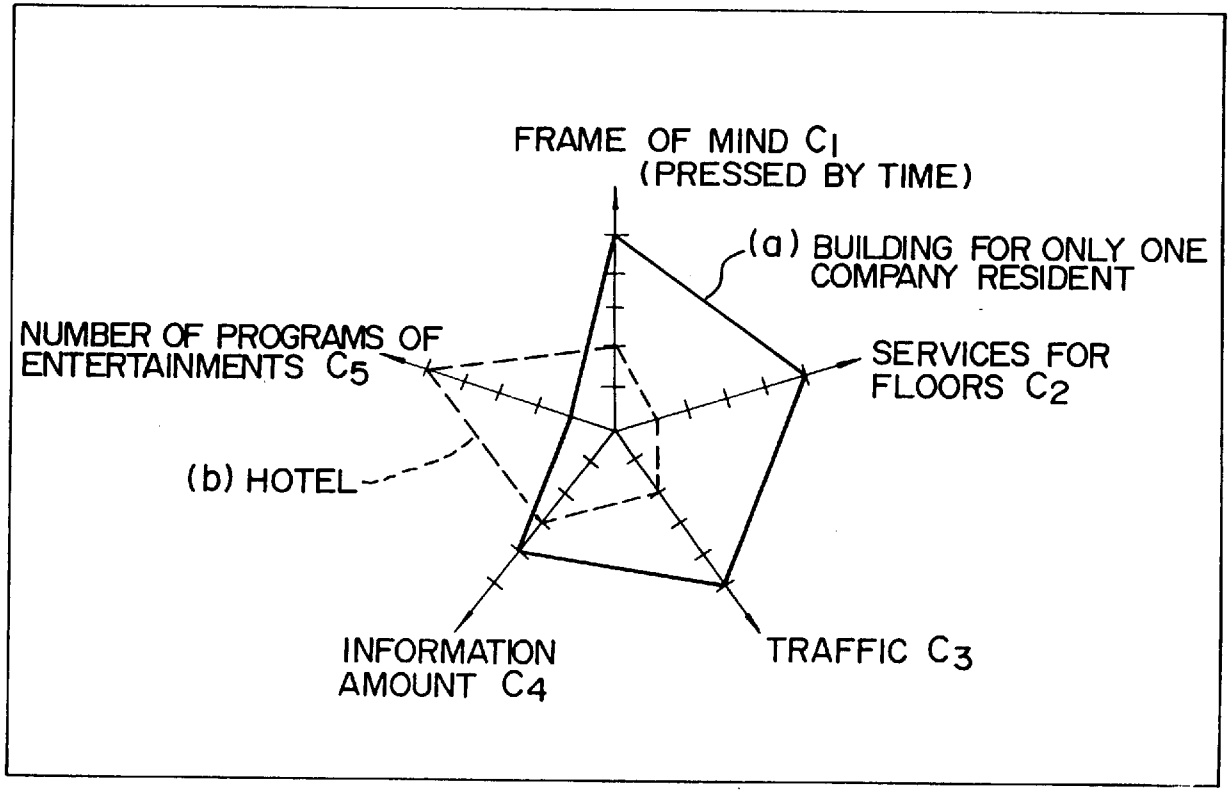
FIG. 25 is a radar chart showing characteristics of a building.

Incidentally, concurrently with inputting of the request target, the building specification needs to be set. Characteristics of building are indicated in a radar chart as shown in FIG. 25 and they differ for the types of building. In FIG. 25, characteristics (a) of the building for only one company resident are indicated at solid line and characteristics (b) of the hotel are indicated at dashed line. Different request target values are set depending on the difference between these characteristics.

Figure 26:
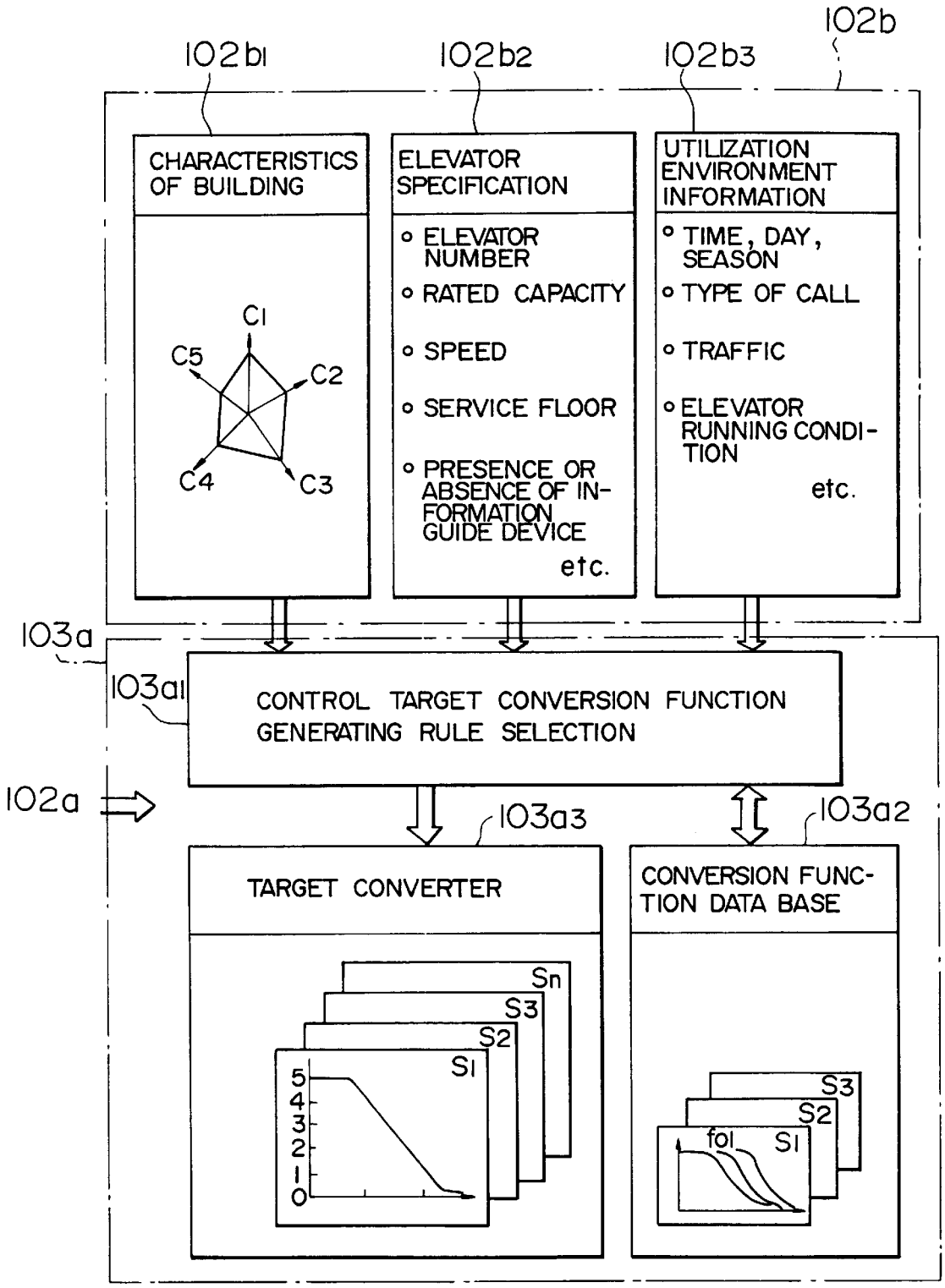
FIG. 26 is a diagram for explaining the manner of conversion to control target.

FIG. 26 schematically illustrates an arrangement for converting the set request target value into the control target value.

As described previously, concurrently with setting of the request target value, information about elevator utilization environment is set by an elevator utilization environment setting section 102*b*. The elevator utilization information is mainly classified into building characteristic 102*b*1, elevator specification 102*b*2, and utilization environment information 102*b*3. The elevator specification and building characteristic once set will not be changed to a great extent but the utilization environment information 102*b*3 contains items or parameters which need to be renewed when the user sets a new request. Such parameters are, for example, traffic, time zone and floor number which are required to meet the new request. A request target set by the request target value setting section 102*a* and elevator utilization environment information set by the elevator utilization environment setting section 102*b* are sent to the control target setting section 103*a* of the target conversion unit 103. The target conversion unit 103 comprises the control target setting section 103*a* and the control target data table 103*b*, and the section 103*a* includes a control target conversion function generating rule selector 103*a*1, a conversion function data base 103*a*2 and a target converter 103*a*3. The control target conversion function generating rule selector 103*a*1 responds to the elevator utilization environment information to activate one of conversion function selection rules which are set in accordance with characteristics of building and pursuant to the activated rule, it selects functions $f_{s1}, \ldots, f_{sm}$ contained in conversion function itmes $s_1, s_2, \ldots s_n$ corresponding to request target items.

Figure 27A:
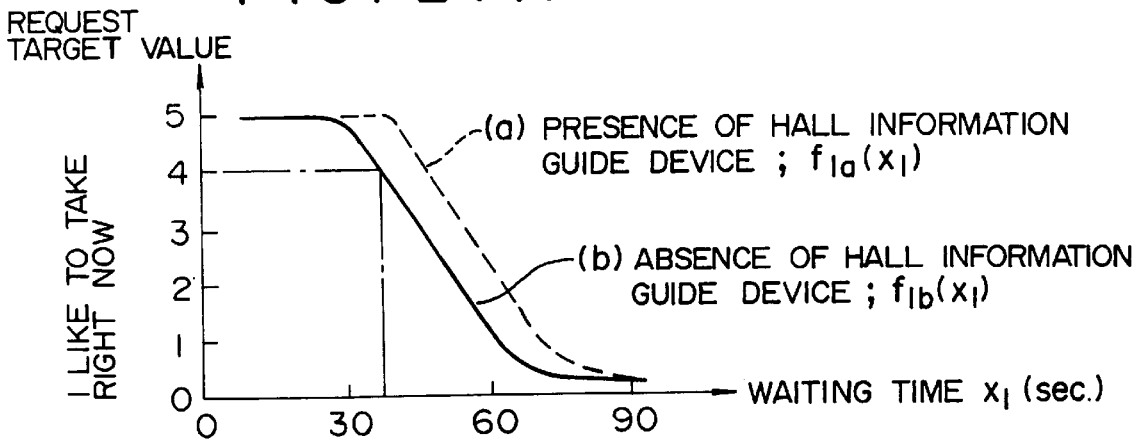
FIGS. 27A to 27C are graphs showing example of target conversion function.
Figure 27B:
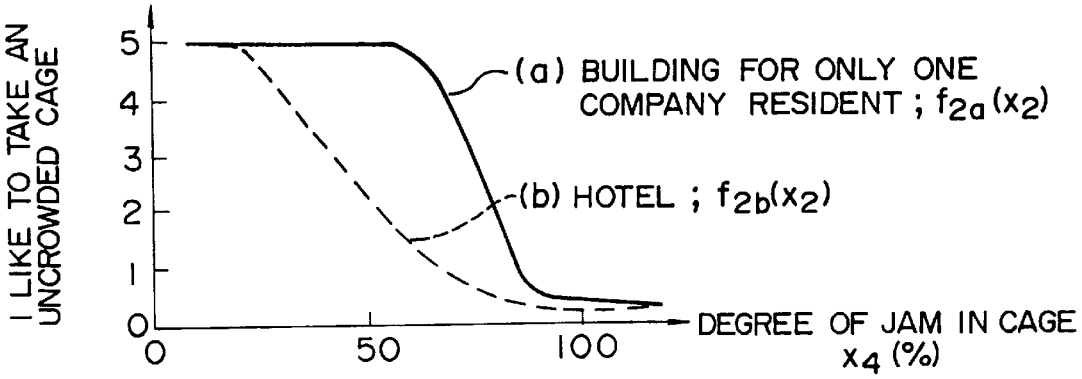
Figure 27C:
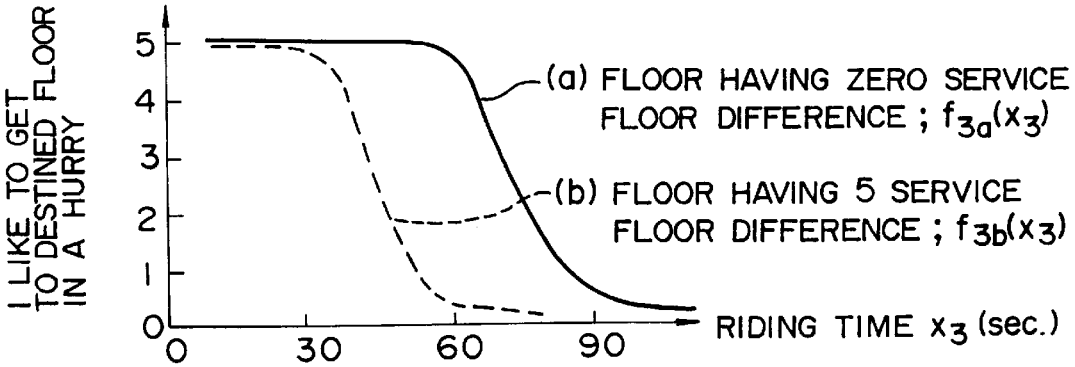

Examples of conversion function are illustrated in FIGS. 27A, 27B and 27C. These examples correspond to membership functions in fuzzy control. When taking the request target item "I like to take right now" as shown in FIG. 27A, for instance, either a function $f_{1a}(x_1)$ compatible with the presence of a hall information guide unit or a function $f_{1b}(x_1)$ compatible with the absence of the hall information guide unit is selected. More particularly, the control target conversion function generating rule selector 103*a*1 takes into account the elevator utilization environment represented by the presence or absence of the hall information guide unit and searches a rule "IF hall information guide apparatus is absent AND taking right now is requested, THEN $f_1(x)=f_{1b}(x_1)$" to select the control target conversion function $f_{1b}(x_1)$ in the absence of the hall information guide apparatus. Similarly, in connection with request target items "I like to take an uncrowded cage" and "I like to get to the destined floor in a hurry" shown in FIGS. 27B and 27C, respectively, conversion functions are selected in consideration of corresponding elevator utilization environment.

In the examples shown in FIGS. 27A to 27C, for simplicity of explanation, one type of elevator utilization environment is taken as decision item but actually a conversion function to be used is determined depending on a combination of a plurality of decision items.

The request target value can be converted into a control target value by using a conversion function as will be exemplified below.

Given that in FIG. 27A, the request target value "I like to take right now" is set to 4 during setting of target and $f_1(x)=f_{1b}(x_1)$ is selected as conversion function pursuant to the generating rule, a target value $x_1$ of the waiting time standing for the control target value can be determined to be 40 seconds through the conversion function. This determined value of 40 seconds is decided to be a permissible maximum value (limit value) of waiting time and the waiting time is recorded on the control target table 103*b* with its value determined to be less than 40 seconds. Concurrently therewith, elevatot utilization environment and a weight value necessary for attainment of this control target are obviously recorded on the control target table 103*b*. In this manner, the qualitative and indirect request target value can be converted into the quantitative and direct control target value.

Request target items correspond to control target items or parameters as exemplified in FIG. 28. The request target is described as corresponding to the control target in one-to-one relationship but actually, one request target item affects a plurality of control target items. For example, in addition to the waiting time, the rate of first arrival unresponsive to cage call (the quotient obtained by dividing the frequency of first arrival of an elevator other than elevators for which the reservation lamp is turned on by the number of all hall calls), the information guide amount and the like are greatly affected by the request item "I like to take right now".

Figure 29:
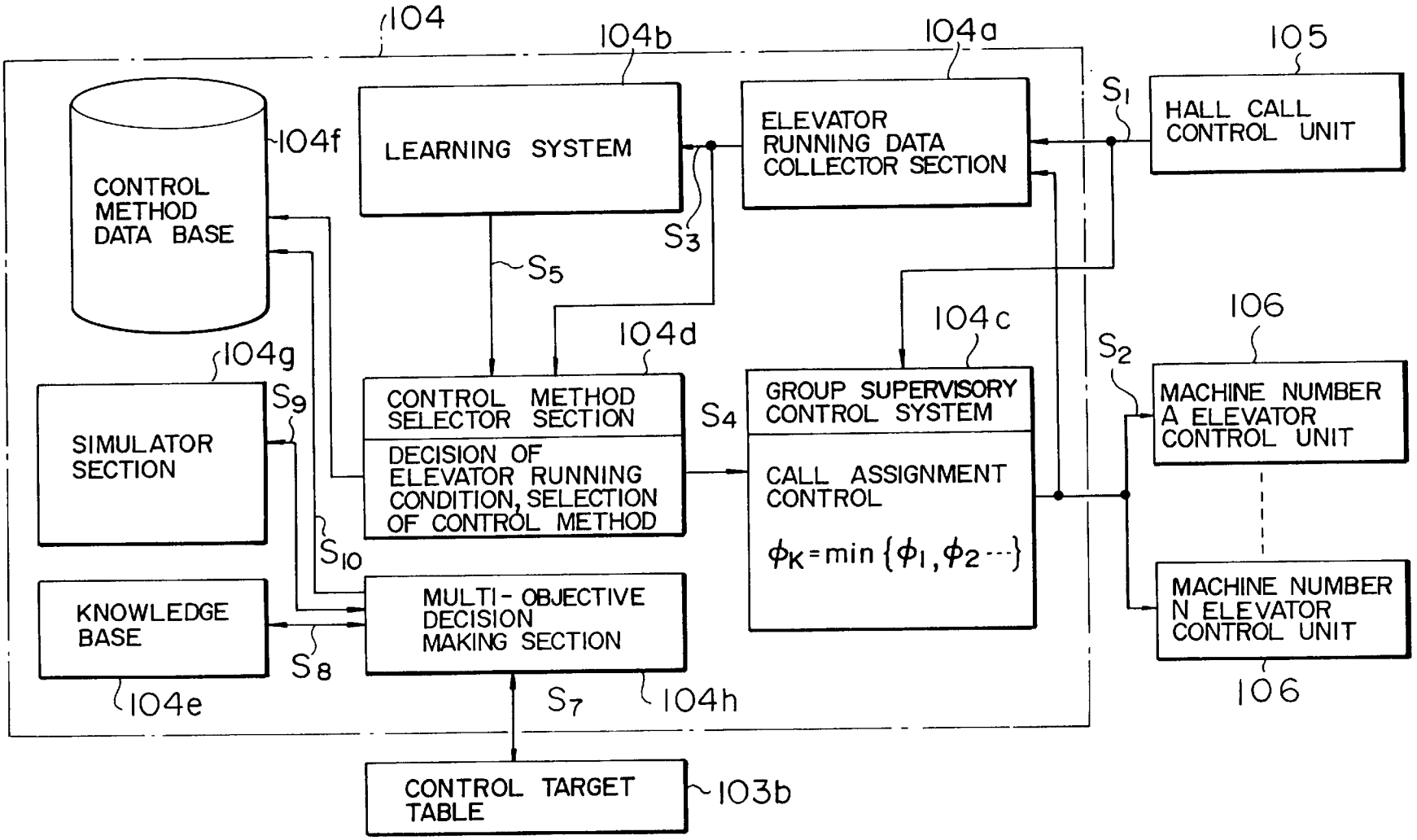
FIG. 29 is a block diagram useful to explain the operation of a control execution unit.

A plurality of control target values determined in the manner described as above are sent to the control execution unit 104 (see FIG. 21). Details of the control execution unit 104 are illustrated in FIG. 29. In the control execution unit 104, knowledge (control method selection rules) stored in a knowledge base 104*e* is used to extract a few candidates for realizable control method, such as assignment control based on minimum waiting time (Min), assignment control based on minimization of maximum waiting time (Min/Max), assignment control based on minimization of average waiting time and floating service control, on the basis of the information from the control target table 103*b*. If only one realizable control method is decided, this method is ultimately determined. The thus extracted candidates for control method are sent to an elevator simulator section 104*g* which simulates movement of elevator on software basis. The simulator section 104*g* accesses the control target table 103*b* to fetch data representative of traffic and elevator specification, carries out simulation pursuant to the selected plural control methods under the condition of the fetched data, adjusts simulation results in accordance with the control target items and determines predictive values of the control targets. The determined predictive values are sent to a multi-objective decision making section 104*h* in which the predictive values are compared with the previously determined control target values so that a control method best suited for attainment of the control target values may be selected.

The individual control methods may be checked for their superiority and inferiority as below. For example, when the whole target value is described as a vector $\hat{f}=(\hat{f}_1, \hat{f}_2, \ldots, \hat{f}_n$ having individual target values for control_goal $\hat{f}_i$, where i=1 . . . n, as components and the whole predictive value is described as a vector $f=(f_1, f_2 \ldots f_n)$ having individual predictive values for control goal $f_i$, where i=1 . . . n, as components, the control method having superiority can be obtained by selecting a control methods which can minimize the distance between target value vector $\hat{f}$ and predictive value vector f measured in terms n of weighted norm lp which is $$lp = \sum_{i=0}^{n} \omega_1 |f_i - \hat{f}_i|.$$

The thus selected control method is stored in a control method data base 104*f* in association with the elevator utilization environment information. The foregoing description has been directed to offline operation.

Online operation will be described hereinafter. In the control execution unit 104, a signal $S_2$ from the machine number elevator control unit 106 and a signal $S_1$ from the hall call control unit 105 are supplied to an elevator running data collector section 104*a*. By using the input data, the elevator running data collector section 104*a* prepares elevator utilization information data (traffic data, position and running direction of elevator, assigned hall call, the number of passengers in cage (passenger number) and so on) occurring within a short period of time which begins about 10 minutes before generation of a new call. A signal $S_3$ representative of the data prepared in this section 104*a* is sent to a learning system 104*b*. The learning system 104*b* looks up the input data to learn traffic, waiting time and other data for different time zones. By using learned information $S_5$ and the utilization information $S_3$ occurring within the short period of time and prepared by the data collector section 104*a*, a control method selector section 104*d* decides the elevator running condition. As described previously, the control method selector section 104*d* is also operable to look up the knowledge base 104*e* storing knowledge used for selecting control methods applicable to precedently inputted control target values, the simulator section 104*g* and the control method data base 104*f* storing control methods determined by the multi-objective decision making section 104*h* and then use control method selecting rules to select a control method commensurate with the actual running condition of elevator. A signal $S_4$ representative of the thus selected control method is sent to a group supervisory control system 104*c* which in turn evaluates the machine number elevators to determine a selected machine number elevator and sends a signal $S_2$ representative of a new hall call assignment command to the selected machine number elevator.

FIGS. 30A to 30C show an example of a rule table for selecting a call assignment control method. As shown, the rule table consists of three parts. A registration rule table T11 as shown in FIG. 30A is employed to indicate whether rules to be applied to running directions called or originated at each floor are registered, and rules are defined at divisions described with mark "o". For example, rule 3 is registered for up-call at the first floor and rules 1 and 3 are registered for up-call at the third floor. In this example, other calls attached with mark "o" are registered with their own rules. A rule condition table T12 as shown in FIG. 30B records conditional parts for individual rules. The condition includes designation of the elevator utilization environment information such as day, time and traffic and setting of the control target values (waiting time, loading rate, call informing time and so on). All condition items are handled as AND condition but if handled as OR condition, these condition items are registered in accordance with a different rule. Each item of condition data is described in the form of a decision conditional formula. For example, a condition that the loading weight is less than 30% is described as $$\text{WEIGHT}(K)=<\text{SEKISAI}(K)*\ 0.3 \quad (1)$$

where WEIGHT(K): the number of passengers in machine number K elevator

SEKISAI(K): rated capacity of machine number K elevator.

A rule execution table T13 as shown in FIG. 30C records execution parts showing execution formula under rule condition, and contains evaluation formula or assigned machine number. For example, an evaluation formula that an elevator expected to be of the first arrival should be selected from elevators of 30% or less rated capacity is described as $$\left.\begin{array}{l}\omega = \mathrm{WEIGHT}(K) - SEKISAI(K) * 0.3 \\ \mathrm{IF}\ \omega \leqq 0\ \mathrm{THEN\ VALUE}(K) = \mathrm{WAIT} \\ \mathrm{ELSE\ VALUE}(K) = \mathrm{MAX}\end{array}\right\} \quad (2)$$

$$\mathrm{ASIGN} = K\ \mathrm{FOR\ MIN}[\mathrm{VALUE}(K)] \quad (3)$$

where VALUE(K): array of evaluation values

K: variable corresponding to machine number

ASIGN: assigned machine number

MAX: maximum value.

Actually, data recorded on each table and the above formulas are converted into binary data which is executable by the microcomputer. In each table, blank divisions signify the absence of any condition.

Figure 31:
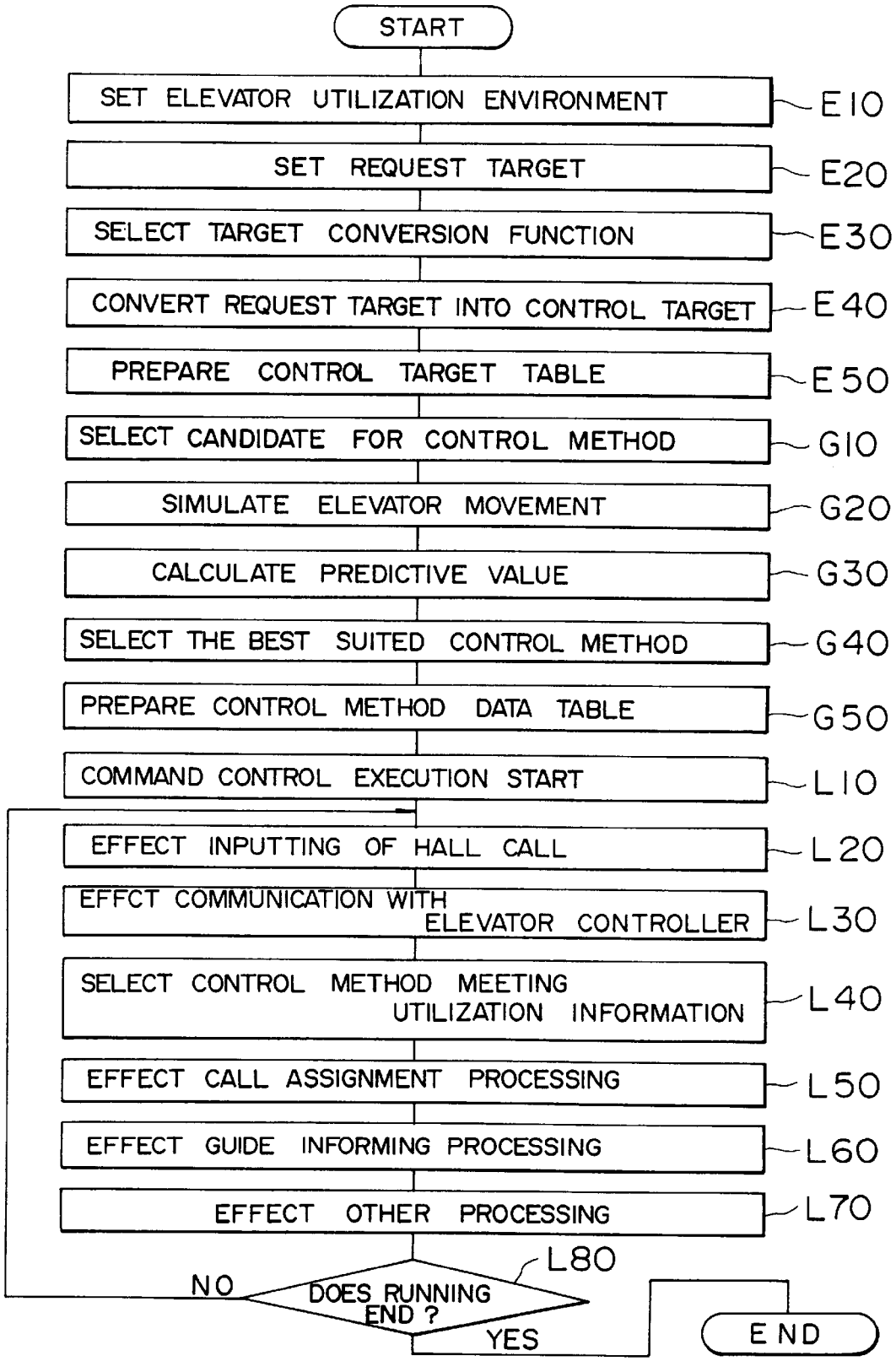
FIG. 31 is a flow chart showing the operation of the FIG. 21 embodiment.
Figure 32:
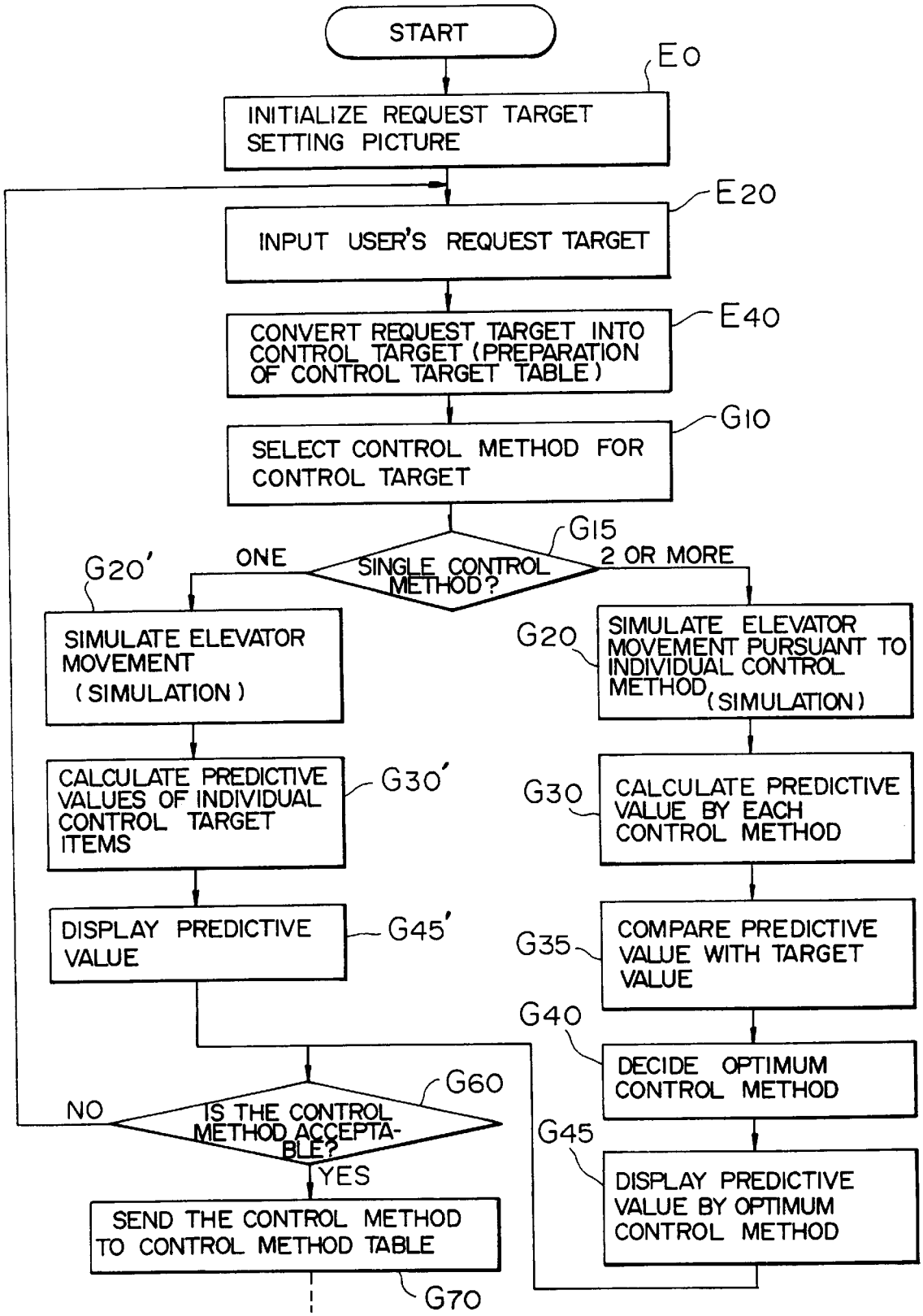
FIG. 32 is a flow chart showing steps in the FIG. 31 flow chart which are visually accessible.

The operation explained so far can be described in terms of a flow chart as shown in FIG. 31. Firstly, data representative of elevator utilization environment is set (step E10). Subsequently, a request target item corresponding to the data in the step E10 is selected and its target value is set (step E20). The control target conversion function generating rule selector is activated under the condition of the set elevator utilization environment and request target to determine a conversion function (step E30). But if the request target is related to a control target value in one-to-one relationship, the generating rule selector 103*a*1 determines the control target value. Subsequently, the request target value is converted into a control target value by using the conversion function selected in the step E30 (step E40). The resulting control target value is recorded on the control target table (step E50). The following steps are carried out by means of the control execution unit 104. Values on the control target table and expert knowledge set in advance are used to select candidates for control method (step G10). Selected plural control methods are sent to the simulator section 104*g* and simulated under the set condition by using a system which simulates movement of elevator on software basis (step G20). Simulation results are used to calculate a predictive value of the control parameter (step G30). Predictive values obtained by individual control methods are compared with the input target value through multi-objective decision making process to select a control method which is best suited for attainment of the control goal (step G40). The thus selected control method may be presented to the user and if unacceptable, the request target setting steps E20 to G30 may be repeated to select a different control method which is best suited for attainment of control goal. The ultimately selected control method is stored, along with the elevator utilization information, in the control method data table or decision table 641 (step G50). As viewed from elevator control, the steps E10 to E50 and G10 to G50 can be executed on offline basis.

Thereafter, elevator running control is started by an elevator control execution start command (step L10). A hall call signal processing is first executed to input a hall call (step L20). Communications are effected for exchange of various kinds of data from the machine number elevator control unit (step L30). Utilization environment information is determined on the basis of the above data and a control method to be used is selected from the control method data base 104*f* by using the thus determined utilization environment information (step L40). Subsequently, an optimum call assigned cage is determined through the selected control method and a call assignment processing is executed (step L50). On the basis of hall call assignment information and predictive time for elevator arrival, the contents of the guide indicator at the hall is determined and informed (step L60). In addition to the above processings, delivery and display of various kinds of data are executed (step L70). Thereafter, it is decided whether the execution of running should continue after termination of the above procedure sequence (step L80). If continuation is determined, the procedure returns to the step L20 but if termination is determined, the procedure ends. of steps in the flow chart of FIG. 31, steps appearing in a schematic flow chart shown in FIG. 32 can be accessed visually by the user. Firstly, when the user turns on the switch, a picture indicative of the initially set request target (for example, FIG. 23 or FIG. 24) is displayed on the screen (step E0). Subsequently, the user can change the initially set picture by inputting new target values by means of, for example, the mouse (step E20). When inputting of all new target values is terminated (a change completion signal is issued), the request target is converted into a control target through the medium of a conversion function (step E40). Subsequently, a candidate or candidates for control method which are expected to be best suited for attainment of the control target are selected using the control target table and knowledge base (step G10). Since there is a possibility that a single control method candidate is selected or a plurality of control method candidates are selected, the number of control method candidates is decided as to whether to be singular or plural (step G15). If a single control method is determined, this control method is sent directly to the simulator section 104*g* (step G20'). The simulator section 104*g* carries out simulation by using the traffic and the like data set concurrently with inputting of the request target. Simulation results are used to determine a predictive value of the previously set control target (step G30'). The thus determined predictive value is inverted into a request target which is displayed together with the original request target previously set by the user (step G45').

Contrarily, when a plurality of control methods are selected, simulation is conducted for individual control methods (step G20) and on the basis of simulation results, predictive values of the control target are calculated in respect of the individual control methods (step G30). Subsequently, each of the calculated predictive values is compared with the target value to calculate an overall degree of attainment of control goal in respect of the individual control methods (step G35). The thus calculated degrees of attainment by the individual control methods are compared with each other to determine an optimum control method which has the maximum degree of attainment (or the minimum degree of attainment) (step G40). A predictive value by the thus selected control method is inverted into a request target value which is displayed together with the original request target previously set by the user (step G45), thus enabling the user to decide on the basis of a display on the screen whether the control method determined by the system is acceptable (step G60). If acceptable, the control method is sent to the control method table (step G70). If unacceptable, the procedure returns to the step E20.

The offline operation steps ranging from inputting of a request target to recording of a control method on the decision table 641 will now be described by referring to a specific example.

It is assumed that the building specification in elevator utilization environment designates a hotel, the elevator specification (the number of installed elevators, speed, the number of service floors and the like parameter) is set as shown in FIG. 33 and the elevator utilization environment information is set to designate normal traffic at the reference floor (floor having the front desk) and check-in time zone Istep E10 in FIG. 31).

Figure 34:
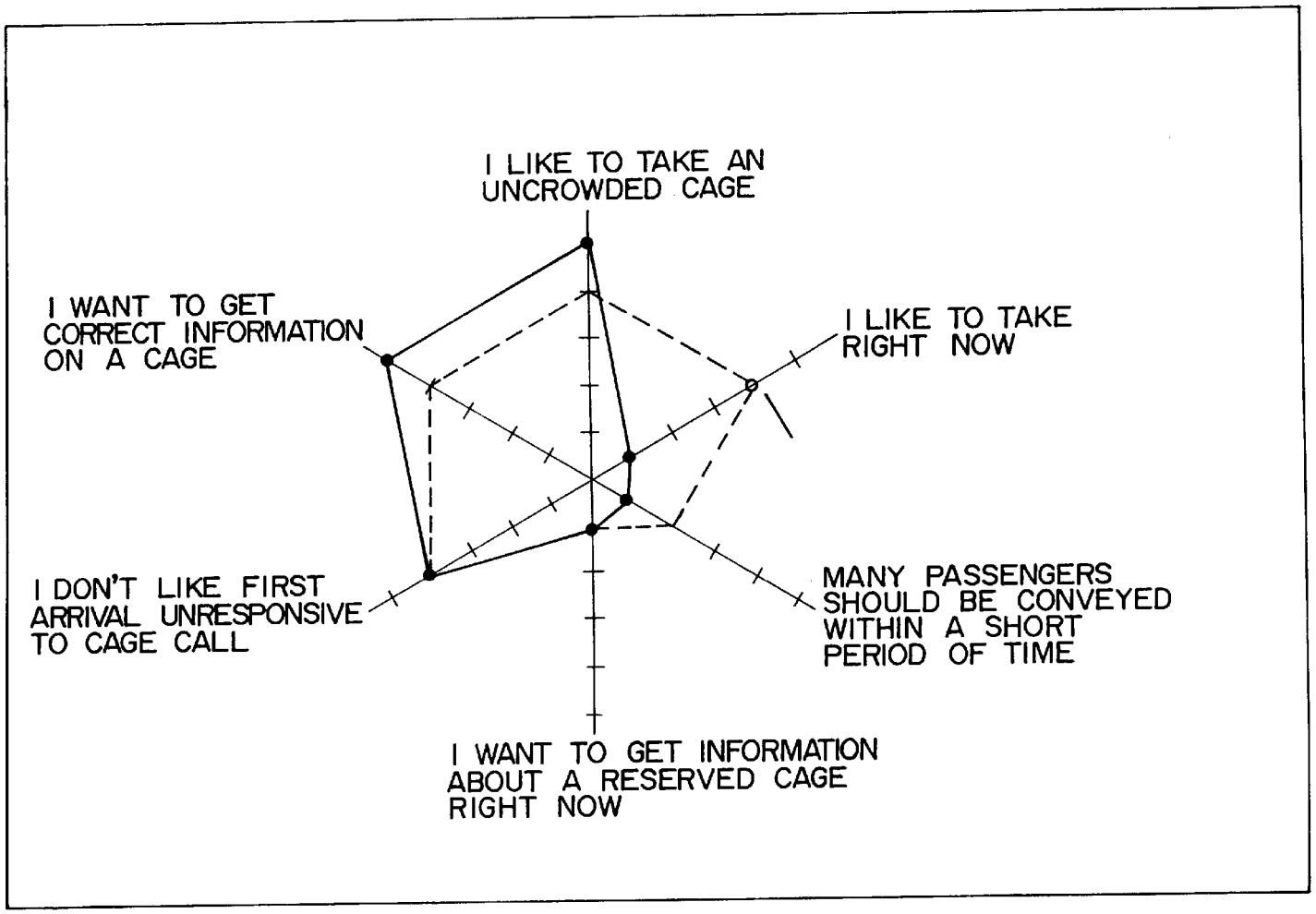
FIG. 34 is a diagram showing an example of change of request target setting.
Figure 35:
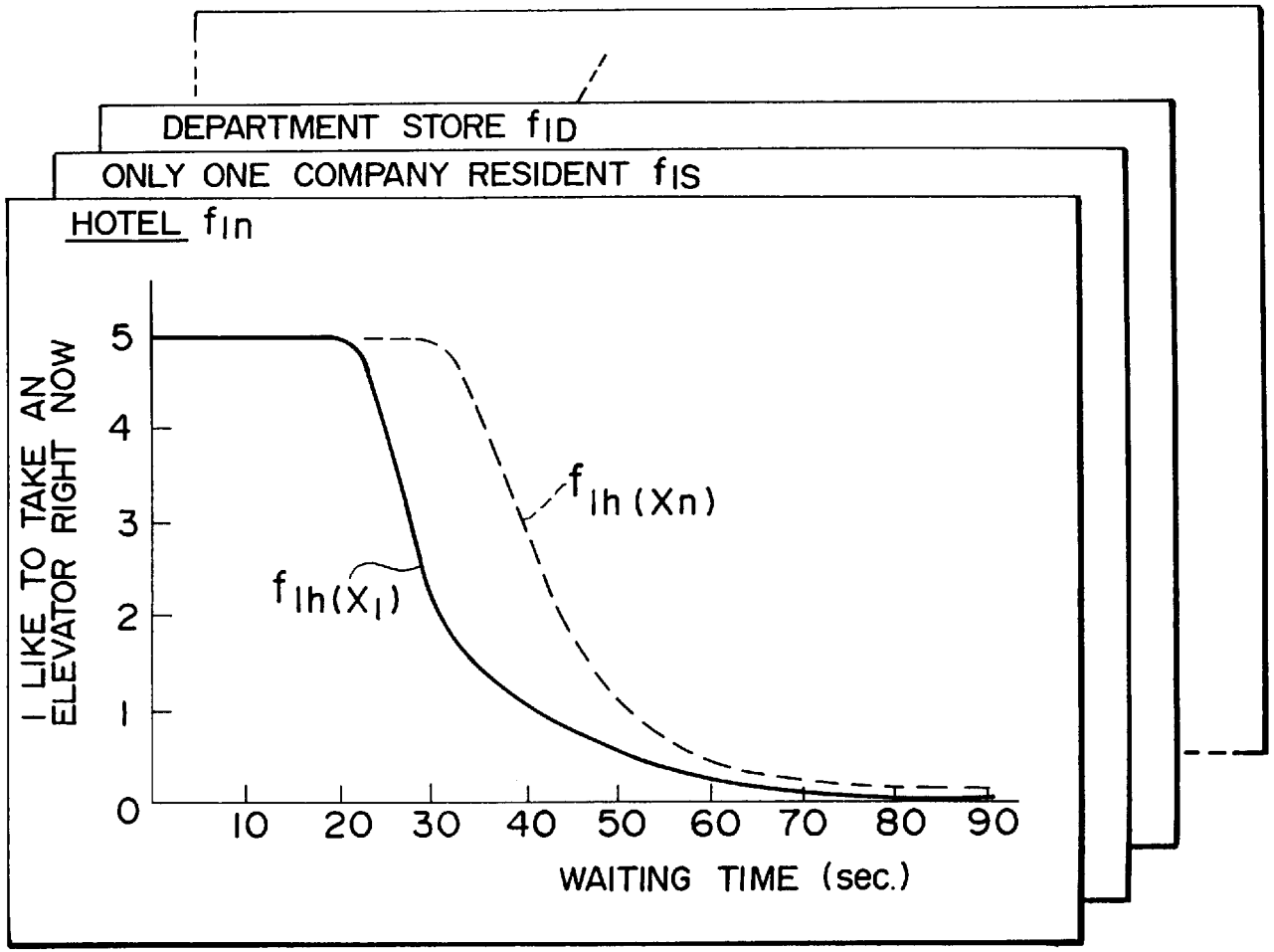
FIG. 35 is a diagram showing an example of target conversion function.

Under this condition, it is further assumed that the system precedently sets by itself initial values of 6 request target items as shown as solid line in FIG. 34. Needless to say, the user may otherwise set initial values directly. Then, the user changes the initial value "1" of a request target "I like to take right now" described in the chart of FIG. 34 to a value of "4" (step E20 in FIG. 31). Concurrently with this change of setting, the priority ranking for attainment of individual request target items is also inputted. If the inputted priority ranking is the same as the initially set priority ranking and the priority ranking for the item subject to change of setting is low, the realizable control method remains unchanged and therefore the user is urged to change the priority ranking. In this example, when the initially set value is changed to a new larger target value, the priority ranking for the item subject to change of setting is brought to the top and when changed to a new smaller target value, the priority ranking for this item is brought to the sixth rank (the last).

Thereafter, in order to convert the request target value "I like to take right now" into a control target value, the control target conversion function generating rule selector 103*a*1 is activated. An example of rule (for hotel) is as follows:

1) A rule group for item "I like to take right now"

Rule 1

IF hotel AND check-in time

THEN $f_1(x) = f_{1h}(x_1)$

Rule 2

IF hotel AND lunch time

THEN $f_1(x) = f_{1h}(x_2)$

. . . . . .

A target conversion function commensurate with the conditional part of the rules is selected (step E30 in FIG. 31). The thus selected target conversion function (assumed to be $f_{1h}(x_1)$ herein) is sent to the target conversion unit 103 (FIG. 21) and a control target value is deterimined pursuant to this target conversion function. Specifically, because of the initially set request target value being "1", the waiting time has been set to less than 40 seconds but the request target value is now changed to "4" and as a result the target value is newly set to less than 25 seconds (step E40 in FIG. 31). This target value changes the previously set value on the control target table (step E50 in FIG. 31). At that time, the weight described on the control target table is changed concurrently. Control target values and associated weights before change of setting and those after setting are shown in FIG. 36.

Candidates for control method which meet the control targets are selected using the knowledge base precedently set with expert knowledge (step G10 in FIG. 31). An example of selection rule group is as follows:

Rule 1

IF time zone = $T_1$ AND traffic ≧ a AND front floor

-continued

THEN $\phi = T_1$

Rule 2

IF time zone = $T_1$ AND traffic ≧ a AND general floor

THEN $\phi = T_2$

. . . . . .

In the above rules, $T_1$ represents check-in time zone, a represents traffic in terms of passengers/cage·5 min and $T_1$ and $T_2$ represent different types of call assignment methods. The call assignment method $T_1$ signifies the assignment method based on minimum waiting time (Min) pursuant to the following equation (5) and its evaluation value is defined by the following equation (4):

$$\phi_K = T_K - \alpha \cdot T_{AK} + \alpha' \cdot T_{BK} \tag{4}$$

$$T_1 = \min(\phi_1, \ldots \phi_K)$$

where $\phi K$: hall waiting time evaluation value for machine number K elevator, $T_K$: time required for machine number K elevator to reach a floor from which a new assignment hall call originates, $T_{AK}$: stop call evaluation value for machine number K elevator in consideration of assigned hall call and cage call, $T_{BK}$: load concentration evaluation value in accordance with the condition of elevator, and $\alpha$, $\alpha'$: weight coefficient.

Similarly, $T_2$ represents the assignment method based on minimization of maximum waiting time (Min/Max) which is pursuant to equations (7) and (8) as below and its evaluation value is defined by the following equation (6):

$$\phi_{Ki} = T_{Ki} + T_{Pi} - \alpha \cdot T_{AKi} + \alpha' T_{BKi} \tag{6}$$

where $\phi_{Ki}$: i-th hall call evaluation value assigned to machine number K elevator, $T_{Ki}$: time required at the moment for machine number K elevator to reach i-th floor, $T_{pi}$: time lapse following generation of i-th floor hall call, $T_{AKi}$: stop call evaluation value for machine number K elevator, $T_{BKi}$: load concentration evaluation value in accordance with the condition of elevator, and $\alpha$, $\alpha'$: weight coefficient.

Equations (7) and (8) are $$\phi_K = \max(\phi_{K1}, \ldots \phi_{Ki} \tag{7}$$

$$T_2 = \min(\phi_1, \phi_2, \ldots \phi_k \tag{8}$$

Thus, in this assignment method, evaluation values of individual hall calls assigned to respective elevators are determined (equation (6)), the maximum of the hall call evaluation values is selected (equation (7)), and a call is assigned to an elevator having the minimum hall waiting call evaluation value.

In addition to the above assignment methods, other formulated assignment evaluation methods such as assignment evaluation method based on average waiting time, assignment evaluation method based on waiting time distribution, cage assignment evaluation method based on equi-interval of time and a combination of these methods can be selected using rules stored in the knowledge base.

The control method selection rule selector 103*a*1 is also operable to perform selection of one of various types of running specifications, in addition to the selection of call assignment method. In the above example directed to hotel, the selector 103*a*1 also commands a lobby control method by which elevators not being in charge of any call are returned to the reference floor. In this case, the introduced control method is expected to respond to a request target value inputted by the user to realize two evaluation methods based on minimum waiting time and average waiting time. In initialization by the system by itself, the target value is initially set through the call assignment method based on minimization of maximum waiting time by which occurrence of a longtime waiting can be suppressed. However, because the assignment method based on minimum waiting time and assignment method based on average waiting time are now selected as candidates, the selected two types of assignment evaluation methods and the running specification are sent to the simulator section which in turn carries out simulation (step G20 in FIG. 31). As a result of simulation, predictive values of the control targets as shown in FIG. 37 are obtained (step G30 in FIG. 31). Thus, in order to evaluate the degree of attainment of control goal, norm $$lp = \sum_{i=0}^{n} \omega_i |f_i - \hat{f}_i|$$

according to the previously-described multi-objective decision making method is: determined for each of the assignment methods. The norm lp is treated under the condition that the item in which the set control target is satisfied with the predictive value is evaluated to be zero, and the items in which set control target is not satisfied with the predictive value are multiplied by weight coefficients and the products are added together to provide the sum the magnitude of which is used to evaluate the degree of attainment of control goal. More specifically, in norm $$lp = \sum_{i=0}^{n} \omega_1 |f_i - \hat{f}_i|,$$

the initially set weight values are used as weight coefficients $w_i$ and the degree of attainment of control goal is evaluated for each of the control methods shown in FIG. 37 which are selected through the previous simulation. For the minimum waiting time method, norm $lp_1$ is given by $$lp_1 = 8(40-30)+7(5-3)+6(3-3)+9(25-25)+5(-35+30)+4(0.1-1).$$

In the above equation, the first term is the loading weight, the second term is the reservation change rate, the third term is the first arrival rate unresponsive to cage call, the fourth term is the waiting time at the hall, the fifth term is the transport capability and the sixth term is the reservation informing time. The target value of transport capability in the fifth term is 30 passengers/min or more and better results can be obtained in proportion to excess of the predictive value over the target value. On the other hand, in connection with the remaining terms, better results can be obtained in proportion to deficiency of the predictive value from the target value. Accordingly, the signs of addition for the former and latter terms are mutually inverted. Under the aforementioned condition, the above equation is reduced to $$lp_1 = 8\times10+7\times2+6\times0+9\times0+5\times0+4\times0=94.$$

Norm $lP_2$ is then calculated for the average waiting time method in a similar way and there results $lP_2=147$. For simplicity of explanation, the negative term is zeroed herein but in an actual evaluation method, the weight coefficient $\omega_i$ associated with each evaluation item may be considered as smoothing coefficient for each control item and the value of the item suited for attainment of control goal, which is zeroed in this example, may be added to the evaluation value.

Since the norm is smaller for the call assignment method based on minimum waiting time than for the assignment method based on average waiting time, the minimum waiting time method is selected. The control target value according to the thus selected control method is inverted into a request target value which is displayed, along with the originally set request target value, in the form of a radar chart (dashed line in FIG. 34). If the user accepts the method, this selected control method is registered and recorded on the control method data table.

The steps E10 to G50 have been described by referring to the specified example, with all of the steps carried out in the group supervisory controller.

Figure 38:
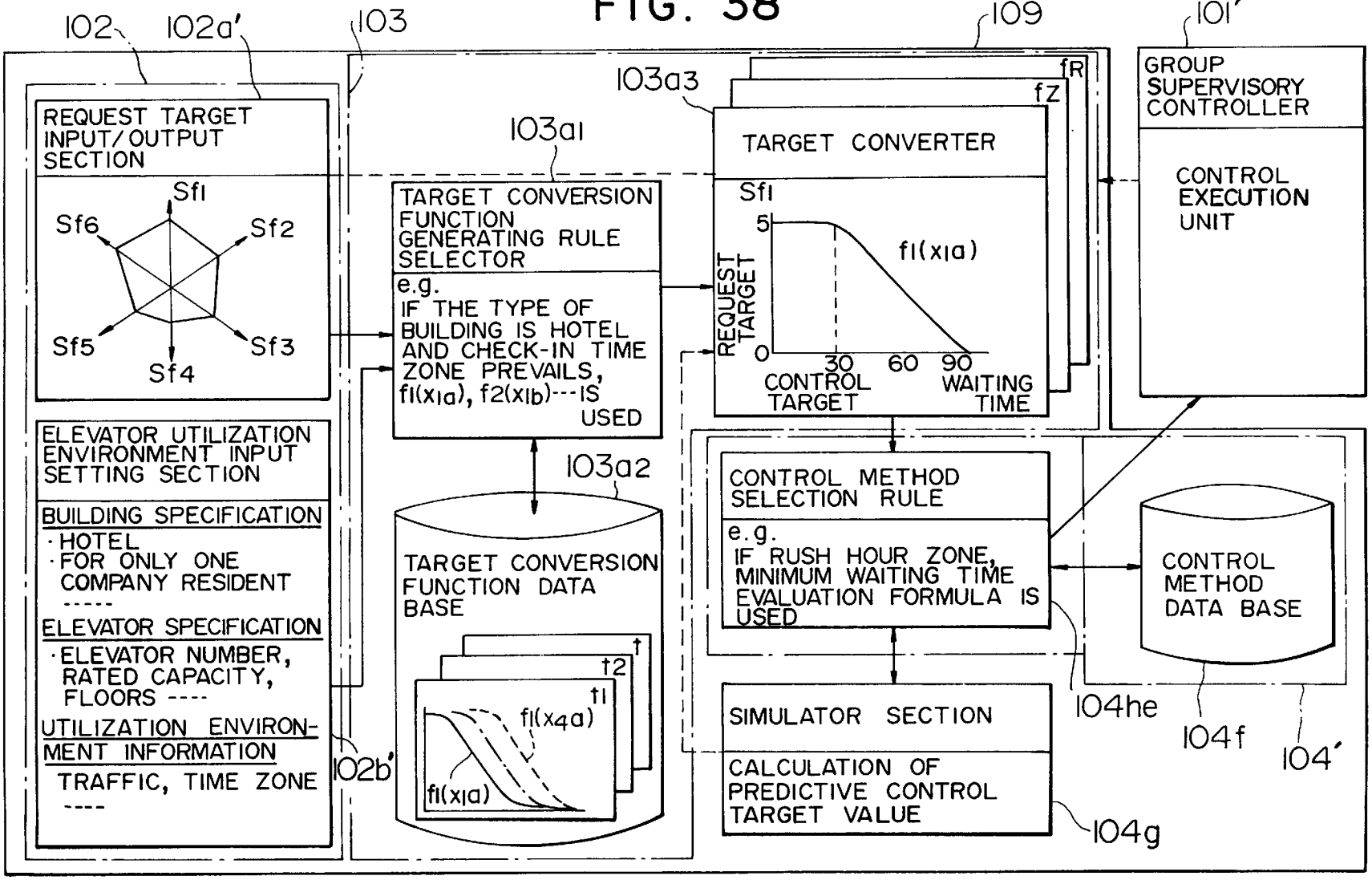
FIG. 38 is a schematic diagram illustrating the overall construction of a modification of the FIG. 21 embodiment.

FIG. 38 illustrates a modification of the FIG. 21 embodiment. In accordance with this modification, an elevator control system comprises a request target setting support 109 and a grop supervisory controller 101'. As compared to the control execution unit 104 in the FIG. 21 embodiment, a control execution unit of the group supervisory controller 101' is removed of the multi-objective decision making section 104*h*, simulator section 104*g* and knowledge base 104*e*. In other words, the control execution unit in this modification is constructed by removing from the control execution unit 104 the sections 104*g*, 104*h* and 104*e* which are offine operation components.

The request target setting support 109 includes a request target setting unit 102 comprised of a request target input/output section 102*a*' and an elevator utilization environment input setting section 102*b*', a target conversion unit 103 comprised of a control target conversion function generating rule selector 103*a*1, a conversion function data base 103*a*2 and a taget converter 103*a*3, a control method selecting rule 104*he* having in combination the multi-objective decision making section and knowledge base included in the control execution unit 104 of FIG. 29, a simulator section 104*g* and a control method data base 104*f*. The request target setting support 109 is operable to decide a control method which meets a plurality of input request targets and record the determined control method on a control method data base included in the group supervisory controller. With this construction, a request of the user can be inputted in the form of a familiar request target independently of the group supervisory controller per se and can be converted into a control value, thereby ensuring that, for example, the request target setting support 109 can be realized in the form of a handy type personal computer (such as lap-top type personal computer) or a terminal unit and the user can use this support at a location remote from a building in which the elevator is installed, for example, at a service dopot to have a conference about control of elevator running.

Other embodiments of the elevator control system according to the invention will be described with reference to FIG. 39 and ensuring figures. In particular, an embodiment of FIG. 39 substantially resembles the FIG. 38 modified embodiment comprising the request target setting support 109 and group supervisory controller 101' but features employment of an analytic hierarchy process (AHP), to be described later, for mutual adjustment of request targets (control targets).

Figure 39:
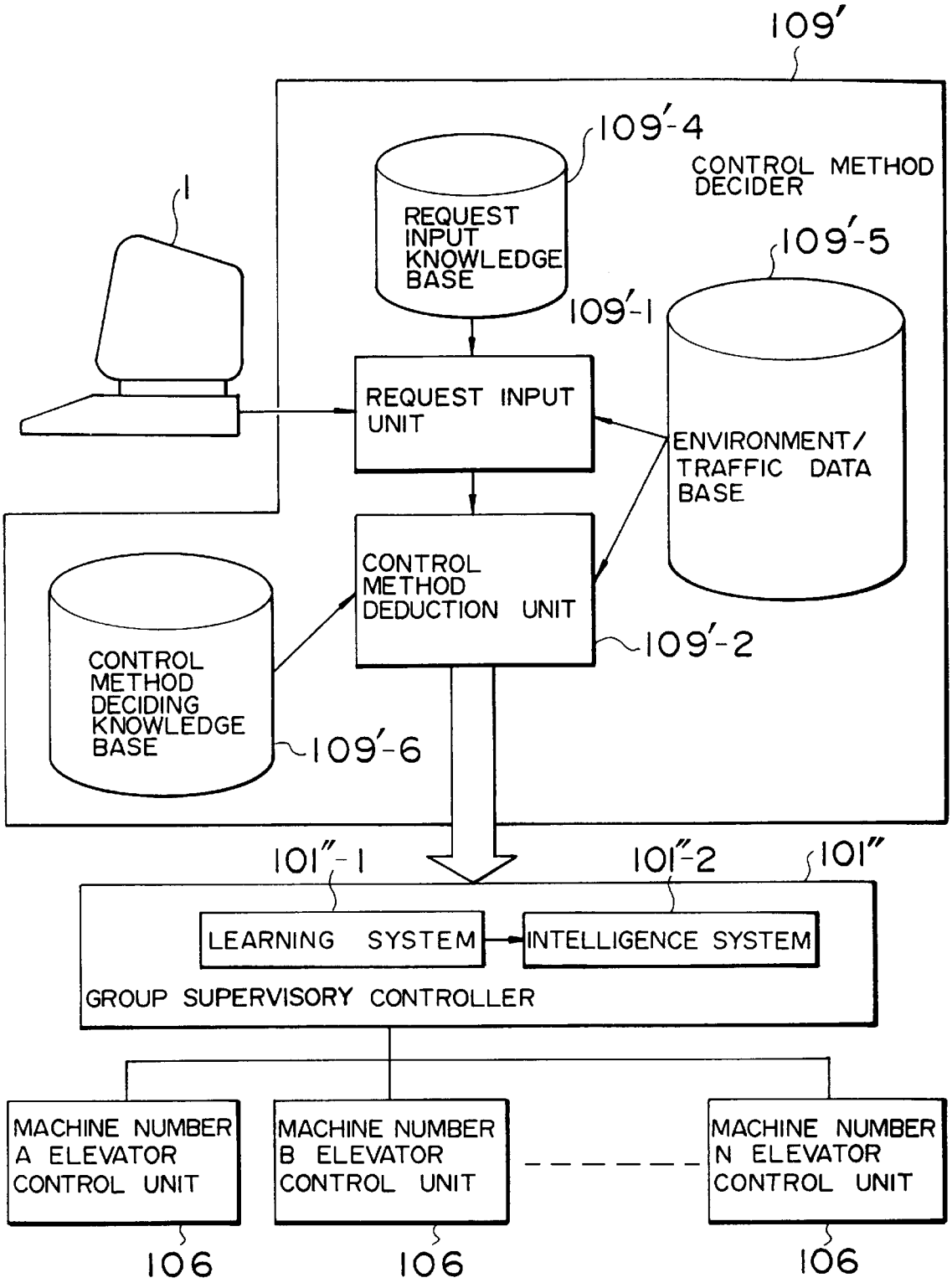
FIG. 39 is a schematic block diagram illustrating the overall construction of still another embodiment of the elevator control system according to the invention.

Referring to FIG. 39 illustrating the overall construction of this embodiment, the elevator control system comprises a control method decider 109' which substantially resembles the request target setting support 109 of the FIG. 38 modification. Thus, the decider 109' includes a request input unit 109'-1 for receiving a request target value of the user and elevator utilization environment such as elevator running condition necessary for attainment of the request target value through an input terminal I (corresponding to the input terminal 102-1 in FIG. 21) and converting the request target value into a control target value (and a weight or a priority rank) by using a request input knowledge base 109'-4 and an environment/traffic data base 109'-5, and a control method deduction unit 109'-2 which selects and determines a control method through deduction process by using the environment/traffic data base 109'-5 and a control method deciding knowledge base 109'-6. A group supervisory controller 101" has a data table for storing the control method determined by the control method decider 109', which data table is usually called a decision table (see block 3*b* in FIG. 2 and an illustration of FIG. 48) and it responds to signals from machine number elevator control units 106 and hall call signals to decide the elevator running condition, select a control method from the data table and execute the selected control method. For example, the group supervisory controller 101" includes a learning system 101"-1 adapted to collect utilization condition data such as waiting time and passenger number to decide a characteristic mode, and an intelligence system 101"-2 adapted to generate a new characteristic mode to prepare a new running program (see JP-A-59-48369).

Figure 40:
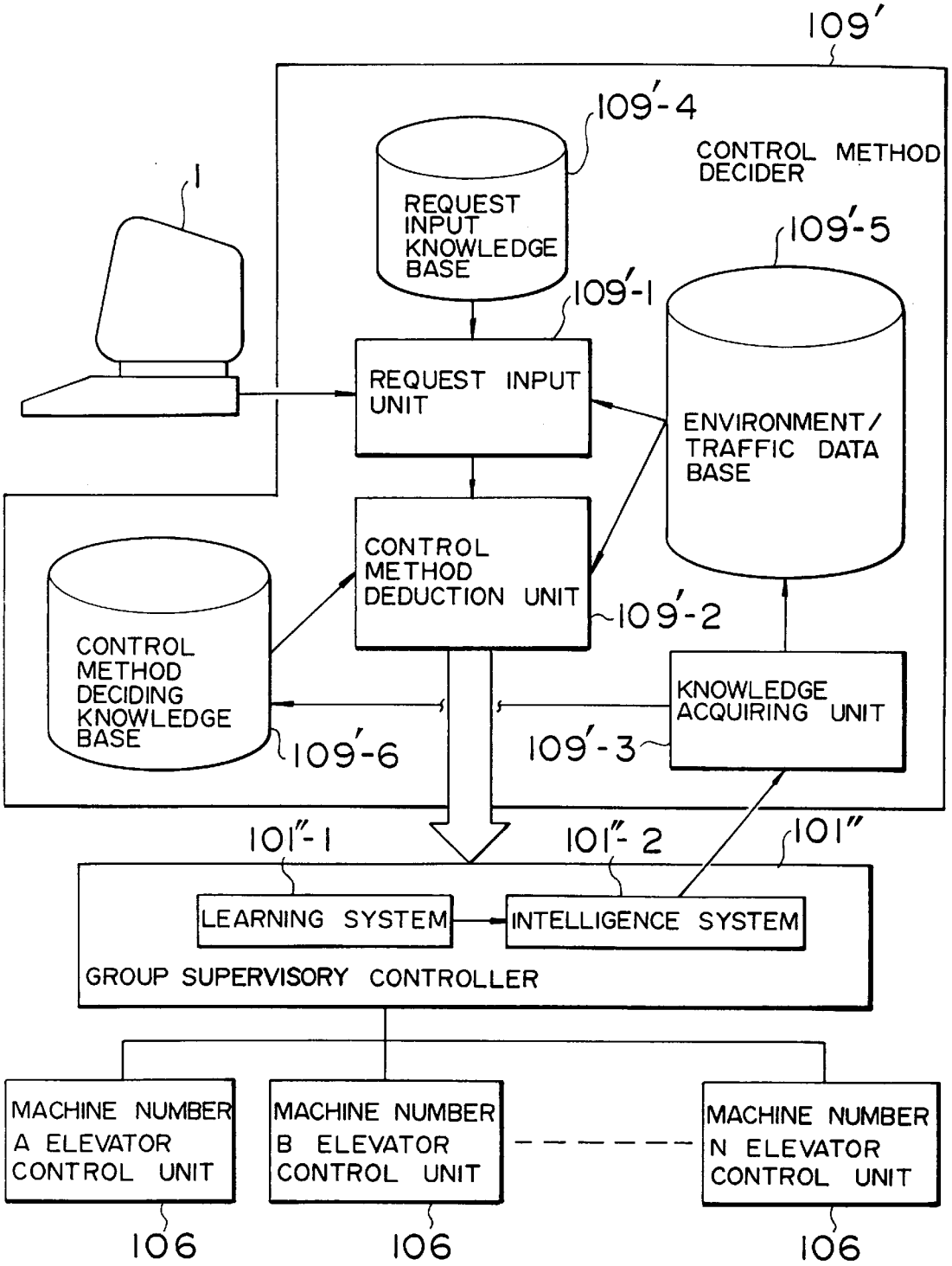
FIG. 40 is a schematic block diagram illustrating the overall construction of a modification of the FIG. 39 embodiment.

FIG. 40 illustrates a modification of the FIG. 39 embodiment wherein a knowledge acquiring unit 109'-3 is additionally provided in the control method decider 109'.

Results of execution of control targets and associated conditions are collected by the learning system 101"-1 of the group supervisory controller 101" and sent to the control method decider 109', whereby when the degree of attainment of control goal is low, improvements in the contents of the control method deciding knowledge base can be requested and when the set environment/traffic data greatly differs from the actual condition, the knowledge acquiring unit 109'-3 can ask for permission of registration of new data, thereby making it possible to improve accuracy of control method selection and decision by the control method decider 109'.

The oepration of the control method decider 109' will now be described specifically.

Figure 41:
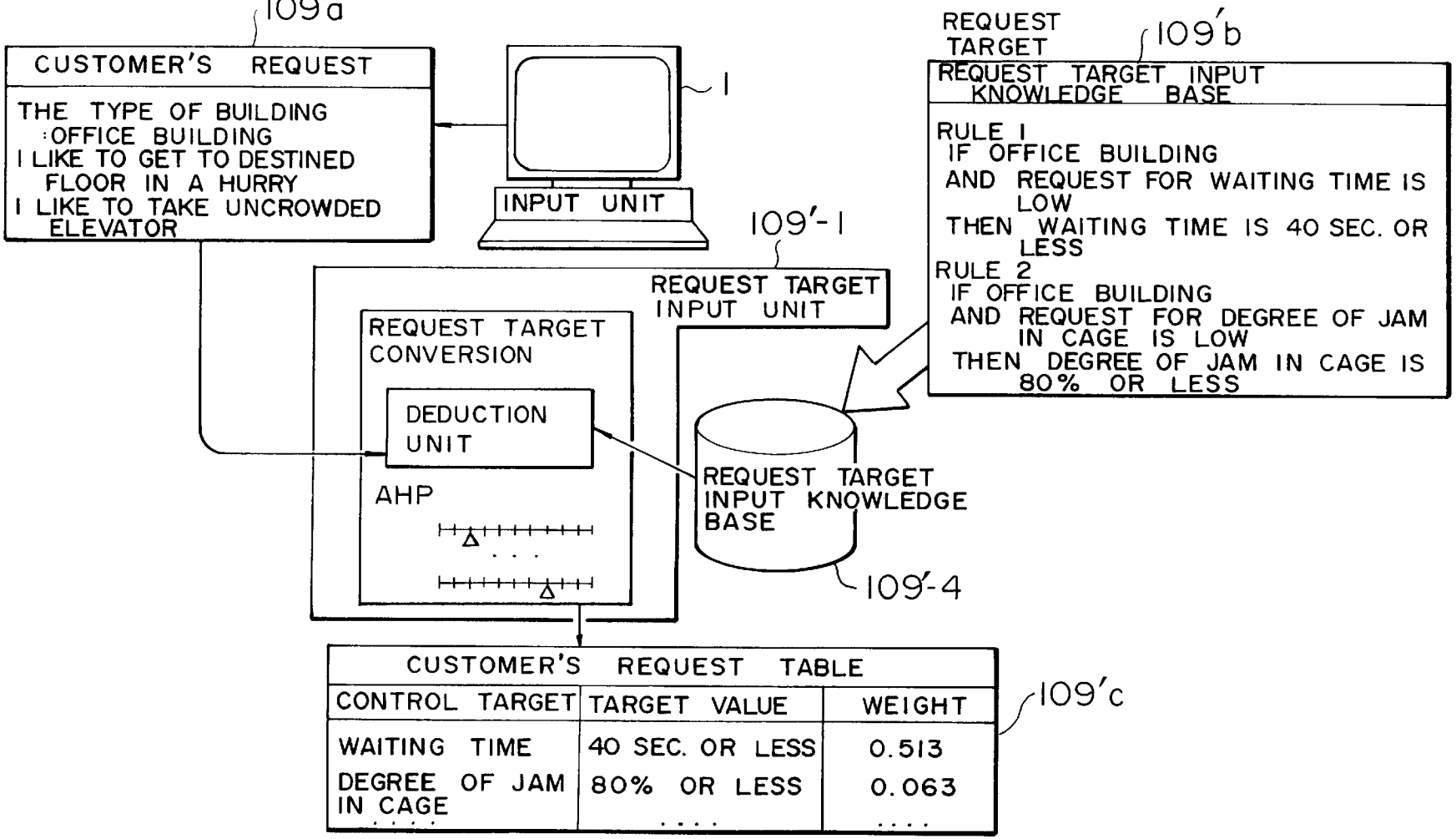
FIG. 41 is a diagram useful to explain the operation of a request input unit in the embodiments of FIGS. 39 and 40.

FIG. 41 is illustrative of the operation of the request input unit 109'-1 and request input knowledge base 109'-4.

The user (customer) first selects the type of building (for example, office building, hotel, department store, hospital, government and public office, building for plural residents or the like) through the input terminal I such as personal computer or touch panel with display. In FIG. 41, the operation will be described on the assumption that an office building is selected. Subsequently, a typical elevator specification based on this type of building as shown in FIG. 42 is presented. If change of the specification is desired, correction can be inputted using the keyboard or mouse through the input terminal I. After completion of correction, environment/traffic is inputted as necessary. Thereafter, the user inputs a request in the conversational (guidance) fashion. An example of request input items as shown in FIG. 43 is available. Specifically, there is prepared an answer at five grades "1) very strongly, 2) strongly, 3) moderately, 4) slightly, 5) don't care" to each of the request target items including an item "Q.1 Do you like to take an elevator right now?". If an answer at grade 4) corresponding to a request target value is selected, deduction is carried out using the request input knowledge base 109'-4 (and 109*b*') of the control method decider 109' to select rule 1 and pursuant to this rule 1, the request target value is converted into a specified control target value for control goal to the effect that the waiting time should be 40 seconds or less. It is to be noted that in this example, the request target item corresponds to the control target item in one-to-one relationship.

The request target can be inputted in various manners other than the above, for example, by using the radar chart described in connection with the foregoing emboidments. This exemplary method may be carried out by presenting a standard pattern of request target items or values in accoreance with, for example, set building type, specification and utilization environment and setting (or modifying) the degree of desire of the user on the basis of the pattern and may be utilized effectively by the user who is not well acquainted and familiar with elevator control. To consult an example of radar chart used for the office building for only one company resident, reference should be made to FIG. 24. Due to the fact that desires can not be optimized for all of the request input items, the control target value can conceivably be determined by way of (1) an expedient of informing the user of the range within which the target value is changeable in connection with an item in question (for example, "The waiting time is settable within a range of from 30 to 40 seconds" may be displayed, or the range may be displayed in the form of a colored zone) or (2) an expedient of supplying a total par (for example, 20 points) to the user and allowing the user to distribute the total par to individual items proportionally. Of course, if the user is familiar with setting operation, this user will be allowed to directly set input items and target values in accordance with his request.

Incidentally, as described previously, the request target is the expression of language used for the machine in language understandable by ordinary persons, and its value is equivalent to an analog or digital quantity representative of a targer value (control target value), normalized and indicated at, for example, 5 grades, of control data by which control condition of elevator can be observed (waiting time at the hall, riding time, reservation change rate, rate of nonstop of full-up cage, passenger number, conveyed passenger number and so on). In some applications, one request target may include two or more control targets.

Deduction is then carried to determine a control target value by using the request input knowledge base 109'-4 (109*b*') of FIG. 41 in consideration of the inputted request target value and the environment/ traffic under which the request has to be attained. Pursuant to the production rule shown in the request input knowledge base 109'-4 (109*b*'), conversion to control target value can be achieved without resort to the conversion function and conversion table (FIGS. 27A to 27C) explained in connection with the foregoing embodiment but uncertain parameters (including climate) must be converted into control target values by using dedicated conversion functions and conversion tables as in the case of the foregoing embodiments.

The qualitative request target can be converted into the quantitative control target in this manner, but the request target item does not always correspond to the control target item in one-to-one relationship and actually the request target item frequently affects a plurality of control target items. For example, when the request target item "I like to get to in a hurry" is inputted, there are involved various requests including a request that the waiting time be reduced, a request that the riding time be reduced and a request that a longtime waiting be avoided (reduction in the rate of occurrence of longtime waiting). Therefore, it is necessary to distribute the request target item to a plurality of control target items and determine corresponding control target values. As an example, the degree of correlation of control items to each other may precedently be determined for the request of the user through, for example, simulation in accordance with elevator utilization environment/traffic to prepare a correlation table (stored in, for example, the request input knowledge base 109'-4) as shown in FIG. 44 and pursuant to the correlation table, the request may be distributed. For example, given that the request "I like to get to in a hurry" is inputted with "4" of normalized numerical values 0 to 5 and at that time the utilization environment is designated by ① of co-relation numerical values 0 to 5 in the correlation table of FIG. 44, the request conserning individual control targets is weighted in respect of the input request target value as follows:

I like to take right now (waiting time): $4 \times \frac{3}{5} = 2.4$

I don't like to stay in the elevator for a long time (riding time): $4 \times \frac{5}{5} = 4$ I don't like to wait for a long time frequently (rate of occurrence of longtime waiting): $4 \times \frac{2}{5} = 1.6$ I like to take an uncrowded cage (degree of jam in cage): $4 \times \frac{1}{5} = 0.8$ The request target value is modified in this manner and converted into the control target value in the manner described previously.

In the above example, the control target value is determined through two steps but by having great command of the request target input knowledge data base 109'-4, the control target value can be determined from correlation in one-to-one relationship.

As described above, the control target value can be determined for the request target but in some applications, a control method capable of meeting all of the control target values can not be realized and the control method for group control can not be determined in one definite way, with the result that an inconvenient event may be expected to occur wherein set control target values can not be reflected fully. Accordingly, individual control targets (request targets) are required to be set with weights or priority ranks which indicate which control target is thought much of. Obviously, the user can directly determine values of weighting and priority ranking but more effectively, the AHP technique may be employed to advantage.

Figure 45:
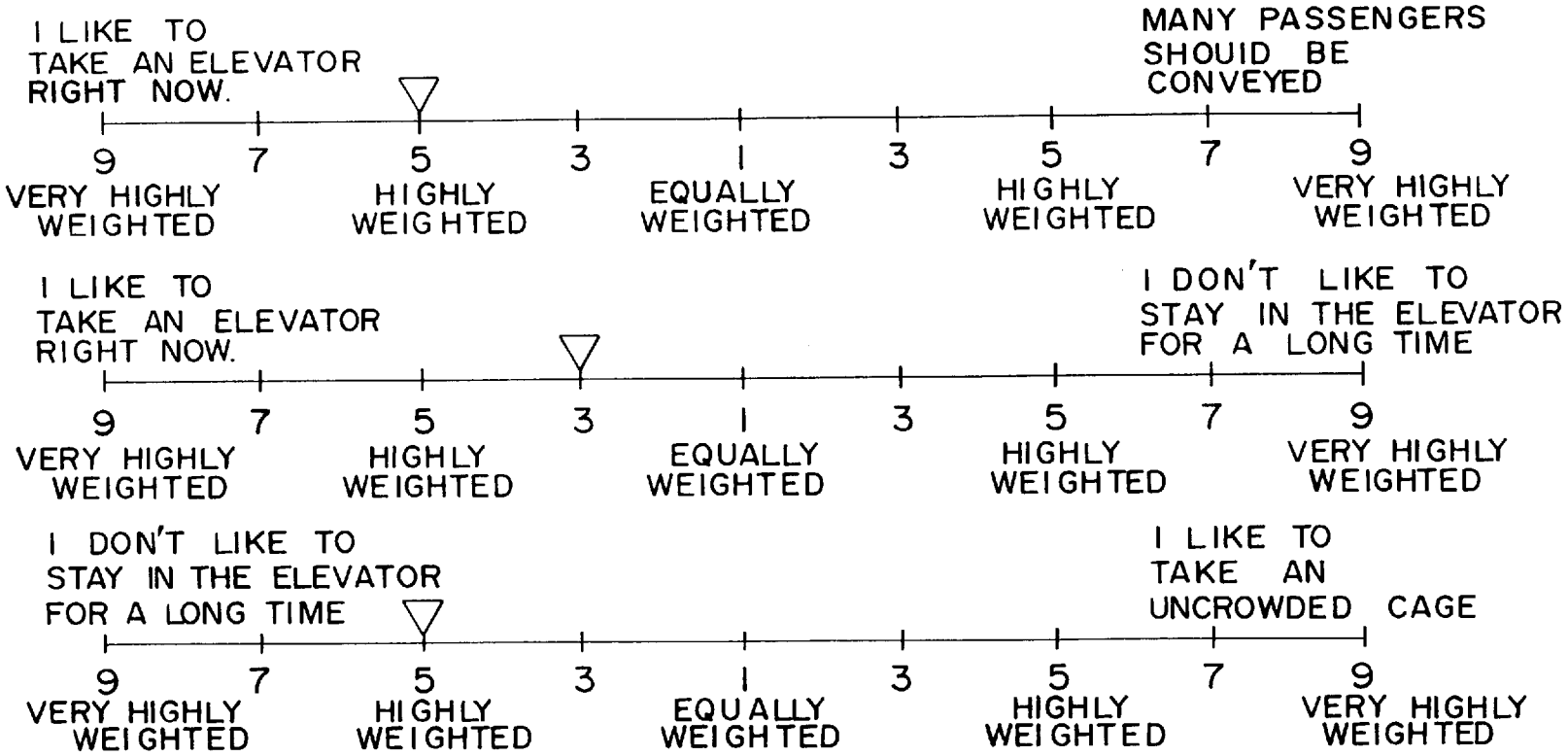
FIG. 45 shows the manner of inputting weights through AHP.

This AHP technique will be described with reference to FIGS. 45 and 46. It is assumed that the user can set five request items "I like to take right now (waiting time)", "Many passengers should be conveyed (transport capability)", "I don't like to stay in the elevator for a long time (riding time)", "I want to get correct information about a reserved cage (prediction hit rate)" and "I like to take an uncrowded cage (degree of jam in cage)". Conversationally, the request items are compared in priority by successively picking up two request items and comparing one with another (hereinafter referred to as one-to-one comparison) and comparison results are inputted as shown in FIG. 45. On the basis of the thus set values, a one-to-one comparison table as shown in FIG. 46 is prepared. A one-to-one comparison matrix A is prepared from this table and a characteristic vector V of the one-to-one comparison matrix A is calculated to determine the priority (weight coefficient) for the individual request items as follows:

$$A = \begin{bmatrix} 1 & 5 & 3 & 9 & 7 \\ 1/5 & 1 & 1/3 & 5 & 3 \\ 1/3 & 3 & 1 & 7 & 5 \\ 1/9 & 1/5 & 1/7 & 1 & 1/3 \\ 1/7 & 1/3 & 1/5 & 3 & 1 \end{bmatrix}$$

$$V = \begin{bmatrix} 0.513 \\ 0.129 \\ 0.261 \\ 0.033 \\ 0.063 \end{bmatrix}$$

In this example, the priority for the waiting time at the hall is 0.513 and that for the riding time is 0.261.

With the correlation table shown in FIG. 44 used, the correlation is inclusive of the weight and therefore there is no need of additionally setting weight values or priority ranks through, for example, AHP technique. When the range of target value is limited upon inputting of request or the par is supplied to user, weighting or priority ranking can sometimes be omitted.

Through the above procedure, a customer request table 109'*c* as shown in FIG. 41 can be prepared. This customer request table 109'*c* stores control target values and associated weights (priority ranks). The succeeding control method deduction unit 109'-2 then determines a control method which can meet the thus stored control target values (see FIG. 40).

In selecting and determining a control method, a rule for determining at least one of various running modes (for example, running with express zone, skip running for service every other floor or at alternation of a plurality of floors, through running directed to a specified floor, running with preset start sequence, running for preferential service to a specified floor and so on) is first selected. For example, when a request thinking much of the transport capability is inputted during the time to attend office building, given 6 elevators installed, 3 elevators can be distributed to lower floors with the remaining three distributed to higher floors or given that a plurality of elevators at the reference floor are placed in condition for waiting, preset start sequence can be assigned to these elevators so that passengers can be conveyed at predetermined passenger number or at predetermined time intervals, thereby improving the transport capability. In some applications, two or more running modes may be used in combination to determine an ultimate running mode. A call assignment control method according to the thus determined running mode and usable parameters are then selected. The control method can be selected using the control method deciding knowledge base 109'-6 (rules) as shown in FIG. 47 while looking up the environment/traffic data table 109'-5. By using the thus selected running mode, call assignment control method and usable parameters, a predictive value is deduced, and the predictive value is inverted into a request target by means of the request input unit 109'-1 and displayed on the input terminal I, thus presenting the predictive value to the customer. If accepted by the customer, the predictive value is recorded on a decision table 101"-3 as shown in FIG. 38 which is included in the group supervisory controller 101". The contents of the FIG. 48 table is exemplarily referenced to the time zone but a table referenced to a sorted traffic pattern may be prepared and used in combination. Further, the running direction may be recorded on the decision table. The group supervisory controller uses a learned traffic pattern from the learning system and a built-in timer to decide the condition, calls out a decision table corresponding to the decided condition, and execute control commensurate with the contents of the decision table.

Another modification of the FIG. 39 embodiment may be achievable as desired.

Structurally, this modification comprises the knowledge acquiring unit 109'-3 in the control method decider 109' as in the case of the first modification shown in FIG. 40.

In the group supervisory controller 101", the learning system 101"-1 collects data representative of control targets obtained from actual control of elevator, and it statistically processes the data daily or weekly under given environment/traffic conditions and records results. The learning system 101"-1 is also operable to learn additional data representative of parameters which are not directly related to request of the user but indirectly affect the user's request, for example, riding rejection rate, running time for measurement of the number of floors, occurrence of an abnormally longtime waiting and the elevator condition at that time and occurrence of a longtime stop. The above learned data can be presented to the customer through the control method decider 109'. In the control method decider 109', the knowledge acquiring unit 109'-3 receives the learned data and compares it with a control target value precedently prepared on the basis of a request input. If the learned data meets the target value, the data is inverted into a request target which is based on actual measurement and understandable by the user and presented to the user in the form of a radar chart or the like. In the event taht the leanred data contains an item or parameter which does not meet the target value, it is examined whether an abnormal phenomenon takes place under the utilization condition at that time (for example, frequent occurrence of riding rejection or increased rate of unexpected utilization of unscheduled floors). If the abnormal phenomenon is detected, the control method deduction unit 109'-2 again seeks and selects another control method by using the utilization environment data. In the absence of a selection rule matching the utilization environment data, deduction is carried out using the closest utilization environment data.

The thus deduced control method and parameters are compared with previous ones and if coincident, a request for preparation of a new rule is issued. If a different control method and different parameters are selected, they are presented to the customer so as to be checked for their use under the actually measured utilization environment and if accepted, recorded on the decision table 101"-3 provided in the intelligence system 101" of group supervisory controller 101". When the knowledge acquiring unit 109"-3 detects that the learning system 101"-1 of the group supervisory controller 101" generates new environment/traffic data, it can add the new data to the environment/traffic data base and issue information to this effect.

Figure 49:
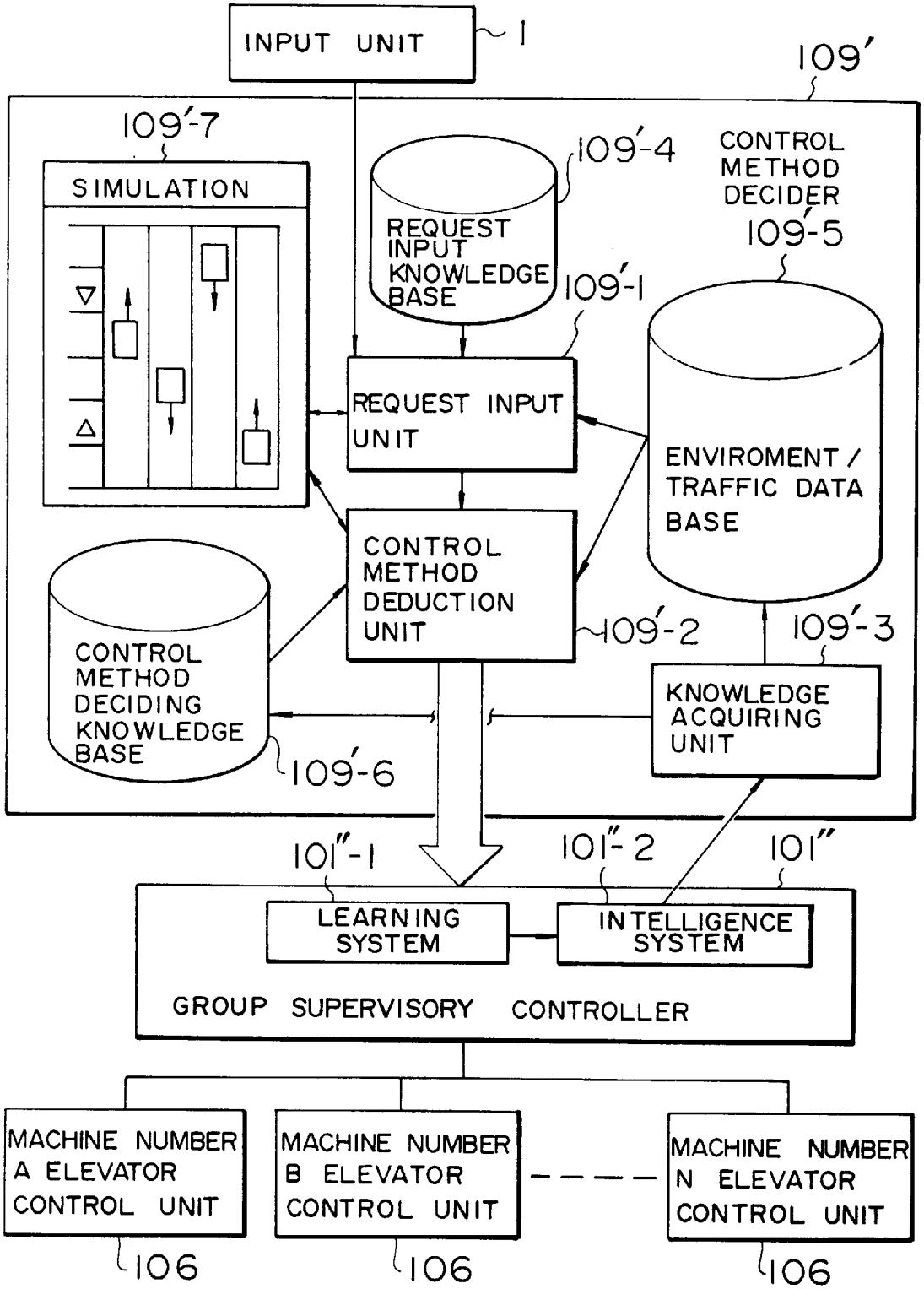
FIG. 49 is a schematic block diagram illustrating the overall construction of another modification of the FIG. 39 embodiment.

Referring to FIG. 49, still another modification of the FIG. 39 embodiment is illustrated wherein a simulator unit 109'-7 is additionally provided in the control method decider 109'. With this construction, the knowledge acquiring unit 109'-3 determines the degree of attainment in respect of a control target value set by the request input unit 109'-1 and if the thus determined degree of attainment is small (or large), the control method deduction unit 109'-2 again seeks and selects a control method by using the actually measured environment/traffic data, the simulator unit 109'-7 predicts results of execution of the selected control method to confirm that this control method meets the control target, and the thus confirmed control method is sent to the decision table 101"-3 in the group supervisory controller 101".

When the control method and evaluation parameters newly selected by the control method deduction unit 109'-2 are identical to those used in actual control, a control parameter related to an item which can not meet the target value is extracted and simulation is carried out by changing the extracted control parameter to obtain a new parameter best suited for the target value and which is registered.

Figure 50:
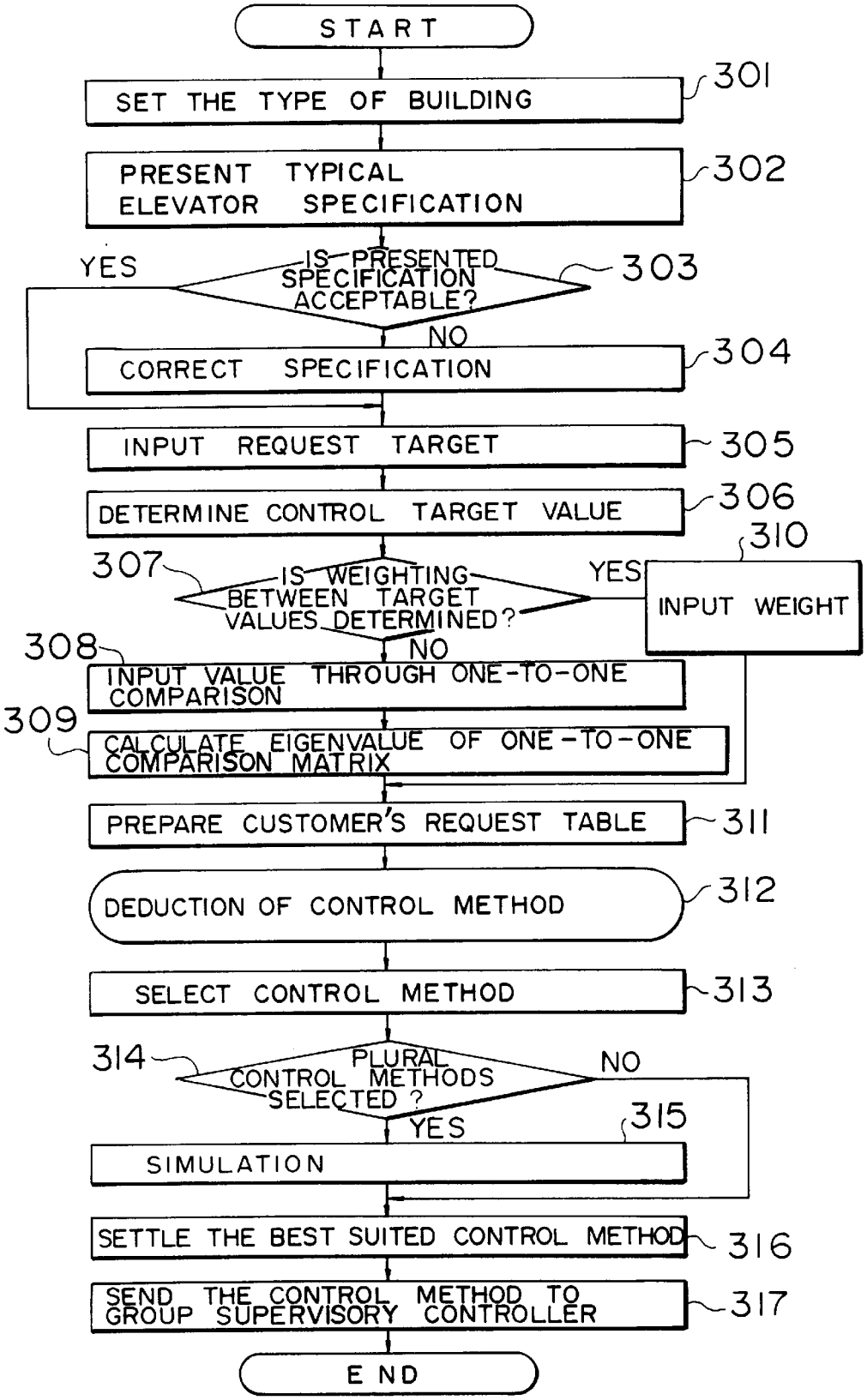
FIGS. 50 and 51 are flow charts showing processings in the embodiments of FIGS. 39, 40 and 49.

An example of the overall processing flow will now be described with reference to FIGS. 50 and 51.

Firstly, the control method decider sets the type of building (step 301). Subsequently, a typical elevator specification for the same type of building is presented (step 302) to enable the customer to decide whether the presented specification needs to be corrected (step 303) and if necessary, correction of the specification is executed (step 304). Thereafter, the customer inputs a request target (step 305). The input target is converted into a control target value by using the request input knowledge base (step 306). Then, the customer is asked if priority ranking between control target values can be set by the customer (step 307) and if impossible, the customer is enabled to set a relative comparison value between two targets through one-to-one comprison based on AHP technique (step 308). The thus inputted results are used to prepare a one-to-one comparison matrix and an eigenvalue is calculated (step 309). This eigenvalue is taken as a weight. If a preset weight is available, the customer inputs this weight (step 310). The control target value and associated weight determined in this manner are recorded as customer's request data on a table in respect of individual control targets (step 311). This table is then sent to the control method deduction unit (step 312). The control method deduction unit selects a control method by using the control method knowledge base and environment/traffic data base (step 313). If only one type of control method is selected, this method is determined to be the best control method (step 316) and it is sent, if approved by the user (who inputs the request), to the control system (step 317). If a plurality of types of control method are selected (step 314), predictive values by the individual control methods are sought through simulation (step 315) and the determined predictive value is compared with the precedently determined control target value to determine an optimum control method which is best suited for attainment of control goal (step 316). The predictive value of the thus determind control method is presented to the customer and if approved by the customer, sent to the decision table provided in the group supervisory controller (step 317).

Figure 51:
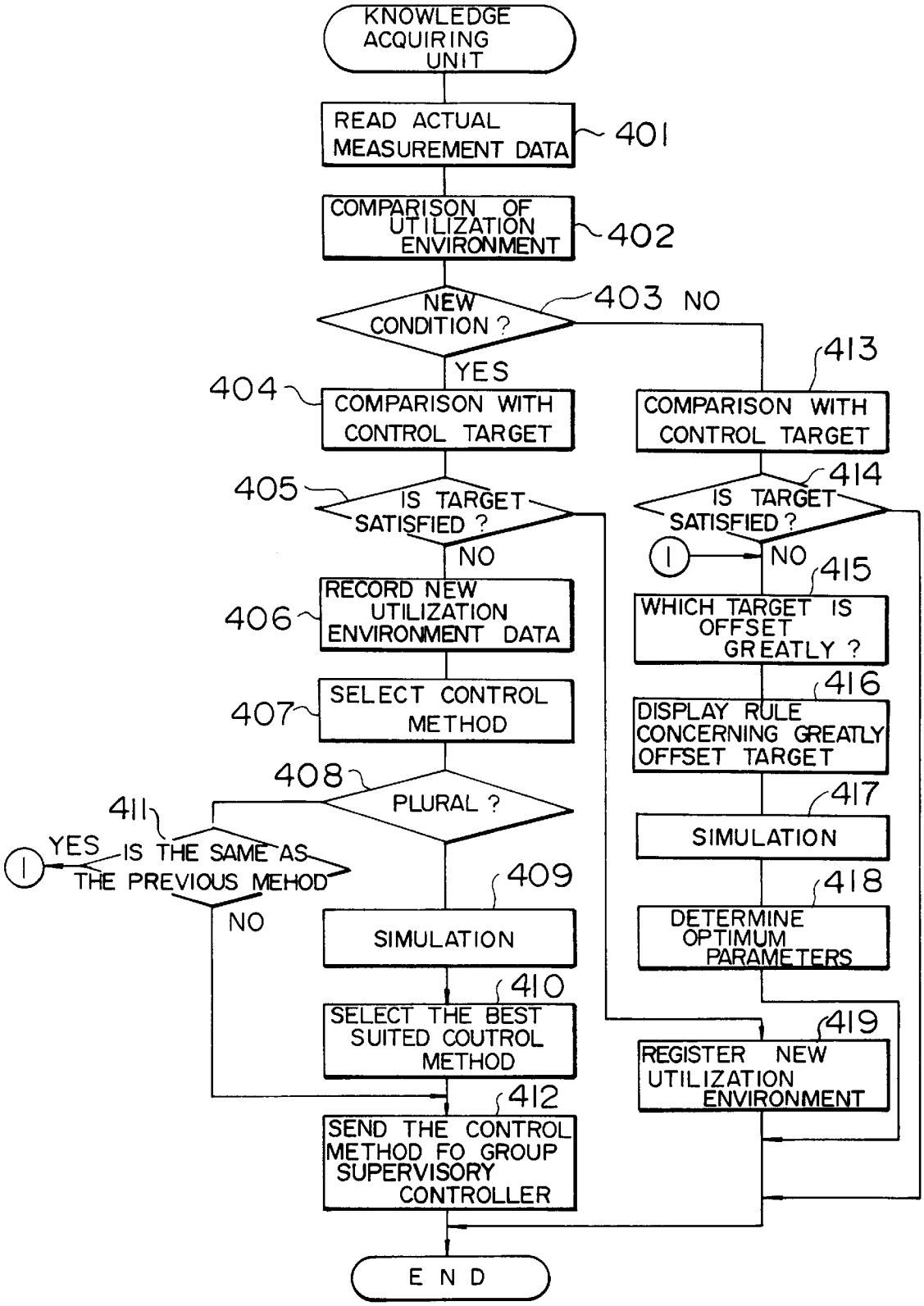

Particularly, FIG. 51 illustrates a flow chart showing the operation of the knowledge acquiring unit. Firstly, data actually measured by the group supervisory controller is read (step 401). Subsequently, of read data, utilization environment/traffic data is compared with the previously set target value of environment/traffic (step 402). It is decided from the comparison result whether a new state is occurring (step 403). If occurrence of new state is determined, the control target value is compared with the actually measured data (step 404) to decide whether the data meets the target value. If the target value is unsatified with the data, the new utilization environment is recorded on the environment/traffic data base (step 406). Subsequently, the control method deduction unit performs selection of control method by using the new utilization environment data (step 407), and the selected control methods is checked for its singularity or plurality (step 408). If a plurality of control methods are selected, simulation is carried out pursuant to individual control methods by using the actually measured new utilization environment data (step 409). Simulation results are compared with the control target value to select a control method best suited for attainment of control goal (step 410). If only one control method is selected in the step 408, this control method is decided as to whether to be different from the previous control method (step 411). If different, the selected control method is determined to be the best suited control method and sent to the decision table of the group supervisory controller (step 412). If the utilization environment is decided to be coincident with the environment/traffic data base in the step 403, the control target value is compared with the actually measured data (step 413) to decide whether the data meets the target value (step 414). If the target value is satisfied with the data, the operation of the knowledge acquiring unit ends. If the target value is unsatified with the data, a target item not meeting the target value is extracted (step 415), a rule related to the target item is extracted, simulation is carried out by changing parameters described in the rule (step 417) to determine a parameter best suited for attainment of control goal, and a new rule containing the thus determined parameter is registered while an old rule is deleted. If the data is decided to meet the target value in the step 405, the new utilization environment and corresponding control method are registered (step 419).

In this manner, a rule which does not meet new environment and rule correction based on results of actual running can be extracted to realize delicate running control.

The invention has been described by way of the elevator control system applied to a group supervisory elevator system but the elevator control system of the invention may also be applied to a single elevator. Specifically, in running control methods (for example, directed to setting of express zone and nonstop floor and realization of VIP service) and recently predominant control operations such as hall information guide display control and door open/close speed control, request of the user and support tools can be introduced for the purpose of improving man-machine capability.

The present invention is advantageous in that the request target (qualitative) of the elevator user can automatically be converted into the actual control target and hence a desired control method can be executed without assistance of expert in elevator.

In addition, after installation, actual elevator operation data can be inverted to a request target or a control target value and presented to the customer to enable the customer to examine whether the desired control is executed and to diagnose the elevator utilization condition. Further, since the control method used for the control execution means is permitted to be adopted only when approved by the user, the user can fully make use of the elevator system.

Referring to FIGS. 52 to 63, a further embodiment of the elevator control system according to the invention will be described. This embodiment is particularly directed to an elevator group supervisory control system using a table similar to the correlation table described by referring to FIG. 44.

Figure 52:
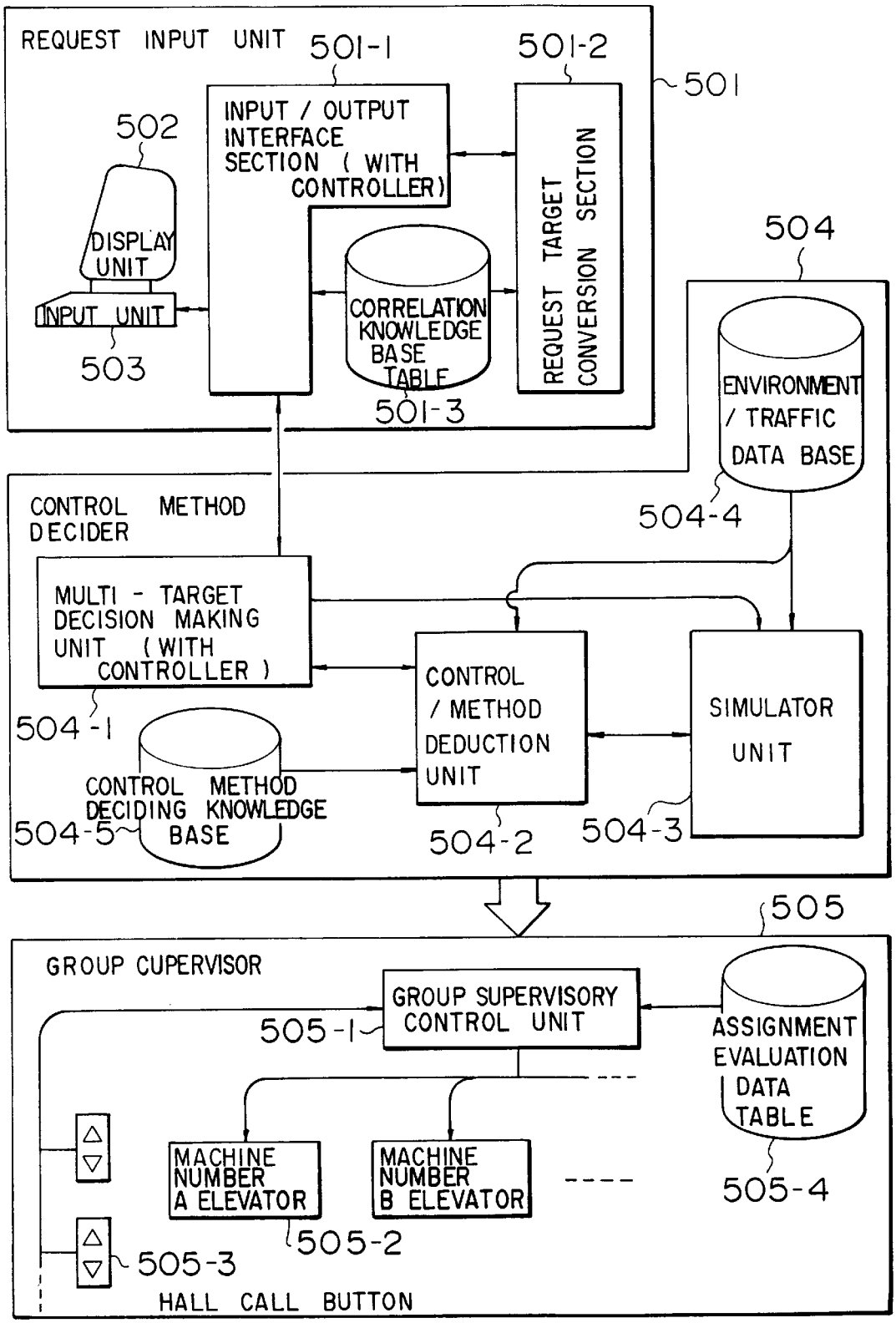
FIG. 52 is a schematic block diagram illustrating the overall construction of a further embodiment of the elevator control system according to the invention.
Figure 53:
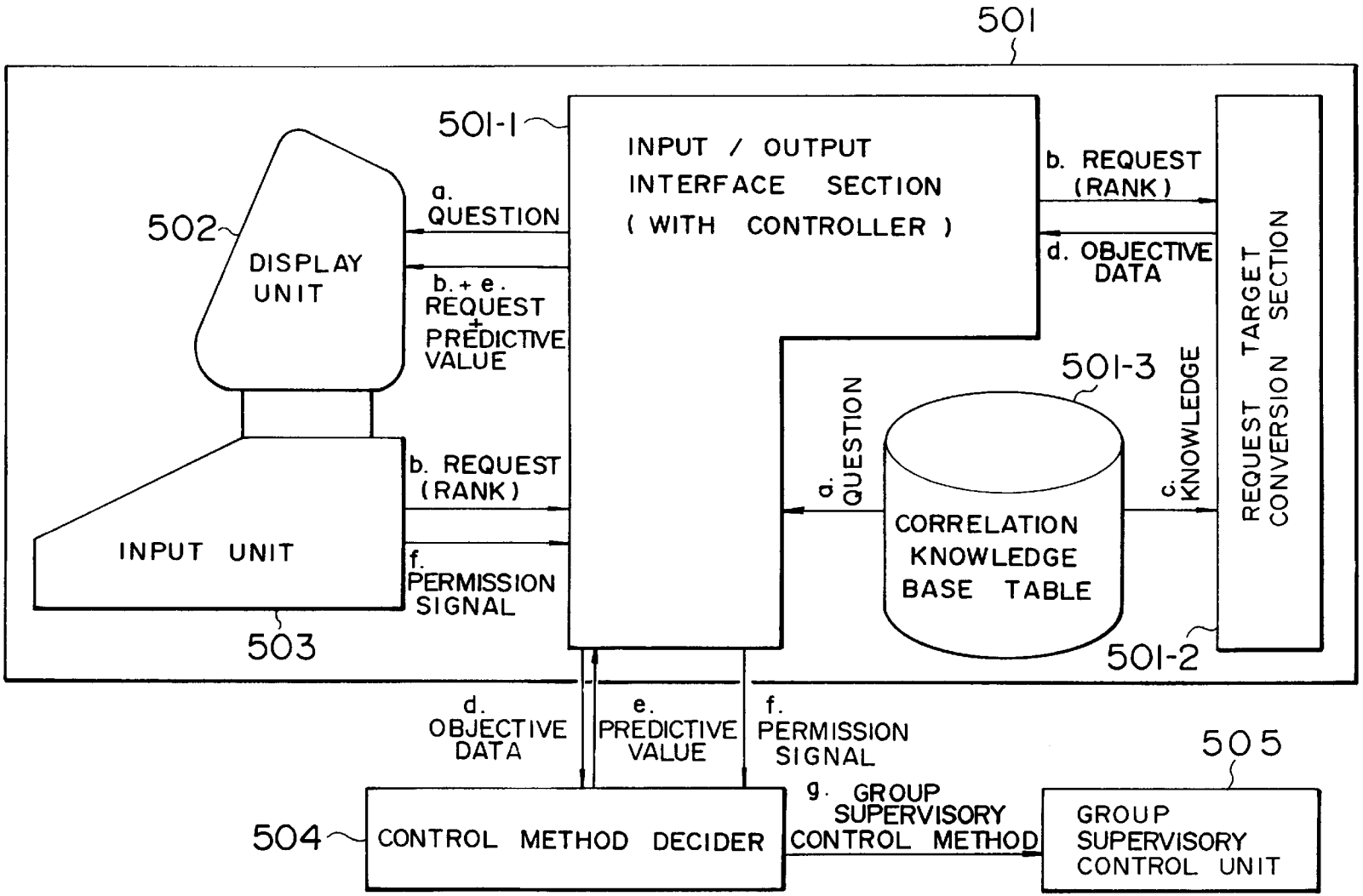
FIG. 53 is a diagram showing flow of data between component blocks in the FIG. 52 embodiment.

As diagrammatically shown in FIG. 52, a control system of this embodiment is generally constructed and associated with the peripheral equipment. The control system features a request input unit 501 and the remaining blocks 504 and 505 are similar to those of the foregoing embodiments illustrated in, for example, FIG. 1. The request input unit 501 includes an input/output interface section 501-1, a request target conversion section 501-2, a correlation knowledge base table 501-3, a display unit 502 and an input unit 503. The control method decider 504 includes a multi-objective decision making unit 504-1, a control method deduction unit 504-2, a simulator unit 504-3, an environment/traffic data base 504-4 and a control method deciding knowledge base 504-5. The group supervisor 505 includes a group supervisory control unit 505-1, machine number elevators 505-2, hall call button switches 505-3 and an assignment evaluation data table 505-4. FIG. 53 is a diagram useful to explain flow of data.

Referring to FIG. 52 or 53, the input/output interface section 501-1 with controller function included in the request input unit 501 reads n questions, referred to as question a hereinafter, including an inquiry statement alone or both of inquiry statement and commentary statement in compliance with the user and delivers the question a to the display unit 502. The user answers individual items of the displayed question a by selecting one of three grades A (very strongly), B (strongly) and C (don't care) on the basis of his feeling and inputs his request (rank) b to the input unit 503. The request (rank) b is sent to the request target conversion section 501-2 which in turn converts individual items of the request into m control targets by using knowledge c stored in the correlation knowledge base table 501-3. The thus obtained control targets are processed so as to be applied with weights or priority ranks according to which the control target values are set. The control target value applied with weighting or priority ranking (referred to as objective data d) is transmitted to the control method decider 504 through the input/output interface section 501-1.

In the control method decider 504, the multi-objective decision making unit 504-1 with controller function sends the objective data d to the control method deduction unit 504-2. The control method deduction unit 504-2 consults the environment/traffic data base 504-4 and control method deciding knowledge base 504-5 in respect of a building of interest to deduce a few group supervisory control methods capable of achieving the objective data d. Deduction results are simulated by the simulator unit 504-3 operable to simulate elevator running/assignment by using data in the environment/traffic data base 504-4, so that predictive values e can be determined. By taking the predictive values e into account, the multi-objective decision making unit 504-1 selects and determines an optimum control method from the deduced methods. A predictive value e by the selected control method is returned to the request input unit 501.

The input/output interface section 501-1 being in receipt of the returned value operates to display this predictive value e along with the request b inputted by the user on the display unit 502 (see FIG. 63) to obtain user's approval. If unaccepted, the procedure is restarted from the beginning step of inputting. If accepted by the user, a permission signal f is sent to the control method decider 504 through the input/output interface section 501-1.

In response to the information, the multi-objective decision making unit 504-1 transmits a group supervisory control method g to the group supervisor 505 through the medium of an IC card or the like.

In the group supervisor 505, the contents of the assignment elvaluation data table, which is used by the group supervisory control unit 505-1 to assign signals from the hall call button switches 505-3 on respective floors to the plural machine number elevators 505-2, is rewritten to the contents derivable from the IC card.

Referring now to FIGS. 54 to 58, the contents of the correlation knowledge base table 501-3 will be described. The correlation knowledge base table 501-3 is constructed of five blocks. The first block (FIG. 54) is an inquiry statement table. The second block (FIG. 55) is a default table pursuant to the type of building. The third block (FIG. 56) is a correlation table showing the correlation between request item and control objective. The fourth block (FIG. 57) is a priority table showing the relation between the correlation and the inputted rank, default persuant to the type of building. The fifth block (FIG. 58) is a control target value conversion table.

In the inquiry statement table shown in FIG. 54, n questions are assigned with item numbers ①, ②, . . . , ⓝ, and an inquiry statement and a commentary statement are prepared for each item when constructing the knowledge base.

In the default table pursuant to the type of building shown in FIG. 55, three types of default from the standpoint of the type of building, that is, large (very important), medium (important) and small (slightly important) are allotted to the individual items in accordance with the types of building.

FIG. 56 numerically shows how the individual request items are correlated to the control objectives by using five kinds of correlation values 3 (closely correlated), 2 (correlated), 1 (indirectly affecting), 0 (not particularly correlated) and −1 (negatively correlated).

The function table shown in FIG. 57 is used for effecting arithmetic operation of the obtained correlation and default by using the rank inputted by the user and knowledge base.

The conversion table shown in FIG. 58 is used to quantitatively set values of individual control objectives in accordance with priority ranks determined through processing by the request target conversion section 501-2 to be described below.

The processing in the request target conversion section 501-2 will now be explained. In this processing, functions of variables as described below are used.

Variables i={①, ②, . . . , ⓝ}: request item number; ① indicates "arriving earlier".

j={1, 2, . . ., m}: control objective number; "1" indicates waiting time.

Suffix k={1, 2, . . .,l}: building type number; "1" indicates building for only one company resident.

Functions $\lambda(i)$ rank inputted for request represented by {A, B, C}

$\mu(i, j)$: correlation between request item and control objective represented by {3, 2, 1, 0, −1}

$\delta_k(i)$ : default value for request item pursuant to the type of building represented by {large, medium, small}

ρk(i, j): priority for individual request items corresponding to individual control objectives which is represented by {5, 4, 3, 2, 1, 0, −1, −2, −3}

$\tau_k(j)$ weights for individual control items represented by $$\sum_{i=1}^{n} \rho_k(i,j)$$

Figure 59:
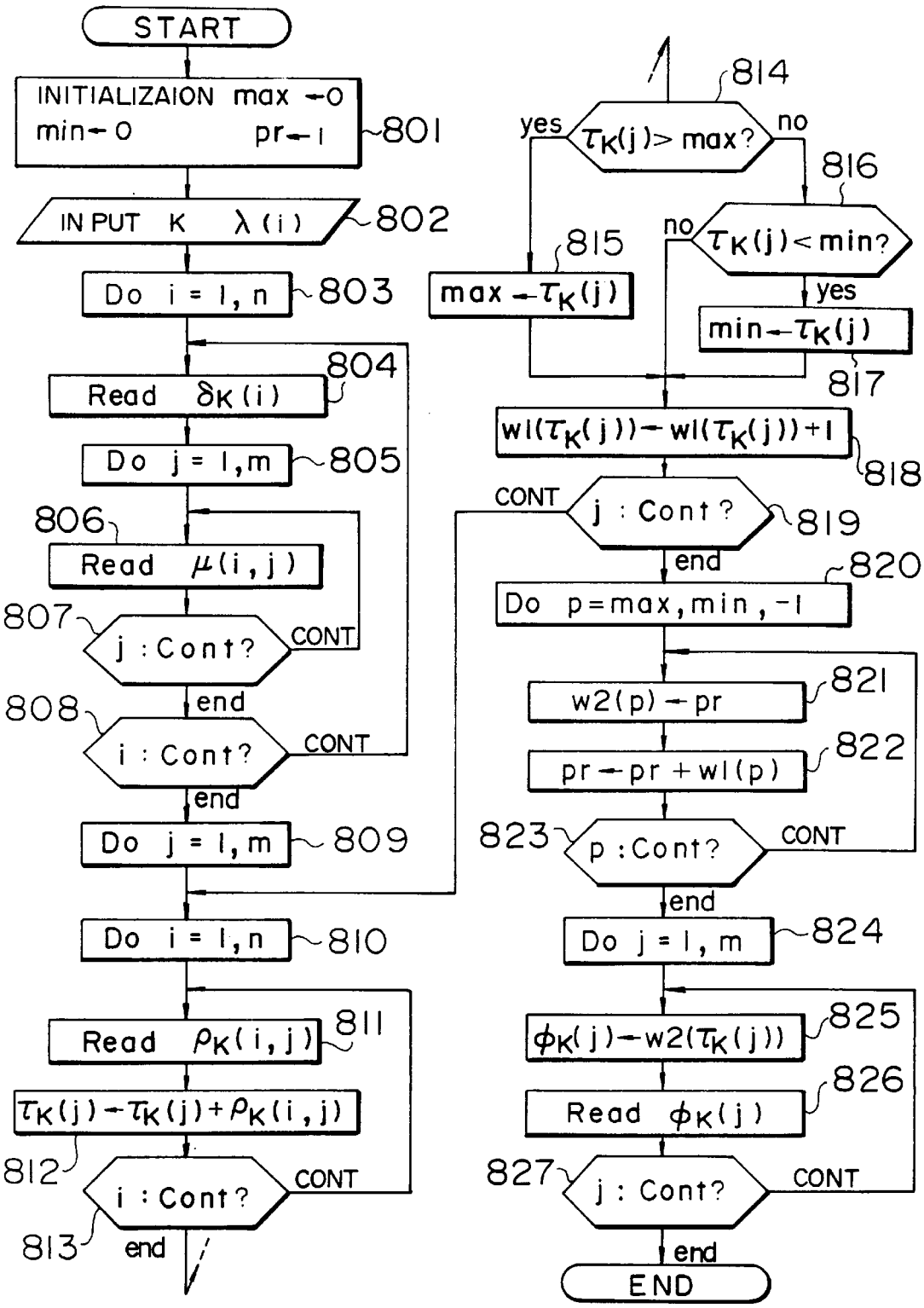
FIG. 59 is a flow chart showing the operation of a request target conversion section.

$\phi_k(j)$: priority ranks for individual control objectives represented by a function of $T_k(1), \ldots, \tau_k(m)$ $\psi_k(j)$: values of individual control objectives The request target conversion section 501-2 operates in accordance with a flow chart as shown in FIG. 59. In step 801, usable variables max (maximum value), min (minimum value) and pr (rank) are initialized. In step 802, the type of building k and rank A(i) inputted by the user are obtained.

A loop consisting of steps 803 to 808 is concerned with i. In step 804, default $\delta_k(i)$ is read out of the default table (FIG. 55) and in step 806 within a loop consisting of steps 805 to 807, correlation $\mu(i, j)$ is read out of the correlation table (FIG. 56). Thereafter, the procedure proceeds to a loop consisting of steps 809 to 819 and concerned with j. In step 811 within a loop consisting of steps 810 to 813, priority $\rho_k(i, j)$ for individual request items is determined on the basis of $\lambda(i)$, $\mu(i, j)$ and $\delta_k(i)$ by using the priority table (FIG. 57). The thus determined priority is added to $\tau_k(j)$ in step 812 so that at the termination of the loop of steps 810 to 813, weight $\tau_k(j)$ for the individual control objectives can be obtained. In steps 814, 815, 816 and 817, the maximum value and the minimum value of $\tau_k(j)$ are substituted into the variables max and min. In step 818, a processing for obtaining priority rank for $\tau_k(j)$ by utilizing algorithm of frequency sorting based on work array w1 is ready to start. A loop consisting of steps 820 to 823 is concerned with the weight ranging from maximum to minimum. In step 821, rank pr is substituted into work array w2 and in step 822, the rank pr is renewed using w1. A loop consisting of steps 824 to 827 is concerned with j. In step 825, priority rank $\phi_k(j)$ for the individual control objectives is determined on the basis of the previously obtained w2 and in step 826, a control objective value is determined on the basis of $\phi_k(j)$ by utilizing the control objective value table (FIG. 58). In this manner, the objective data d representative of the control objective value applied with weighting/priority ranking can be determined through processings in the flow chart of FIG. 59.

Finally, a test case will be described in which the above procedure is actually executed. For simplicity of explanation, it is assumed that the type of building is hotel, the control objectives are four (m=4) including "1" indicative of waiting time, "2" indicative of degree of jam in cage, "3" indicative of reservation hit rate and "4" indicative of riding time, and the request items are five (ⓝ=5).

Inquiry statements of questions about the request item including feelings are exemplified in FIG. 60. Among the feelings, question ① mainly originates from the sense of value, ② from preference, ③ and ④ from taste and ⑤ from sense. If answers to the questions are such that ①: A, ②: A, ③: C, ④: B and ⑤: A, $$\lambda(①)=A,\ \lambda(②)=A,\ \lambda(③)=C\lambda(④)=B \text{ and } \lambda(⑤)=A$$

are set in step 802 of FIG. 59.

Then, from a default table/correlation table for hotel shown in FIG. 61, function $\delta_{hotel}(i)$ and $\mu(i, j$ are set as follows (steps 803 to 808):

$\delta_{hotel}$(①)=medium $\delta_{hotel}$(②)=large $\delta_{hotel}$(③)=small $\delta_{hotel}$(④)=medium $\delta_{hotel}$(⑤)=medium, $$\mu(i,j)=\begin{bmatrix} 3 & -1 & -1 & 1 \\ -1 & 3 & 1 & 2 \\ 2 & -1 & 3 & 2 \\ -1 & -1 & 1 & -1 \\ 1 & 0 & 3 & 1 \end{bmatrix}.$$

This $\mu$(i, j) is converted into the priority $\rho_{hotel}$(i, j) by using the FIG. 57 table. When elements of $\mu$(i, j) are added together in accordance with the individual control objectives (in the column direction), weight$_{hotel}$(j) can be set (steps 810 to 813 and step 819):

$$\rho_{hotel}(i,j)-\begin{bmatrix} 4 & -2 & -2 & 2 \\ -2 & 6 & 2 & 4 \\ 0 & 1 & -1 & 0 \\ -1 & -1 & 1 & -1 \\ 2 & 0 & 4 & 2 \end{bmatrix},$$

$\tau_{hotel}(1)=3$
$\tau_{hotel}(2)=5$
$\tau_{hotel}(3)=4$
$\tau_{hotel}(4)=6.$ In step 809 and steps 814 to 823, the processing for obtaining priority rank $\phi_{hotel}$(j) by utilizing the frequency sorting is ready to start and the following results are obtained in step 825:

$\phi_{hotel}(1)=4$
$\phi_{hotel}(2)=2$
$\phi_{hotel}(3)=3$
$\phi_{hotel}(4)=1.$ In step 826, quantitative values $\psi_{hotel}$(j) of the individual control objectives are set using a table of FIG. 62 as follows:

$\psi_{hotel}$(1): waiting time . . . 35 seconds or less
$\psi_{hotel}$(2): jam degree in cage . . . 50% or less
$\psi_{hotel}$(3): reservation hit rate . . . 93% or more
$\psi_{hotel}$(4): riding time . . . 30 seconds or less The thus determined weight $\tau_{hotel}$(j), priority rank $\phi_{hotel}$(j) and value $\psi_{hotel}$j) construct objective data d.

Figures 62, 63:
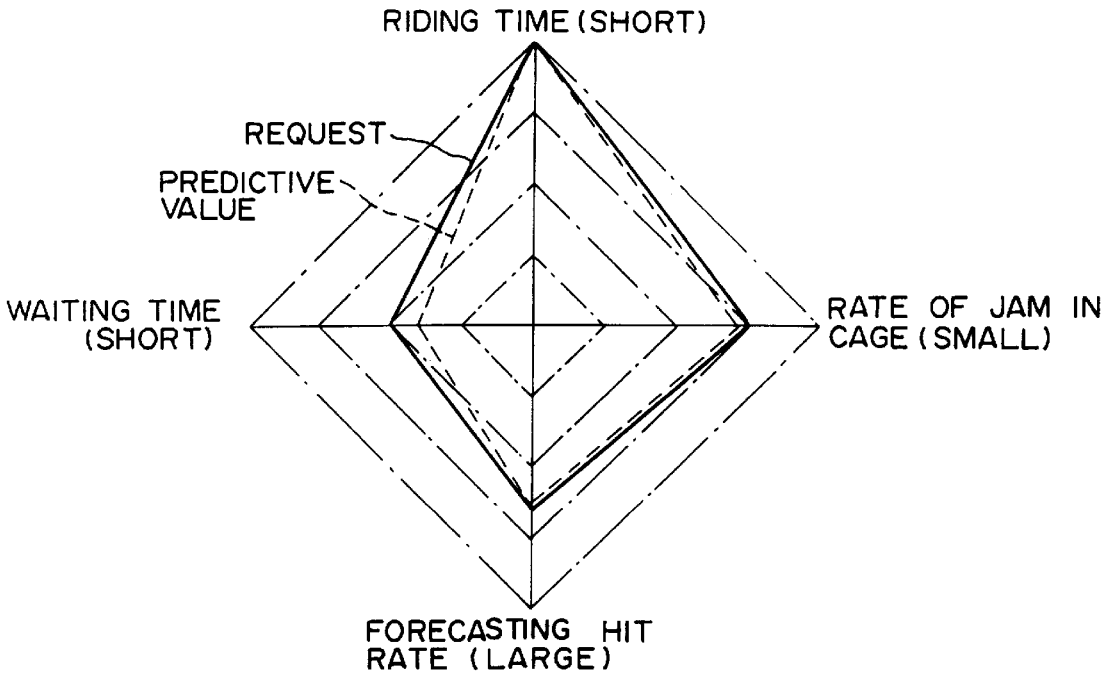

FIG. 63 illustrates an example of display of request items inputted by the user and corresponding predictive values.

In accordance with the present embodiment of FIG. 52, the knowledge base is used in the processing carried out by the request target conversion section and therefore the request item can be extended easily. The sophisticated relation between request items can be handled flexibly by changing values of the function tables (FIGS. 61 and 62) related to default and priority. Further, knowledge stored in the form of table can decrease the processing time to advantage.

In the present embodiment, the correlation tables of FIGS. 54 to 58 are prepared and used but the provision of all the correlation tables is not always necessary. For example, some of them can be omitted or changed by enabling the user to directly input the type of building and control objective and to carry out weighting.

Since in this embodiment the qualitative request or desire which is how one feels is converted into the quantitative control object by using the knowledge base, no constraint is imposed on the structure of the correlation table in the knowledge base.

The present embodiment can be summarized as follows. Firstly, experts in elevator extract control targets and request items and arrange the control targets and request items to settle tables of correlation between control target and request item, thus constructing a correlation knowledge base table. The user or building caretaker can conversationally input a request applied with ranking. The request input unit converts the rank for inputted individual request items into the priority for individual control targets by using the correlation knowledge base table. Priority is calculated for each control target to obtain a value representative of a weight for a control target of interest, and ranking is derived from weight values for individual control targets to determine a priority rank for the control target of interest. On the basis of the thus obtained weight or priority rank, the control target is quantitatively determined using the knowledge base. The quantitative control target value is sent to the control method decider acting as a tool for effecting multi-objective control in elevator group supervisory fashion. The control method decider considers a group supervisory control method adapted for the quantitative control target and calculates a predictive value which in turn is returned to the request input unit. The request input unit presents to the user the request inputted by the user and predictive value in the form of a graph such as a radar chart or bar graph or numerical value. If presented results are unacceptable to the user, the request is again inputted by the user. If approved and accepted, the presented results are permitted to be transmitted to the elevator group supervisory control unit through transmission line, floppy disc, IC card or the like medium and set in this control unit. In this manner, the user's request can be realized by being set in the group supervisory control unit in the form of the quantitative control target.

Used as the input means to input feeling or request is a keyboard, mouse or touch panel which introduces the user's feeling or request, standing for an answer to a question, into the system. The knowledge base serves as a file which stores the contents of question, default pursuant to the type of building, correlation between request item and control target, conversion function table and control target value and which is independent of the program. The conversion means converts the request of the user into the control target value in accordance with the contents of the knowledge base. The output means is also operable to activate the display unit so as to present the user's request and the predictive value accomplished by the system to the user.

In accordance with the present embodiment, the question to the user can be expressed in simple language. The effect of converting the request item (feeling) concerning elevator running into data without resort to knowledge of incomprehensible technical term is advantageous to the user and the effect of extending, correcting and changing knowledge with ease is advantageous to the maker.

Referring now to FIGS. 64 to 74, further embodiments of the elevator control system according to the invention will now be described. Principally, these embodiments feature that as in the embodiment described by referring to FIGS. 44 and 45, various requests inputted by the user are applied with weighting or priority ranking by using the technique such as AHP (i.e. one-to-one comparison and characteristic vector) and fetched into group supervisory control.

Figure 64:
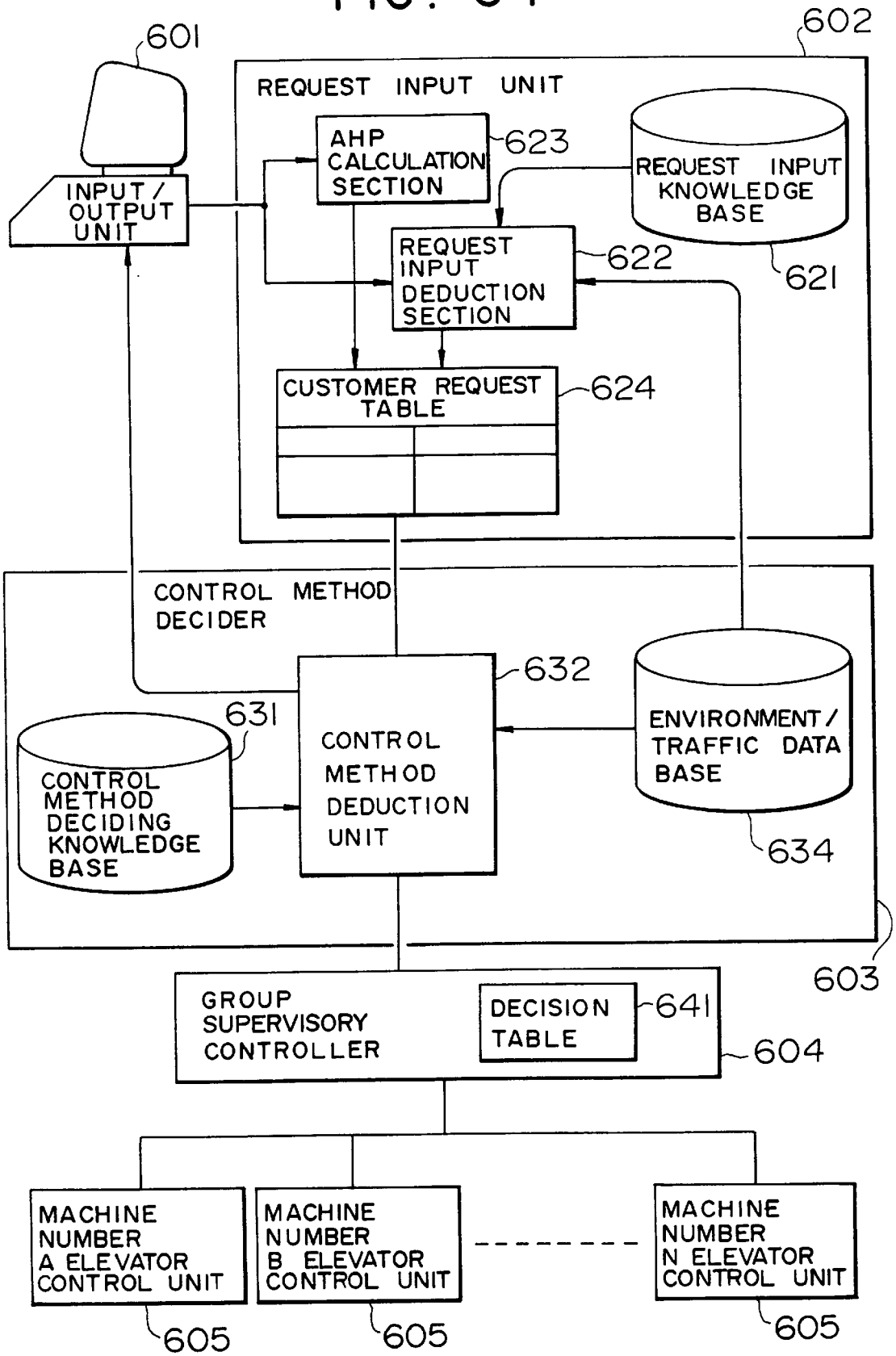
FIG. 64 is a schematic block diagram illustrating the overall construction of a further embodiment of the elevator control system according to the invention.

FIG. 64 illustrates the overall construction of an embodiment. The user or building caretaker inputs, in question-and-answer fashion, qualitative information in the form of feeling or request which represents environment surrounding an elevator system such as the type of building, elevator performance and request item concerning elevator running of the user or caretaker into a request input unit 602 through an input/output unit 601. In the request input unit 602, a request input deduction uses the inputted elevator-surrounding environment and request of the user to deduce a target value for control goal by looking up knowledge stored in a request input knowledge base 621. In addition, one-to-one comparison between items corresponding to control targets is carried out by the user. Comparison results are inputted by the user and sent to an AHP calculation section 623 included in the request input unit 602. On the basis of one-to-one comparison results, the AHP calculation section 623 prepares an one-to-one matrix and calculates eigenvalue and characteristic vector of the one-to-one comparison matrix. Components of the characteristic vector are taken as weights for individual control targets which are used in combination with the target values for control goal previously deduced by the request input deduction section 622 to prepare a customer request table 624. In deducing the control target value, in addition to the data representative of traffic, elevator-surrounding environment, elevator number and elevator performance inputted from the input/output unit 601, data precedently stored in an environment/traffic data base 634 may be used.

Subsequently, the customer request table 624 is sent to a control method decider 603. In the control method decider 603, a control method deduction unit 632 deduces, on the basis of knowledge stored in a control method deciding knowledge base 631, a control method capable of attaining the customer request table 624. The control method deduction unit 632 is also operable to determine predictive values of individual control targets which are obtainable with the deduced control method and send the thus determined predictive values to the input/output unit 601, thereby enabling the customer to decide whether the predictive values are acceptable.

If the predictive values are unaccepted, the above procedure is repeated. If accepted, the approved control method and parameters for realization thereof are written in a decision table 641 provided in a group supervisory controller 604. The group supervisory controller 604 performs controlling in accordance with the decision table 641, so that group supervision accepting the customer's request can be insured. As is clear from the above, by inputting such fuzzy and qualitative data as customer's feeling and converting the requests into quantitative control targets through deduction or AHP technique, the group supervision accepting the fuzzy requests of the customer who does not have preliminary knowledge about elevator can be realized.

The weight can be determined through AHP technique in a manner as will be described below with reference to FIGS. 65A to 65C. Firstly, individual control targets are mutually subjected to the one-to-one comparison as shown in FIG. 65A to provide a one-to-one comparison table as shown in FIG. 65B. Subsequently, on the basis of the one-to-one comparison table, a one-to-one comparison matrix A as shown in FIG. 65C is prepared and maximum eigenvalue $\lambda max$ and characteristic vector V of this matrix are calculated. Then, components of this characteristic vector V are weights for individual control targets.

Figure 66:
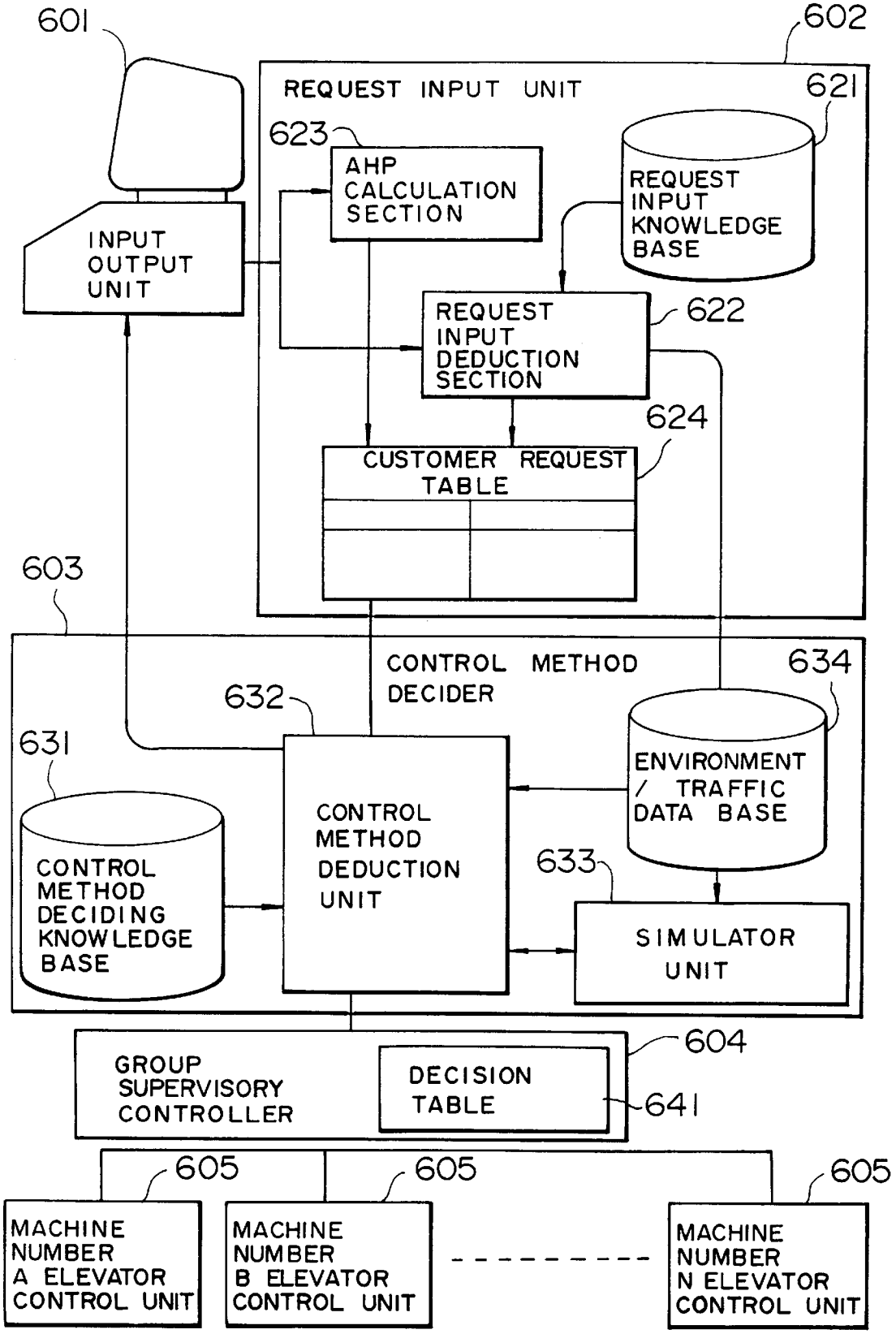
FIG. 66 is a schematic block diagram illustrating the overall construction of a modification of the FIG. 64 embodiment.

FIG. 66 illustrates a modification of the FIG. 64 embodiment wherein the control method decider 603 comprises a simulator unit 633 operable to simulate the movement of elevator. In this modified embodiment, the control method decider 603 determines a few control methods which meet a customer request table 624, predictive values of control targets expected to be obtained with these control methods are determined through simulation, by simulator unit 633, of movement under group supervision and on the basis of simulation results, the control method deduction unit 632 determines a control method best suited for attainment of control goal. The thus determined control method is displayed on the input/output unit 601 and if accepted by the user, written in the decision table 641.

When carrying out simulation, the simulator unit 633 uses data stored in the environment/traffic data base 634. In this modified embodiment, since the predictive value is determined through simulation, there is no need of precedently storing knowledge about the predictive value and even in particular case where the elevator system includes an elevator serving for different floors from those served by other elevators or the speed or rated capacity is different for respective elevators, highly reliable predictive values can be determined.

FIG. 67 shows an example of the request input knowledge base. A control target value can be derived from this knowledge base when one of inputted customer's feelings or requests, for example, traffic is presupposed. Thus, if for office building the request concerning reservation change is low, the reservation hit rate is determined to be 90% or move pursuant to rules 1 and 2, and if the request concerning passenger number is low, the jam degree in cage is determined to be 60% or less pursuant to rule 3.

Figure 68:
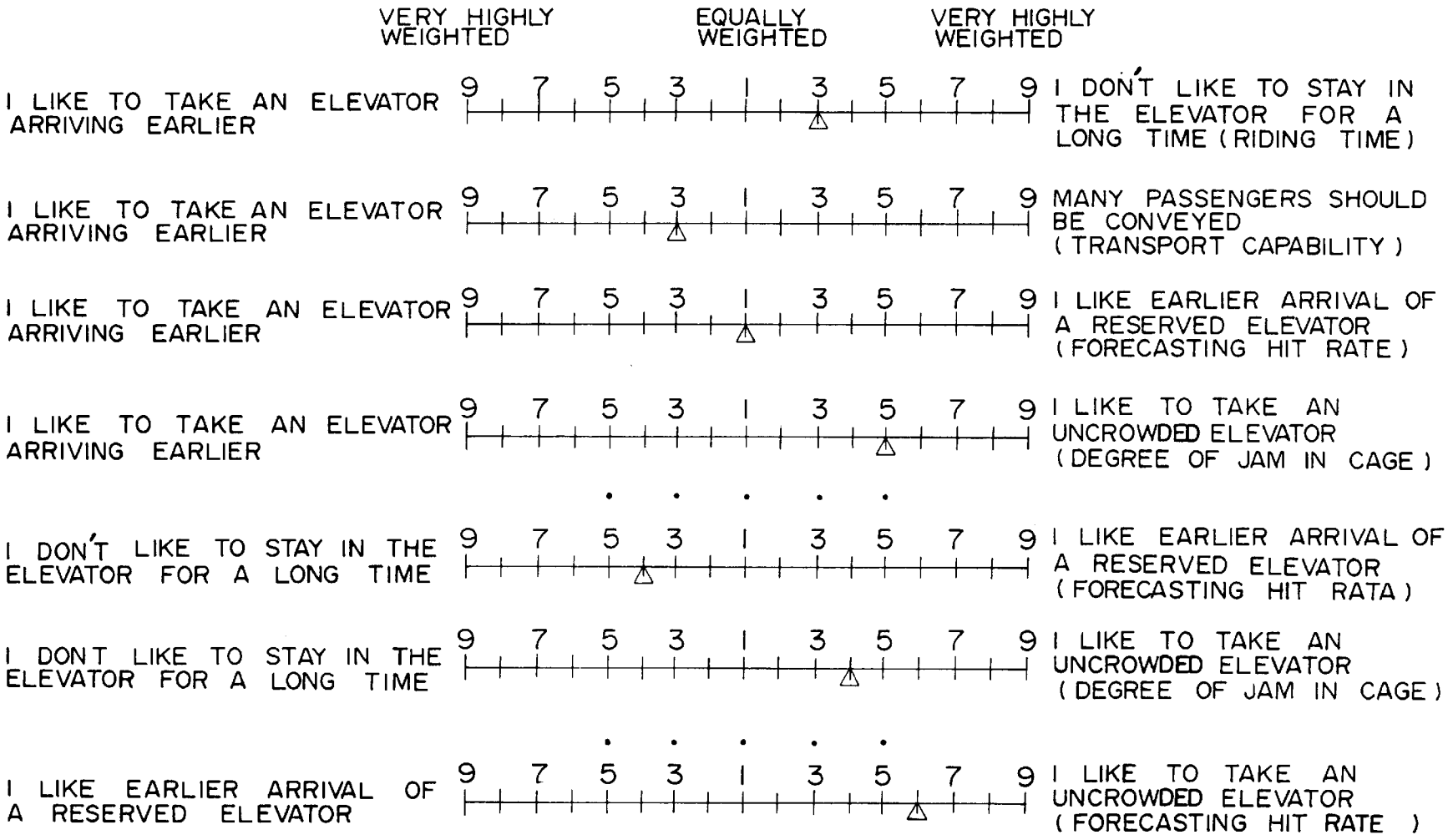
FIG. 68 shows an example of the manner of inputting relative priority through AHP.

Priority subject to the one-to-one comprison based on AHP technique can be inputted in a manner examplified in FIG. 68. Specifically, relative priority desired to be set between request items is inputted by manipulating a cursor key on the input/output unit and can be visually recognized or confirmed with ease.

FIG. 69 shows an example of the environment/traffic data base 634. Environment surrounding a building in which elevators are installed, traffic varying with time, season or day and elevator number and performance are inputted through the input/output unit 601 or precedently stored in the environment/traffic data base 634 and delivered to the request input deduction section 622 or simulator unit 633.

FIG. 70 shows an example of the customer request table, FIG. 71 an example of the control method deciding knowledge base, and FIG. 72 an example of the decision table.

Figure 73A:
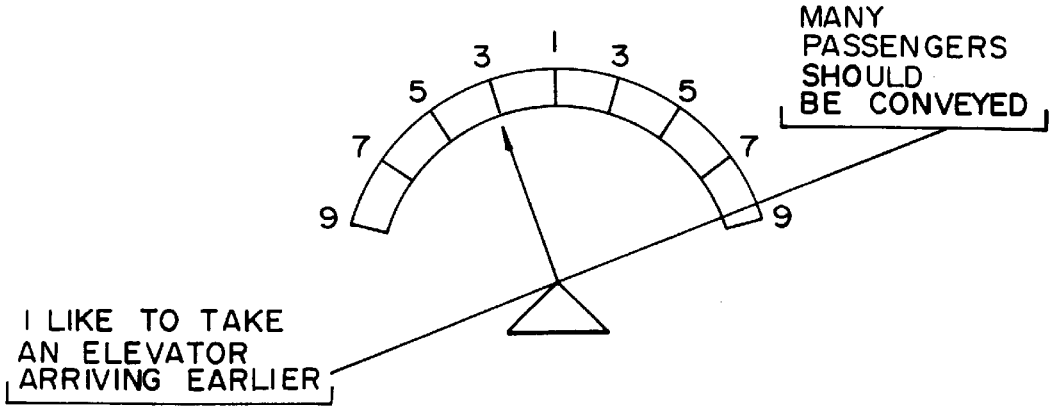
FIGS. 73A to 73C are diagrams illustrating an example of one-to-one comparison effected in terms of inclination of a balance.
Figure 73B:
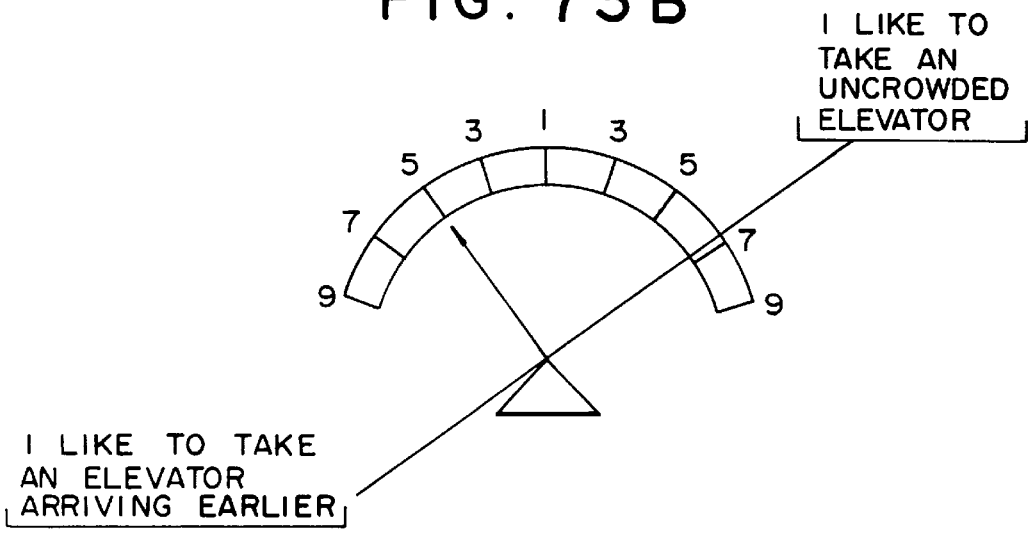
Figure 73C:
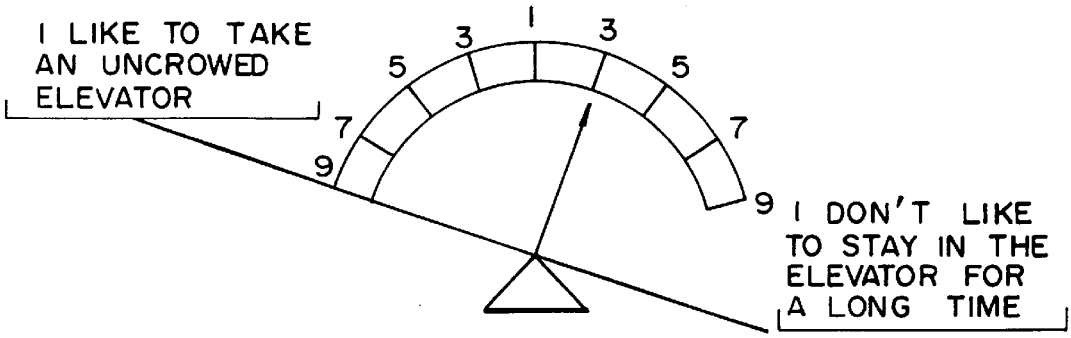

Relative priority subject to the one-to-one comparison based on AHP technique can be inputted by referring to inclination of a balance, as illustrated in FIGS. 73A to 73C. This example is effective to express the priority by making abstract concept indicative of weight for control target correspond to physical concept of weight represented by inclination of the balance.

Figure 74:
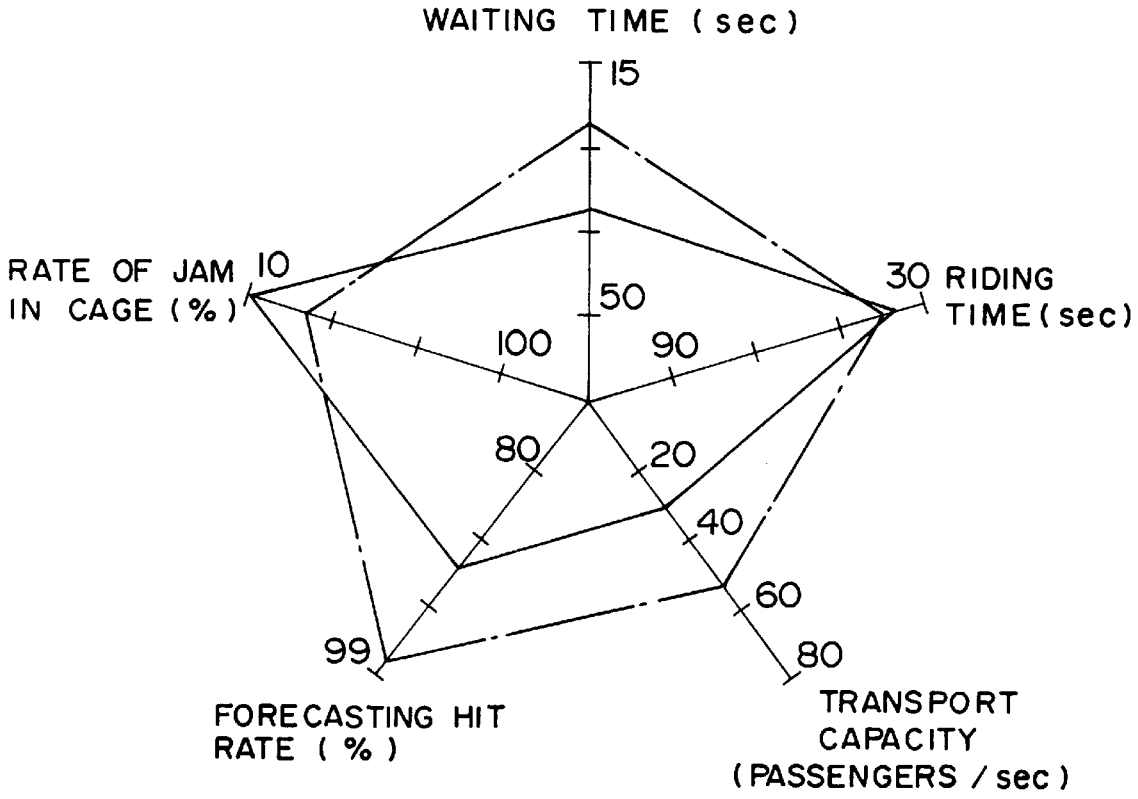
FIG. 74 is a radar chart on which target values for control goal and corresponding predictive values are indicated.

Illustrated in FIG. 74 is a radar chart on which target values for control goal inputted through the request input unit are indicated at chained line and predictive values are indicated at solid line.

In an alternative, the weight value or priority rank may be determined directly from the inputted feeling or request item by using AHP technique without resort to intervention of the determination of control target or the weight value or priority rank may be determined by directly inputting control target items and processing the items through AHP.

To sum up, the embodiments of FIGS. 64 and 66 principally feature that various requests inputted by the user are applied with weighting or priority ranking through, for example, AHP and fetched into group supervisory control.

Especially, items of inputted data representative of customer's feeling or request concerning elevator running, items of data representative of a plurality of control targets (at least two or more of hall waiting time, riding time, reservation change rate, transport capability, passenger number, rate of occurrence of longtime waiting, reservation informing time, rate of first arrival unresponsive to cage call, frequency of nonstop of cage, frequency of nonstop of full-up cage, information guide amount, noise level, energy saving, frequency of elevator start and scheduled operation) determined from the inputted request, or items of data representative of directly inputted control targets are applied with weighting or priority ranking through AHP by using the concept of weight of the items.

Structurally, the elevator control system directed to group supervisory control in accordance with the present embodiment comprises input means for inputting feeling or requests derivable from taste, sense of value or preference of the user or building caretaker which are used for determining a plurality of control targets for elevator, means for deducing control target items and control target values from the input requests, means for calculating weight values or priority ranks for the qualitative requests of the user or building caretaker through AHP, and means for deducing a control method capable of realizing control target values applied with weights or priority ranks.

More effectively, the knowledge base, adapted to precedently store knowledge of environment surrounding the elevator system, the number of elevators and elevator performance, may be used for deduction.

The guidance mode can be employed in order for the deduction to be carried out through conversational cooperation with the user or building caretaker. means is provided for determining a predictive value of control target and presenting the predictive value to the user in the form of, for example, a graph, thereby ensuring that in the course of the conversational cooperation with the user or building caretaker, the predictive value can be presented in an easy-to-understand manner. operationally, the input means is first used in order to determine a control target corresponding to an inputted feeling or request. To this end, environment surrounding the elevator such as the type of building and elevator performance such as elevator speed are inputted or designated by the user and questions originating from the input data are sequentially answered by the user to deduce control target values.

Particularly, this deduction is carried out using data in the knowledge base adapted to precedently store knowledge necessary for converting the input request into a reasonable control target value on the basis of the elevator-surrounding environment and elevator performance.

Thereafter, feeling or requests corresponding to the control target values are subjected to the one-to-one comparison and a one-to-one comparison matrix is prepared on the basis of comparison results. Subsequently, characteristic vector and eigervalue of the one-to-one comparison matrix are determined and components of the characteristic vector are then determined to be weights for individual control targets.

Subsequently, by using the thus determined control target values for control goal and associated weights, predictive values of the control targets are determined and the thus determined predictive values are presented to the user or building caretaker in the form of an easy-to-understand graph to enable the user to conversationally determine an elevator control method, thus realizing elevator control which is acceptable to the user or building caretaker.

As is clear from the above, in accordance with the present embodiment, weighting or priority ranking for items inputted by the user can be achieved easily.

Further, not only the conventional control items such as waiting time at the hall and energy saving but also requests of the customer concerning many items such as riding time, reservation change rate and passenger number can be controlled harmonically, and the requests of the user or building caretaker concerning the control items can be inputted in an easy-to-understand form such as feeling and predictive values of the control items can be presented to the customer, thereby making it possible to realize elevator control satisfactory to the customer.

We claim:

1. An elevator control system having a plurality of elevators serving a plurality of floors and a control apparatus for group supervisory control of the elevators, wherein each of the elevators has a predetermined maximum passenger load for its respective cage, said control apparatus comprising:

means for detecting the passenger load of each of said cages of said elevators as a proportion of the corresponding maximum passenger load;

means for determining control targets of said elevators by permitting input of information concerning said control targets, said control targets indicating desired operating conditions of said elevators and including information indicating respective desired passenger loads of said cages of said elevators, said desired passenger loads being a proportion less than unity of the corresponding maximum passenger load;

means for determining a control strategy on the basis of the inputted information concerning said control targets; and means for executing group supervisory control on the basis of the control strategy to cause the elevators to operate so that the detected passenger loads of the elevators can approach the corresponding desired passenger loads.

2. An elevator control apparatus according to claim 1, wherein said control targets further include waiting times.

3. An elevator control apparatus according to claims 1 or 2, wherein said control targets further include riding times.

4. A method of controlling an elevator system comprising a plurality of elevators serving a plurality of floors and a control apparatus for group supervisory control of the elevators, wherein each of the elevators has a predetermined maximum passenger load for its respective cage, said method comprising the steps of:

detecting the passenger load of each of said cages of said elevators as a proportion of the corresponding maximum passenger load;

determining control targets of said elevators by permitting input of information concerning said control targets, said control targets indicating desired operating conditions of said elevators and including information indicating respective desired passenger loads of said cages of said elevators, said desired passenger loads being a proportion less than unity of the corresponding maximum passenger load;

determining a control strategy on the basis of the inputted information concerning said control targets; and executing group supervisory control on the basis of the control strategy to cause the elevators to operate so that the detected passenger loads of the elevators can approach the corresponding desired passenger loads.

5. An elevator control system having a plurality of elevators serving a plurality of floors and a control apparatus for group supervisory control of the elevators, wherein each of the elevators provides service to a passenger on one of the floors, said control apparatus comprising:

means for calculating for each of said cages of said elevators a waiting time within which said cage provides service to a passenger on one of the floors;

means for determining control targets of said elevators by permitting input of information concerning said control targets, said control targets indicating desired operating conditions of said elevators and including information indicating respective desired waiting times for said cages of said elevators;

means for determining a control strategy on the basis of the inputted information concerning said control targets; and means for executing group supervisory control on the basis of the control strategy to cause the elevators to operate so that the detected wait times of the elevators can approach the corresponding desired waiting times.

6. An elevator control system according to claim 5, wherein said control targets further include passenger loads.

7. An elevator control system according to claims 5 or 6, wherein said control targets further include riding times.

8. A method of controlling an elevator system comprising a plurality of elevators serving a plurality of floors and a control apparatus for group supervisory control of the elevators, wherein each of the elevators provides service to a passenger on one of the floors said method comprising the steps of:

calculating for each of said cages of said elevators a waiting time within which said cage provides service to a passenger on one of the floors;

determining control targets of said elevators by permitting input of information concerning said control targets, said control targets indicating desired operating conditions of said elevators and including information indicating respective desired waiting times of said cages of said elevators;

determining an control strategy on the basis of the inputted information concerning said control targets; and executing group supervisory control on the basis of the control strategy to cause the elevators to operate so that the detected waiting time of the elevators can approach the corresponding desired waiting times.

9. An elevator control system having a plurality of elevators serving a plurality of floors and a control apparatus for group supervisory control of the elevators, wherein each of the elevators caries passengers from one of said floors to another of said floors, said control apparatus comprising:

means for detecting for each of said cages of said elevators a riding time within which passengers are carried from one of the floors to another of the floors;

means for determining control targets of said elevators by permitting input of information concerning said control targets, said control targets indicating desired operating conditions of said elevators and including information indicating respective desired riding times for said cages of said elevators;

means for determining a control strategy on the basis of the inputted information concerning said control targets; and means for executing group supervisory control on the basis of the control strategy to cause the elevators to operate so that the detected riding times of the elevators can approach the corresponding desired riding times.

10. An elevator control system according to claim 9, wherein said control targets further include waiting times.

11. An elevator control system according to claims 9 or 10, wherein said control targets further include passenger loads.

12. A method of controlling an elevator system comprising a plurality of elevators serving a plurality of floors and a control apparatus for group supervisory control of the elevators, wherein each of the elevators carries passengers from one of said floors to another of said floors, said method comprising the steps of:

detecting for each of said cages of said elevators a riding time within which passengers are carried from one of the floors to another of the floors;

determining control targets of said elevators by permitting input of information concerning said control targets, said control targets indicating desired operating conditions of said elevators and including information indicating respective desired riding times of said cages of said elevators;

determining a control strategy on the basis of the inputted information concerning said control targets; and executing group supervisory control on the basis of the control strategy to cause the elevators to operate so that the detected riding times of the elevators can approach the corresponding desired riding times.

13. An elevator control system for controlling a plurality of elevators serving a plurality of floors using a control apparatus for group supervisory control of the elevators, said control apparatus comprising:

means for indicating a predetermined range of values for each of a plurality of control targets defining desired service of the elevators to the floors in a manner to permit selection of a particular value of a control target during operation of the elevators and permitting selection of a value for a control target from said predetermined range of values for said control target; and means for providing the desired service of the elevators to the floors based on said selected value of said control target, to cause the elevators to operate, taking into account selected values for all of said control targets including waiting time.

14. An elevator control system according to claim 13, wherein said control targets includes the number of passengers in each of the elevators relative to the rated capacity of the elevators and the rate at which reservations for the elevators are made.

15. An elevator control system according to claim 13, wherein said control targets includes transport capability and passenger number.

16. An elevator control system according to claim 13, wherein said control targets includes rate of occurrence of a long waiting time and information indicating a time at which a reservation is made for an elevator.

17. An elevator control system according to claim 13, wherein said control targets includes rate of first arrived elevator responding to cage call and frequency of non-stop of cage.

18. An elevator control system according to claim 13, wherein said control targets includes a rate of occurrence of users selecting information which provides guidance for operating the elevators and noise level.

19. An elevator control system according to claim 13, wherein said control targets includes rate occurrence of energy saving and frequency of start of elevator.

20. An elevator control system according to claim 13, wherein said control targets includes rate occurrence of scheduled running and waiting time.

21. A method of controlling an elevator system which includes a plurality of elevators serving a plurality of floors and a control apparatus for group supervisory control of said elevators, said method comprising the steps of:

permitting input of control targets of said elevators including a degree of jam in cages of said elevators, said degree of jam represents the number of passengers in each of said cages of said elevators relative to the rated capacity of said elevators, said control targets indicating desired operating conditions of said elevators; and executing group supervisory control based on a selected control target.

22. A method according to claim 21, wherein said control targets further include waiting times.

23. A method according to claim 22, wherein said control targets further include riding times.

24. A method according to claim 21, wherein said control targets further include riding times.

25. An elevator control method for group supervisory control of a plurality of elevators serving a plurality of floors, comprising the steps of:

indicating target levels within a predetermined range for each of a plurality of request items defining running characteristics of the elevators in a manner selectable by a user of said elevators;

allowing said user to input a target level selected by said user for each request item;

calculating at least a call assignment evaluation formula and/or parameters from said inputted target levels; and executing one of a predetermined group supervisory control methods in accordance with said evaluation formula and/or parameters.

26. An elevator control method according to claim 25, further comprising the step of:

converting said inputted target levels into a plurality of quantitative control targets by using a knowledge base.

27. An elevator control method according to claim 26, wherein said control targets use as an evaluation item at least one of waiting time, rate of occurrence of longtime waiting, riding time, reservation informing time, reservation hit rate, degree of jam in cage, transport capability, rate of nonstop of cage, information guide amount, energy saving rate, noise suppression rate and degree of jam in hall, whereby said control targets are improved using said evaluation item.

28. An elevator control method according to claim 26, wherein said request items represent qualitative desires concerning elevator running which originate from sense of value, interest, taste, sense or preference of said user or a caretaker of a building in which said elevators are installed.

29. An elevator control method according to claim 26, wherein said target levels are inputted by answering a question regarding a plurality of predetermined request items in guidance fashion.

30. An elevator control method according to claim 26, wherein in said conversion, inputted target levels are converted into a plurality of control targets in accordance with knowledge stored in said knowledge base, weighting or priority ranking between said control targets is performed, and said control targets are determined quantitatively.

31. An elevator control method for group supervisory control of a plurality of elevators serving a plurality of floors, comprising the steps of:

indicating target levels within a predetermined range for each of a plurality of request items defining running characteristics of the elevators in a manner selectable by a user of said elevators;

allowing said user to input a target level selected by said user for each request time;

calculating at least a call assignment evaluation formula in group supervisory control and/or parameters from said inputted target levels; and executing the group supervisory control in accordance with said evaluation formula and/or parameters;

wherein said input target levels are converted into control targets for elevator, and said evaluation formula and/or parameters are calculated using said control targets.

32. An elevator control method for group supervisory control of a plurality of elevators serving a plurality of floors, comprising the steps of:

indicating target levels within a predetermined range for each of a plurality of request items defining running characteristics of the elevators in a manner selected by said user of said elevators;

allowing said user to input a target level selected by said user for each request item;

calculating at least a call assignment evaluation formula in group supervisory control and/or parameters from said inputted target levels;

executing the group supervisory control in accordance with said evaluation formula and/or parameters; and converting said inputted target levels into a plurality of quantitative control targets by using a knowledge base;

wherein said knowledge base is constructed of a table showing correlation between target levels and a plurality of control targets which can be determined quantitatively.

33. An elevator control method according to claim 32, wherein said knowledge base corrects said correlation in accordance with the type of a building at which said elevators are installed.

34. An elevator control method for group supervisory control of a plurality of elevators serving a plurality of floors, comprising the steps of:

indicating target levels within a predetermined range for each of a plurality of request items defining running characteristics of the elevators in a manner selectable by a user of said elevators;

allowing said user to input a target level selected by said user for each request item;

calculating at least a call assignment evaluation formula in group supervisory control and/or parameters from said inputted target levels;

executing the group supervisory control in accordance with said evaluation formula and/or parameters;

converting said inputted target levels into a plurality of quantitative control targets by using a knowledge base;

displaying individual request items in the form of a radar chart; and inputting target levels for said request items by using said radar chart.

35. An elevator control system having a plurality of elevators serving a plurality of floors and a control apparatus for group supervisory control of the elevators, wherein each of the elevators has a predetermined maximum passenger load for its respective cage, said control apparatus comprising:

a detector which detects the passenger load of each of said cages of said elevators as a proportion of the corresponding maximum passenger load;

a decision unit which determines control targets of said elevators by permitting input of information concerning said control targets, said control targets indicating desired operating conditions of said elevators and including information indicating respective desired passenger loads of said cages of said elevators, said desired passenger loads being a proportion less than unity of the corresponding maximum passenger load, and determines a control strategy on the basis of the inputted information concerning said control targets; and a control unit which executes group supervisory control on the basis of the control strategy to cause the elevators to operate so that the detected passenger loads of the elevators can approach the corresponding desired passenger loads.

36. An elevator control apparatus according to claim 35, wherein said control targets further include waiting times.

37. An elevator control apparatus according to claim 35 or 36, wherein said control targets further include riding times.

38. An elevator control system having a plurality of elevators serving a plurality of floors and a control apparatus for group supervisory control of the elevators, wherein each of the elevators provides service to a passenger on one of the floors, said control apparatus comprising:

a decision unit which calculates for each of said cages of said elevators a waiting time within which said cage provides service to a passenger on one of the floors, determines control targets of said elevators by permitting input of information concerning said control targets, said control targets indicating desired operating conditions of said elevators and including information indicating respective desired waiting times for said cages of said elevators, and determines a control strategy on the basis of the inputted information concerning said control targets; and a control unit which executes group supervisory control on the basis of the control strategy to cause the elevators to operate so that the detected wait times of the elevators can approach the corresponding desired waiting times.

39. An elevator control system according to claim 38, wherein said control targets further include passenger loads.

40. An elevator control system according to claim 38 or 39, wherein said control targets further include riding times.

41. An elevator control system having a plurality of elevators serving a plurality of floors and a control apparatus for group supervisory control of the elevators, wherein each of the elevators caries passengers from one of said floors to another of said floors, said control apparatus comprising:

a detector which detects for each of said cages of said elevators a riding time within which passengers are carried from one of the floors to another of the floors;

a decision unit which determines control targets of said elevators by permitting input of information concerning said control targets, said control targets indicating desired operating conditions of said elevators and including information indicating respective desired riding times for said cages of said elevators, and determines a control strategy on the basis of the inputted information concerning said control targets; and a control unit which executes group supervisory control on the basis of the control strategy to cause the elevators to operate so that the detected riding times of the elevators can approach the corresponding desired riding times.

42. An elevator control system according to claim 41, wherein said control targets further include waiting times.

43. An elevator control system according to claim 41 or 42, wherein said control targets further include passenger loads.

44. An elevator control system for controlling a plurality of elevators serving a plurality of floors using a control apparatus for group supervisory control of the elevators, said control apparatus comprising:

a request unit which indicates a predetermined range of values for each of a plurality of control targets defining service of the elevators to the floors in a manner to permit selection of a particular value of a control target during operation of the elevators and wherein permits selection of a value for a control target from said predetermined range of values for said control target; and a control unit which provides the desired service of the elevators to the floors based on said selected value of said control target, to cause the elevators to operate, taking into account selected values for all of said control targets including waiting time.

45. An elevator control system according to claim 44, wherein said control targets includes the number of passengers in each of the elevators relative to the rated capacity of the elevators and the rate at which reservations for the elevators are made.

46. An elevator control system according to claim 44, wherein said control targets includes transport capability and passenger number.

47. An elevator control system according to claim 44, wherein said control targets includes rate of occurrence of a long waiting time and information indicating a time at which a reservation is made for an elevator.

48. An elevator control system according to claim 44, wherein said control targets includes rate of first arrived responding to cage call and frequency of non-stop of cage.

49. An elevator control system according to claim 44, wherein said control targets includes a rate of occurrence of users selecting information which provides guidance for operating the elevators and noise level.

50. An elevator control system according to claim 44, wherein said control targets includes rate occurrence of energy saving and frequency of start of elevator.

51. An elevator control system according to claim 44, wherein said control targets includes rate occurrence of scheduled running and waiting time.

* * * * *